US008152515B2

(12) United States Patent
Deng

(10) Patent No.: US 8,152,515 B2
(45) Date of Patent: Apr. 10, 2012

(54) FUEL SELECTABLE HEATING DEVICES

(75) Inventor: David Deng, Diamond Bar, CA (US)

(73) Assignee: Continental Appliances Inc, Brea, CA (US)

( * ) Notice: Subject to any disclaimer, the term of this patent is extended or adjusted under 35 U.S.C. 154(b) by 590 days.

(21) Appl. No.: 12/047,156

(22) Filed: Mar. 12, 2008

(65) Prior Publication Data

US 2008/0227045 A1 Sep. 18, 2008

Related U.S. Application Data

(60) Provisional application No. 60/895,119, filed on Mar. 15, 2007.

(51) Int. Cl.
*F23D 14/60* (2006.01)
*G05D 11/00* (2006.01)
*B67D 7/06* (2010.01)

(52) U.S. Cl. ..... 431/354; 137/111; 222/144.5

(58) Field of Classification Search ..... 431/354; 137/111; 222/144.5
See application file for complete search history.

(56) References Cited

U.S. PATENT DOCUMENTS

| | | | | |
|---|---|---|---|---|
| 743,714 | A | 11/1908 | Guese | |
| 1,051,072 | A | 1/1913 | Bradley | |
| 1,639,780 | A | 8/1927 | Mulholland | |
| 1,867,110 | A | 7/1932 | Signore | |
| 2,160,264 | A | 5/1939 | Furlong | |
| 2,380,956 | A | 8/1945 | Evarts | |
| 2,422,368 | A * | 6/1947 | Ray | 137/66 |
| 2,556,337 | A * | 6/1951 | Paille | 137/66 |
| 2,630,821 | A | 3/1953 | Arey Alton et al. | |
| 2,687,140 | A | 8/1954 | St. Clair et al. | |
| 2,905,361 | A * | 9/1959 | Noall | 222/1 |
| 3,001,541 | A | 9/1961 | St. Clair et al. | |
| 3,032,096 | A * | 5/1962 | Stoul | 431/283 |

(Continued)

FOREIGN PATENT DOCUMENTS

DE 720 854 C 5/1942

(Continued)

OTHER PUBLICATIONS

Consumer Guide to Vent-Free Gas Supplemental Heating Products, est. 2007, p. 10-11.

(Continued)

*Primary Examiner* — Steven B McAllister
*Assistant Examiner* — Frances H Kamps
(74) *Attorney, Agent, or Firm* — Knobbe Martens Olson & Bear LLP

(57) ABSTRACT

In certain embodiments, an apparatus includes a burner. The apparatus can also include an intake valve that includes an input for receiving fuel from either a first fuel source at a first pressure or a second fuel source at a second pressure. The intake valve can include a first output for directing fuel received from the first fuel source and a second output for directing fuel received from the second fuel source. The intake valve can include an actuator configured to permit fluid communication between the input and the first output or between the input and the second output. The apparatus can include a pressure regulator that can include a first inlet for receiving fuel from the first output of the intake valve and a second inlet for receiving fuel from the second output of the intake valve. The regulator can also include an outlet for directing fuel from the pressure regulator toward the burner.

19 Claims, 30 Drawing Sheets

U.S. PATENT DOCUMENTS 3,139,879 A 7/1964 Bauer et al.
3,331,392 A 7/1967 Davidson et al.
3,417,779 A 12/1968 Golay
3,430,655 A * 3/1969 Forney ..... 137/625.47
3,590,806 A 7/1971 Locke
3,800,830 A 4/1974 Etter
3,814,573 A 6/1974 Karlovetz
3,829,279 A * 8/1974 Qualley et al. ..... 431/354
3,884,413 A 5/1975 Berquist
3,939,871 A * 2/1976 Dickson ..... 137/625.47
D243,694 S 3/1977 Faulkner
4,021,190 A * 5/1977 Dickson ..... 431/280
4,081,235 A 3/1978 van der Veer
4,101,257 A * 7/1978 Straitz, III ..... 431/15
4,290,450 A 9/1981 Swanson
4,301,825 A * 11/1981 Simko ..... 137/111
4,340,362 A 7/1982 Chalupsky et al.
4,348,172 A 9/1982 Miller
4,355,659 A 10/1982 Kelchner
4,359,284 A 11/1982 Kude et al.
4,474,166 A 10/1984 Shaftner et al.
4,640,680 A 2/1987 Schilling
4,718,846 A 1/1988 Oguri et al.
4,768,543 A 9/1988 Wienke et al.
4,768,947 A 9/1988 Adachi
4,782,814 A 11/1988 Cherryholmes
4,796,652 A * 1/1989 Hafla ..... 137/116.3
4,848,313 A 7/1989 Velie
4,874,006 A 10/1989 Iqbal
4,930,538 A 6/1990 Browne
4,965,707 A 10/1990 Butterfield
5,025,990 A 6/1991 Ridenour
5,027,854 A 7/1991 Genbauffe
5,090,899 A 2/1992 Kee
5,172,728 A 12/1992 Tsukazaki
5,239,979 A 8/1993 Maurice et al.
5,251,823 A 10/1993 Joshi et al.
5,278,936 A 1/1994 Shao
5,379,794 A 1/1995 Brown
5,413,141 A * 5/1995 Dietiker ..... 137/489
5,470,018 A 11/1995 Smith
5,513,798 A 5/1996 Tavor
5,542,609 A 8/1996 Myers et al.
5,567,141 A 10/1996 Joshi et al.
5,584,680 A 12/1996 Kim
5,591,024 A 1/1997 Eavenson et al.
5,603,211 A 2/1997 Graves
5,642,580 A 7/1997 Hess et al.
5,645,043 A 7/1997 Long et al.
D391,345 S 2/1998 Mandir et al.
5,782,626 A 7/1998 Joos et al.
5,787,874 A 8/1998 Krohn et al.
5,787,928 A 8/1998 Allen et al.
5,807,098 A 9/1998 Deng
5,814,121 A 9/1998 Travis
5,838,243 A 11/1998 Gallo
5,915,952 A 6/1999 Manning et al.
5,941,699 A 8/1999 Abele
5,966,937 A 10/1999 Graves
5,971,746 A * 10/1999 Givens et al. ..... 431/12
5,975,112 A 11/1999 Ohmi et al.
5,987,889 A 11/1999 Graves et al.
5,988,204 A 11/1999 Reinhardt et al.
6,035,893 A 3/2000 Ohmi et al.
6,045,058 A 4/2000 Dobbeling et al.
6,076,517 A 6/2000 Kahlke et al.
6,135,063 A 10/2000 Welden
6,227,451 B1 5/2001 Caruso
6,244,223 B1 6/2001 Welk
6,244,524 B1 6/2001 Tackels et al.
6,257,270 B1 7/2001 Ohmi et al.
6,340,298 B1 1/2002 Vandrak et al.
6,354,072 B1 3/2002 Hura
6,354,078 B1 * 3/2002 Karlsson et al. ..... 60/274
6,543,235 B1 4/2003 Crocker et al.
6,607,854 B1 * 8/2003 Rehg et al. ..... 429/413
6,648,635 B2 11/2003 Vandrak et al.
6,786,194 B2 * 9/2004 Koegler et al. ..... 123/304
6,845,966 B1 1/2005 Albizuri
6,884,065 B2 4/2005 Vandrak et al.
6,901,962 B2 6/2005 Kroupa et al.
6,904,873 B1 6/2005 Ashton
6,938,634 B2 * 9/2005 Dewey, Jr. ..... 137/1
7,013,886 B2 3/2006 Deng
7,044,729 B2 5/2006 Ayastuy
7,048,538 B2 5/2006 Albizuri
7,156,370 B2 1/2007 Albizuri
7,174,913 B2 2/2007 Albizuri
7,201,186 B2 4/2007 Ayastuy
7,251,940 B2 8/2007 Graves et al.
7,299,799 B2 11/2007 Albizuri
7,367,352 B2 5/2008 Hagen et al.
7,386,981 B2 * 6/2008 Zielinski et al. ..... 60/772
7,434,447 B2 10/2008 Deng
7,458,386 B2 12/2008 Zhang
7,487,888 B1 * 2/2009 Pierre, Jr. ..... 222/144.5
7,490,869 B2 2/2009 Iturralde et al.
7,528,608 B2 5/2009 Elexpuru et al.
7,533,656 B2 * 5/2009 Dingle ..... 123/507
7,591,257 B2 9/2009 Bayer et al.
7,600,529 B2 10/2009 Querejeta
7,607,325 B2 10/2009 Elexpuru et al.
7,607,426 B2 10/2009 Deng
7,634,993 B2 12/2009 Bellomo
7,637,476 B2 12/2009 Mugica et al.
7,641,470 B2 1/2010 Albizuri
7,651,330 B2 1/2010 Albizuri
7,654,820 B2 * 2/2010 Deng ..... 431/74
7,677,236 B2 3/2010 Deng
7,730,765 B2 6/2010 Deng
7,758,323 B2 7/2010 Orue
7,766,006 B1 8/2010 Manning
7,861,706 B2 1/2011 Bellomo
2002/0058266 A1 5/2002 Clough et al.
2002/0160325 A1 10/2002 Deng
2002/0160326 A1 10/2002 Deng
2003/0217555 A1 11/2003 Gerhold
2004/0238030 A1 12/2004 Dewey, Jr.
2005/0167530 A1 8/2005 Ward et al.
2005/0202361 A1 9/2005 Albizuri
2005/0208443 A1 9/2005 Bachinski et al.
2006/0096644 A1 5/2006 Goldfarb et al.
2006/0201496 A1 9/2006 Shingler
2007/0044856 A1 3/2007 Bonior
2007/0154856 A1 * 7/2007 Hallit et al. ..... 431/62
2007/0210069 A1 9/2007 Albizuri
2007/0277803 A1 12/2007 Deng
2008/0121116 A1 5/2008 Albizuri
2008/0149871 A1 6/2008 Deng
2008/0149872 A1 6/2008 Deng
2008/0153044 A1 6/2008 Deng
2008/0153045 A1 6/2008 Deng
2008/0168980 A1 7/2008 Lyons et al.
2008/0223465 A1 9/2008 Deng
2008/0227045 A1 9/2008 Deng
2008/0236688 A1 10/2008 Albizuri
2008/0236689 A1 10/2008 Albizuri
2008/0314090 A1 12/2008 Orue Orue et al.
2009/0039072 A1 2/2009 Llona
2009/0139304 A1 6/2009 Deng
2009/0140193 A1 6/2009 Albizuri Landa
2009/0159068 A1 6/2009 Querejeta et al.
2009/0280448 A1 11/2009 Antxia Uribetxebarria et al.
2010/0035195 A1 2/2010 Querejeta Andueza et al.
2010/0035196 A1 2/2010 Deng
2010/0037884 A1 2/2010 Deng
2010/0086884 A1 4/2010 Querejeta Andueza et al.
2010/0086885 A1 4/2010 Querejeta Andueza et al.
2010/0089385 A1 4/2010 Albizuri
2010/0089386 A1 4/2010 Albizuri
2010/0095945 A1 4/2010 Manning
2010/0154777 A1 6/2010 Carvalho et al.
2010/0170503 A1 7/2010 Deng
2010/0255433 A1 10/2010 Querejeta Andueza et al.
2010/0275953 A1 11/2010 Orue Orue et al.
2010/0304317 A1 12/2010 Deng
2010/0310997 A1 12/2010 Mugica Odriozola et al.

| | | | |
|---|---|---|---|
| 2010/0326422 | A1 | 12/2010 | Deng |
| 2010/0326430 | A1 | 12/2010 | Deng |
| 2010/0330513 | A1 | 12/2010 | Deng |
| 2010/0330518 | A1 | 12/2010 | Deng |
| 2010/0330519 | A1 | 12/2010 | Deng |
| 2011/0081620 | A1 | 4/2011 | Deng |

FOREIGN PATENT DOCUMENTS

| | | | | |
|---|---|---|---|---|
| JP | 58 219320 | A | | 12/1983 |
| JP | 03 230015 | A | | 10/1991 |
| JP | 2003 056845 | A | | 2/2003 |
| JP | 2003 074837 | A | | 3/2003 |
| JP | 2003 074838 | A | | 3/2003 |
| JP | 2003074838 | A | * | 3/2003 |
| WO | WO 2008/071970 | | | 6/2008 |

OTHER PUBLICATIONS

Office Action in U.S. Appl. No. 11/649,976 mailed Nov. 17, 2009.
International Search Report and Written Opinion for International Application No. PCT/US2010/039668, Notification mailed Oct. 1, 2010.
International Search Report and Written Opinion for International Application No. PCT/US2010/039687, Notification mailed Oct. 5, 2010.
International Search Report and Written Opinion for International Application No. PCT/US2010/039655, Notification mailed Jan. 14, 2011.
International Search Report and Written Opinion for International Application No. PCT/US2010/039681, Notification mailed Jan. 12, 2011.
Heat and Glo, Escape-42DV Owner's Manual, Rev. i, Dec. 2006.
Heat and Glo, Escape Series Gas Fireplaces, Mar. 2005.
Napoleon, Park Avenue Installation and Operation Instructions, Jul. 20, 2006.
Napoleon, The Madison Installation and Operation Instructions, May 24, 2005.
U.S. Appl. No. 11/443,484, filed May 30, 2006, titled "Pressure Regulator", listing David Deng as inventor.
U.S. Appl. No. 11/443,446, filed May 30, 2006, titled "Nozzle", listing David Deng as inventor.
U.S. Appl. No. 11/443,492, filed May 30, 2006, titled "Oxygen Depletion Sensor", listing David Deng as inventor.
U.S. Appl. No. 11/443,473, filed May 30, 2006, titled "Heater", listing David Deng as inventor.
U.S. Appl. No. 11/649,976, filed Jan. 5, 2007, titled "Valve Assemblies for Heating Devices", listing David Deng as inventor.
U.S. Appl. No. 11/650,401, filed Jan. 5, 2007, titled "Valve Assemblies for Heating Devices", listing David Deng as inventor.
U.S. Appl. No. 11/649,930, filed Jan. 5, 2007, titled "Control Valves for Heaters and Fireplace Devices", listing David Deng as inventor.
U.S. Appl. No. 11/943,359, filed Nov. 20, 2007, titled "Control Valves for Heaters and Fireplace Devices", listing David Deng as inventor.
U.S. Appl. No. 12/047,206, filed Mar. 12, 2008, titled "Log Sets and Lighting Devices Therefor", listing Kirk J. Kirchner, Toby P. Frink and Ron G. Smith as inventors.
U.S. Appl. No. 12/048,191, filed Mar. 13, 2008, titled "Fuel Selection Valve Assemblies", listing David Deng as inventor.
International Search Report for Application No. PCT-US2008-056910 (the PCT counterpart of the parent application) mailed Jul. 16, 2008.

* cited by examiner

FIG. 26A
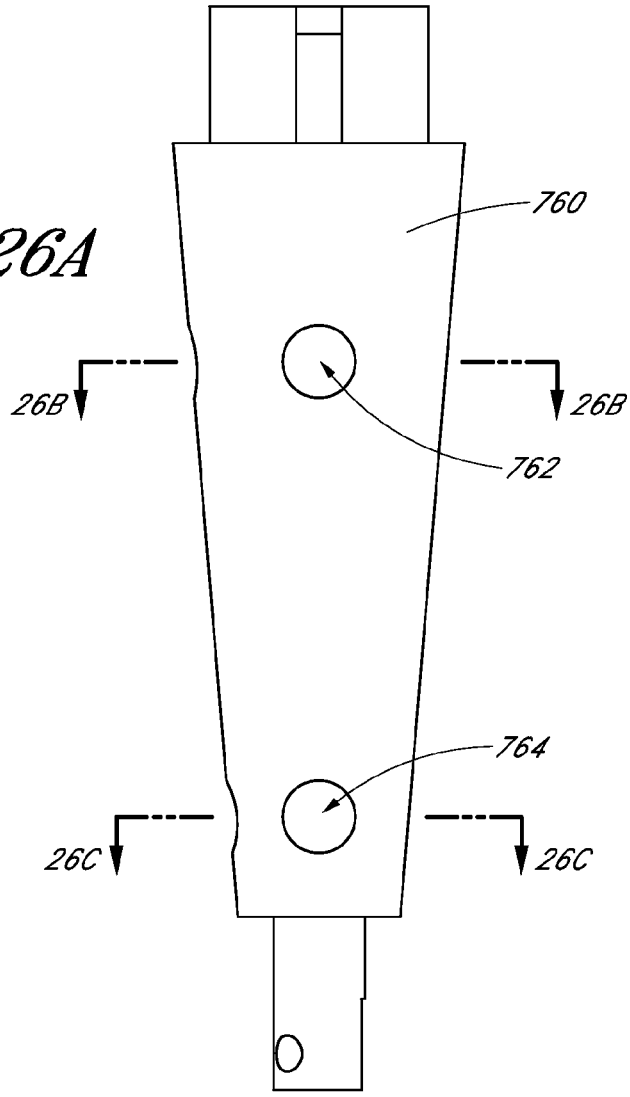
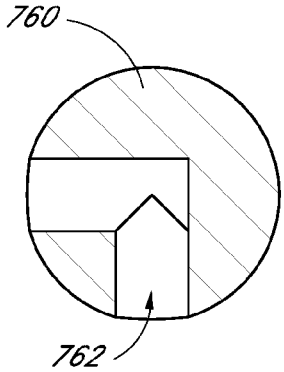
FIG. 26B
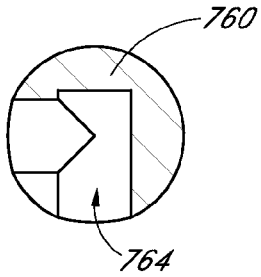
FIG. 26C

FUEL SELECTABLE HEATING DEVICES

CROSS-REFERENCE TO RELATED APPLICATIONS

This application claims the benefit under 35 U.S.C. §119 (e) of U.S. Provisional Application No. 60/895,119, filed Mar. 15, 2007, titled FUEL SELECTABLE HEATING DEVICES, the entire contents of which are hereby incorporated by reference herein and made a part of this specification.

BACKGROUND OF THE INVENTIONS

1. Field of the Inventions

Certain embodiments disclosed herein relate generally to heating devices, and relate more specifically to fluid-fueled heating devices, such as, for example, gas fireplaces.

2. Description of the Related Art

Many varieties of heaters, fireplaces, stoves, and other heating devices utilize pressurized, combustible fuels. Some such devices operate with liquid propane gas, while others operate with natural gas. However, such devices and certain components thereof have various limitations and disadvantages.

SUMMARY OF THE INVENTIONS

In certain embodiments, an apparatus includes a burner. The apparatus can also include an intake valve that includes an input for receiving fuel from either a first fuel source at a first pressure or a second fuel source at a second pressure. The intake valve can include a first output for directing fuel received from said first fuel source and a second output for directing fuel received from said second fuel source. The intake valve can further include an actuator configured to permit fluid communication between the input and the first output or between the input and the second output. The apparatus can include a pressure regulator. The pressure regulator can include a first inlet for receiving fuel from the first output of the intake valve and a second inlet for receiving fuel from the second output of the intake valve. The regulator can also include an outlet for directing fuel from the pressure regulator toward the burner.

In certain embodiments, an apparatus includes a burner. The apparatus can also include an intake valve that can include an input for receiving fuel from either a first fuel source or a second fuel source. The intake valve can include a first output for directing fuel received from said first fuel source. The intake valve can also include a second output for directing fuel received from said second fuel source. The intake valve can further include a first actuator configured to permit fluid communication between the input and the first output or between the input and the second output. In some embodiments, the apparatus includes a valve assembly, which can include a housing defining an inlet for receiving fuel from either the first output or the second output of the intake valve. The housing can further define a first egress flow path and a second egress flow path. The valve assembly can also include a valve body configured to direct fuel received from the first output of the intake valve along the first egress flow path toward the burner and to direct fuel received from the second output of the intake valve along the second egress flow path toward the burner.

BRIEF DESCRIPTION OF THE DRAWINGS

Various embodiments are depicted in the accompanying drawings for illustrative purposes, and should in no way be interpreted as limiting the scope of the inventions.

FIG. 26A is a front plan view of an embodiment of a valve body compatible with the valve assembly of FIG. 24.

FIG. 26B is a cross-sectional view of the valve body of FIG. 26A taken along the view line 26B-26B.

FIG. 26C is a cross-sectional view of the valve body of FIG. 26A taken along the view line 26C-26C.

DETAILED DESCRIPTION OF THE PREFERRED EMBODIMENTS

Figure 1:
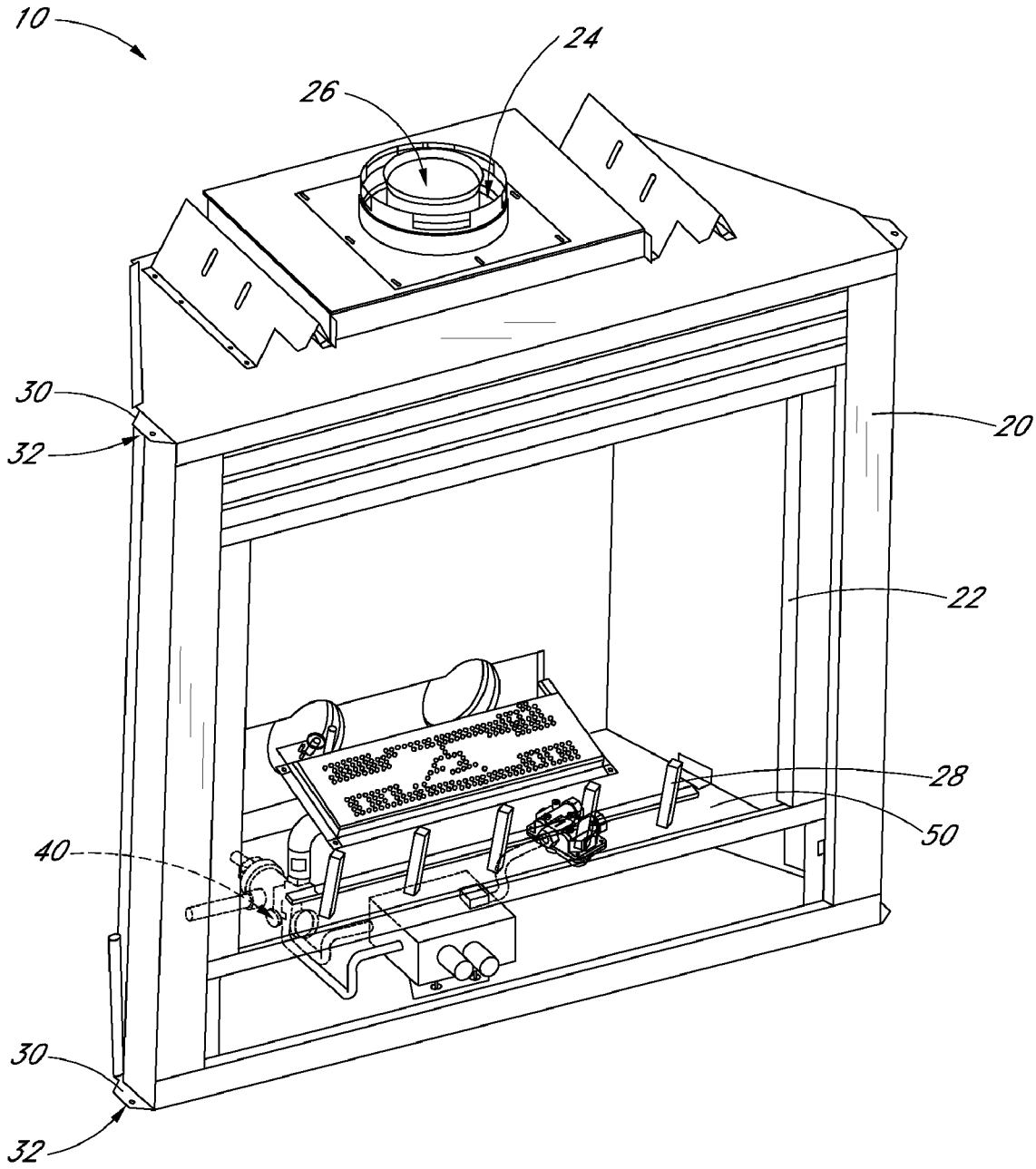
FIG. 1 is a perspective view of an embodiment of a heating device.

Many varieties of space heaters, wall heaters, stoves, fireplaces, fireplace inserts, gas logs, and other heat-producing devices employ combustible fluid fuels, such as liquid propane gas and natural gas. The term "fluid," as used herein, is a broad term used in its ordinary sense, and includes materials or substances capable of fluid flow, such as, for example, one or more gases, one or more liquids, or any combination thereof. Fluid-fueled units, such as those listed above, generally are designed to operate with a single fluid fuel type at a specific pressure or within a range of pressures. For example, some fluid-fueled heaters that are configured to be installed on a wall or a floor operate with natural gas at a pressure in a range from about 3 inches of water column to about 6 inches of water column, while others are configured to operate with liquid propane gas at a pressure in a range from about 8 inches of water column to about 12 inches of water column. Similarly, some gas fireplaces and gas logs are configured to operate with natural gas at a first pressure, while others are configured to operate with liquid propane gas at a second pressure that is different from the first pressure. As used herein, the terms "first" and "second" are used for convenience, and do not connote a hierarchical relationship among the items so identified, unless otherwise indicated.

In many instances, the operability of such fluid-fueled units with only a single fuel source is disadvantageous for distributors, retailers, and/or consumers. For example, retail stores often try to predict the demand for natural gas units versus liquid propane units over a given period of time, and consequently stock their shelves and/or warehouses with a percentage of each variety of unit. If such predictions prove incorrect, stores can be left with unsold units when the demand for one type was less than expected. On the other hand, some potential customers can be left waiting through shipping delays or even be turned away empty-handed when the demand for one type of unit was greater than expected. Either case can result in financial and other costs to the stores.

Additionally, consumers can be disappointed to discover that the styles or models of heaters, fireplaces, stoves, or other fluid-fueled units with which they wish to furnish their homes are incompatible with the type of fuel with which their homes are serviced. This situation can result in inconveniences and other costs to the consumers.

Furthermore, in many instances, fluid-fueled units can be relatively expensive, and further, can be relatively difficult and/or expensive to transport and/or install. For example, some fluid-fueled devices can sell for thousands of dollars, not including installation fees. In many instances, such devices include a variety of interconnected components and detailed instructions regarding proper installation techniques. Often, the installed units must be in compliance with various building codes and legal regulations. Accordingly, the units generally must be installed by a qualified professional, and often are installed during construction or remodeling of a home or other structure.

Accordingly, a change in the type of fuel with which a structure is serviced can result in a significant expense and inconvenience to the owner of the structure. Often, the owner must replace one or more units that are configured to operate on the old fuel type with one or more units that are configured to operate on the new fuel type. Such changes in fuel servicing are not uncommon. For example, some new housing subdivisions are completed before natural gas mains can be installed. As a result, the new houses may originally be serviced by localized, refillable liquid propane tanks. As a result, appliances and other fluid-fueled units that are configured to operate on propane may originally be installed in the houses and then might be replaced when natural gas lines become available.

Therefore, there is a need for fluid-fueled devices, and components thereof, that are configured to operate with more than one fuel source (e.g., with either a natural gas or a liquid propane fuel source). Such devices could alleviate and/or resolve at least the foregoing problems. Furthermore, fluid-fueled devices, and components thereof, that can transition among operational states in a simple manner are also desirable.

In addition, in some instances, the appearance of a flame produced by certain embodiments of fluid-fueled units is important to the marketability of the units. For example, some gas fireplaces and gas fireplace inserts are desirable as either replacements for or additions to natural wood-burning fireplaces. Such replacement units can desirably exhibit enhanced efficiency, improved safety, and/or reduced mess. In many instances, a flame produced by such a gas unit desirably resembles that produced by burning wood, and thus preferably has a substantially yellow hue.

Certain embodiments of fluid-fueled units can produce substantially yellow flames. The amount of oxygen present in the fuel at a combustion site of a unit (e.g., at a burner) can affect the color of the flame produced by the unit. Accordingly, in some embodiments, one or more components the unit are adjusted to regulate the amount of air that is mixed with the fuel to create a proper air/fuel mixture at the burner. Such adjustments can be influenced by the pressure at which the fuel is dispensed.

A particular challenge in developing some embodiments of fluid-fueled units that are operable with more than one fuel source (e.g., operable with a natural gas or a liquid propane fuel source) arises from the fact that different fuel sources are generally provided at different pressures. Additionally, in many instances, different fuel types require different amounts of oxygen to create a substantially yellow flame. Certain advantageous embodiments disclosed herein provide structures and methods for configuring a fluid-fueled device to produce a yellow flame using any of a plurality of different fuel sources, and in further embodiments, for doing so with relative ease.

Certain embodiments disclosed herein reduce or eliminate one or more of the foregoing problems associated with existing fluid-fueled devices and/or provide some or all of the desirable features detailed above. Although certain embodiments discussed herein are described in the context of directly vented heating units, such as fireplaces and fireplace inserts, it should be understood that certain features, principles, and/or advantages described are applicable in a much wider variety of contexts, including, for example, vent-free heating units, gas logs, heaters, heating stoves, cooking stoves, barbecue grills, water heaters, and any flame-producing and/or heat-producing fluid-fueled unit, including without limitation units that include a burner of any suitable variety.

FIG. 1 illustrates an embodiment of a fireplace, fireplace insert, heat-generating unit, or heating device 10 configured to operate with one or more sources of combustible fuel. In various embodiments, the heating device 10 is configured to be installed within a suitable cavity, such as the firebox of a fireplace or a dedicated outer casing. The heating device 10 can extend through a wall, in some embodiments.

In certain embodiments, the heating device 10 includes a housing 20. The housing 20 can include metal or some other suitable material for providing structure to the heating device 10 without melting or otherwise deforming in a heated environment. The housing 20 can define a window 22. In some embodiments, the window 22 defines a substantially open area through which heated air and/or radiant energy can pass. In other embodiments, the window 22 comprises a sheet of substantially clear material, such as tempered glass, that is substantially impervious to heated air but substantially transmissive to radiant energy.

In certain embodiments, the heating device 10 includes an intake vent 24 through which air can flow into the housing 20 and/or an outlet vent 26 through which heated air can flow out of the housing 20. In some embodiments, the heating device 10 includes a grill, rack, or grate 28. The grate 28 can provide a surface against which artificial logs may rest, and can resemble similar structures used in wood-burning fireplaces.

In certain embodiments, the housing 20 defines one or more mounting flanges 30 used to secure the heating device 10 to a floor and/or one or more walls. The mounting flanges 30 can include apertures 32 through which mounting hardware can be advanced. Accordingly, in some embodiments, the housing 20 can be installed in a relatively fixed fashion within a building or other structure.

In certain embodiments, the heating device 10 includes a fuel delivery system 40, which can have portions for accepting fuel from a fuel source, for directing flow of fuel within the heating device 10, and for combusting fuel. In the embodiment illustrated in FIG. 1, portions of an embodiment of the fuel delivery system 40 that would be obscured by the heating device 10 are shown in phantom. Specifically, the illustrated heating device 10 includes a floor 50 which forms the bottom of the combustion chamber and the components shown in phantom are positioned beneath the floor 50.

Figure 2:
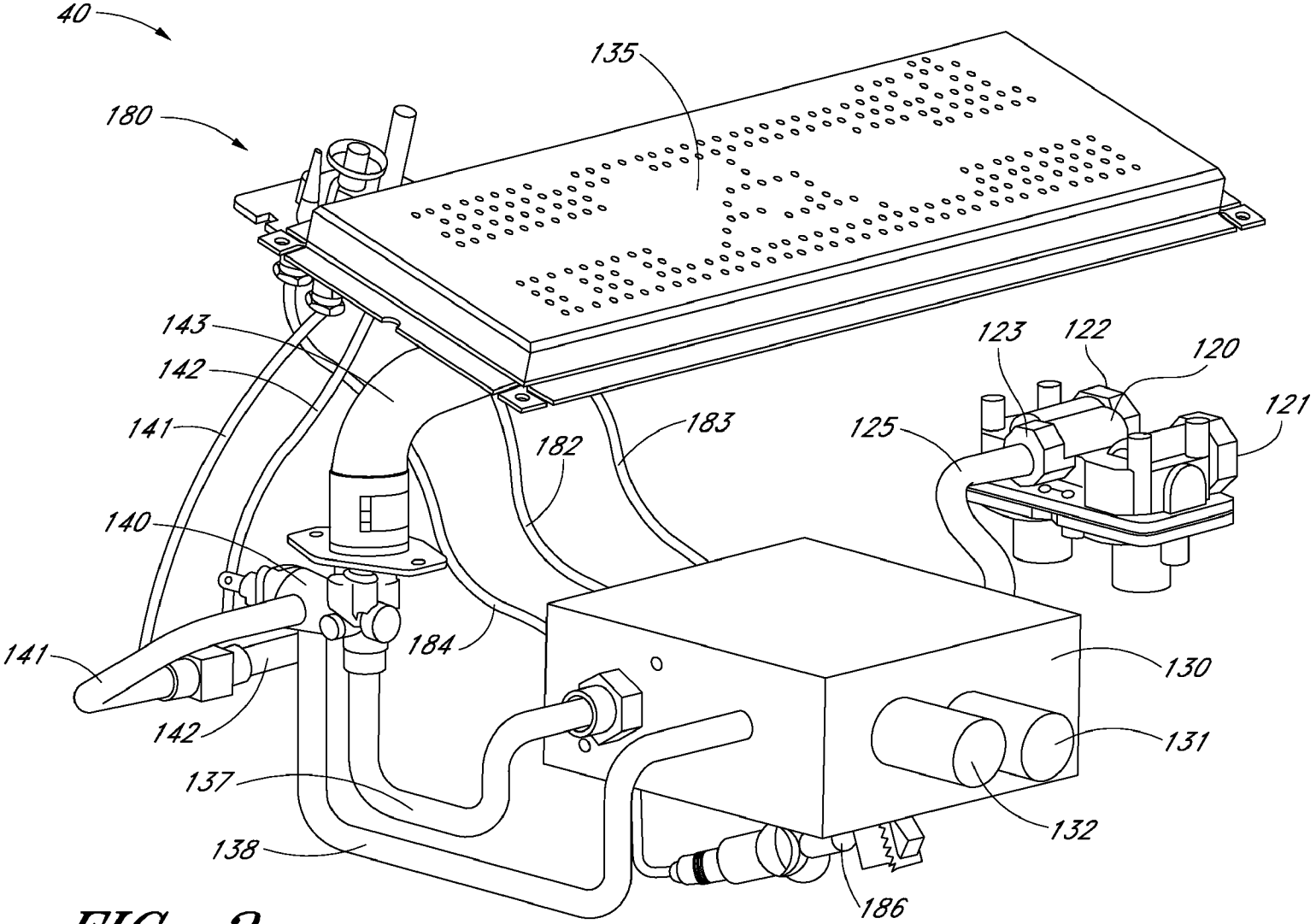
FIG. 2 is a perspective view of an embodiment of a fuel delivery system compatible with the heating device of FIG. 1.

With reference to FIG. 2, in certain embodiments, the fuel delivery system 40 includes a regulator 120. The regulator 120 can be configured to selectively receive either a first fluid fuel (e.g., propane) from a first source at a first pressure or a second fluid fuel (e.g., natural gas) from a second source at a second pressure. In certain embodiments, the regulator 120 includes a first input port 121 for receiving the first fuel and a second input port 122 for receiving the second fuel. In some embodiments, the second input port 122 is configured to be plugged when the first input port 121 is coupled with the first fuel source, and the first input port 121 is configured to be plugged when the second input port 122 is coupled with a second fuel source.

The regulator 120 can define an output port 123 through which fuel exits the regulator 120. Accordingly, in many embodiments, the regulator 120 is configured to operate in a first state in which fuel is received via the first input port 121 and delivered to the output port 123, and is configured to operate in a second state in which fuel is received via the second input port 122 and delivered to the output port 123. In certain embodiments, the regulator 120 is configured to regulate fuel entering the first port 121 such that fuel exiting the output port 123 is at a relatively steady first pressure, and is configured to regulate fuel entering the second port 122 such that fuel exiting the output port 123 is at a relatively steady second pressure. Various embodiments of regulators 120 compatible with certain embodiments of the fuel delivery system 40 described herein are disclosed in U.S. patent application Ser. No. 11/443,484, titled PRESSURE REGULATOR, filed May 30, 2006, the entire contents of which are hereby incorporated by reference herein and made a part of this specification.

In certain embodiments, the output port 123 of the regulator 120 is coupled with a source line 125. The source line 125, and any other fluid line described herein, can comprise piping, tubing, conduit, or any other suitable structure adapted to direct or channel fuel along a flow path. In some embodiments, the source line 125 is coupled with the output port 123 at one end and is coupled with a control valve 130 at another end. The source line 125 can thus provide fluid communication between the regulator 120 and the control valve 130.

In certain embodiments, the control valve 130 is configured to regulate the amount of fuel delivered to portions of the fuel delivery system 40. Various configurations of the control valve 130 are possible, including those known in the art as well as those yet to be devised. In some embodiments, the control valve 130 includes a millivolt valve. The control valve 130 can comprise a first knob or dial 131 and a second dial 132. In some embodiments, the first dial 131 can be rotated to adjust the amount of fuel delivered to a burner 135, and the second dial 132 can be rotated to adjust a setting of a thermostat. In other embodiments, the control valve 130 comprises a single dial 131.

In many embodiments, the control valve 130 is coupled with a burner transport line 137 and a pilot transport line 138, each of which can be coupled with a valve assembly 140. In some embodiments, the valve assembly 140 is further coupled with a first pilot delivery line 141, a second pilot delivery line 142, and a burner delivery line 143. As described below, the valve assembly 140 can be configured to direct fuel received from the pilot transport line 138 to either the first pilot delivery line 141 or the second pilot delivery line 142, and can be configured to direct fuel received from the burner transport line 132 along different flow paths toward the burner delivery line 143.

In certain embodiments, the first and second pilot delivery lines 141, 142 are coupled with separate portions of a safety pilot, pilot assembly, or pilot 180. Fuel delivered to the pilot 180 can be combusted to form a pilot flame, which can serve to ignite fuel delivered to the burner 135 and/or serve as a safety control feedback mechanism that can cause the control valve 130 to shut off delivery of fuel to the fuel delivery system 40. Additionally, in some embodiments, the pilot 180 is configured to provide power to the control valve 130. Accordingly, in some embodiments, the pilot 180 is coupled with the control valve 130 by one or more of a feedback line 182 and a power line 183.

In further embodiments, the pilot 180 comprises an electrode configured to ignite fuel delivered to the pilot 180 via one or more of the pilot delivery lines 141, 142. Accordingly, the pilot 180 can be coupled with an igniter line 184, which can be connected to an igniter actuator, button, or switch 186. In some embodiments, the igniter switch 186 is mounted to the control valve 130. In other embodiments, the igniter switch 186 is mounted to the housing 20 of the heating device 10. Any of the lines 182, 183, 184 can comprise any suitable medium for communicating an electrical quantity, such as a voltage or an electrical current. For example, in some embodiments, one or more of the lines 182, 183, 184 comprise a metal wire.

In certain embodiments, the burner delivery line 143 is situated to receive fuel from the valve assembly 140, and can be connected to the burner 135. The burner 135 can comprise any suitable burner, such as, for example, a ceramic tile burner or a blue flame burner, and is preferably configured to continuously combust fuel delivered via the burner delivery line 143.

In certain embodiments, either a first or a second fuel is introduced into the fuel delivery system 40 through the regulator 120. In some embodiments, the first or the second fuel proceeds from the regulator 120 through the source line 125 to the control valve 130. In some embodiments, the control valve 130 can permit a portion of the first or the second fuel to flow into the burner transport line 132, and can permit another portion of the first or the second fuel to flow into the pilot transport line 134.

In some embodiments, the first or the second fuel can proceed to the valve assembly 140. In many embodiments, the valve assembly 140 is configured to operate in either a first state or a second state. In some embodiments, the valve assembly 140 directs fuel from the burner transport line 132 along a first flow path into the burner delivery line 143 and directs fuel from the pilot transport line 138 to the first pilot delivery line 141 when the valve assembly 140 is in the first state. In further embodiments, the valve assembly 140 is configured to channel fuel from the burner transport line 132 along a second flow path into the burner delivery line 143 and from the pilot transport line 138 to the second pilot delivery line 142 when the valve assembly 140 is in the second state.

In some embodiments, when the valve assembly 140 is in the first state, fuel flows through the first pilot delivery line 141 to the pilot 180, where it is combusted. When the valve assembly 140 is in the second state, fuel flows through the second pilot delivery line 142 to the pilot 180, where it is combusted. In some embodiments, when the valve assembly 140 is in either the first or second state, fuel flows through the burner delivery line 143 to the burner 190, where it is combusted.

Figure 3:
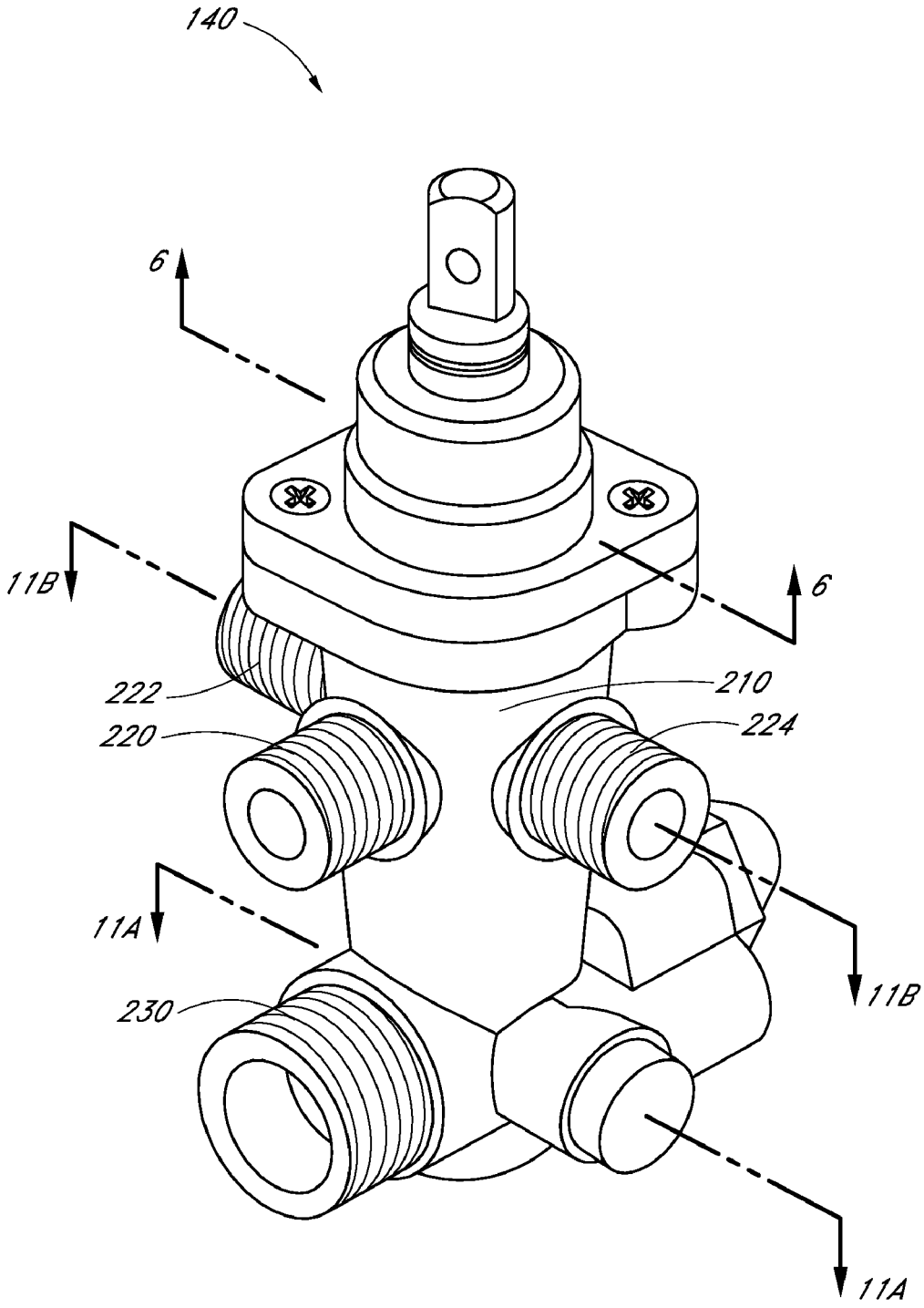
FIG. 3 is a perspective view of an embodiment of a valve assembly compatible with, for example, the fuel delivery system of FIG. 2.

With reference to FIG. 3, in certain embodiments, the valve assembly 140 includes a housing 210. The housing 210 can comprise a unitary piece of material, or can comprise multiple pieces joined in any suitable manner. In certain embodiments, the housing 210 defines one or more inlets, inputs, receiving ports, outlets, outputs, delivery ports, flow paths, pathways, or passageways through which fuel can enter, flow through, and/or exit the valve assembly 140. In some embodiments, the housing 210 defines an pilot input 220 configured to couple with the pilot transport line 138 and to receive fuel therefrom. The housing 210 can define a first pilot output 222 configured to couple with first pilot delivery line 141 and to deliver fuel thereto, and can define a second pilot output 224 configured to couple with the second pilot delivery line 142 and to deliver fuel thereto.

Each of the pilot input 220 and the first and second pilot outputs 222, 224 can define a substantially cylindrical protrusion, and can include threading or some other suitable connection interface. In some embodiments, the pilot input 220 and the first and second pilot outputs 222, 224 are substantially coplanar. The first pilot output 222 can define a first longitudinal axis that is substantially collinear with a second longitudinal axis defined by the second pilot output 224, and in some embodiments, the pilot input 220 defines a longitudinal axis that intersects a line through the first and second longitudinal axes at an angle. In some embodiments, the angle is about 90 degrees. Other configurations of the pilot input 220 and outputs 222, 224 are possible.

In some embodiments, the housing 210 defines a burner input 230 configured to couple with the burner transport line 137 and to receive fuel therefrom. In some embodiments, the burner input 230 defines a substantially cylindrical protrusion, which can include threading or any other suitable connection interface. In some embodiments, the burner input 230 is larger than the pilot input 220, and can thus be configured to receive relatively more fuel. In some embodiments, the burner input 230 defines a longitudinal axis that is substantially parallel to a longitudinal axis defined by pilot input 220. Other configurations of the burner input 230 are also possible.

Figure 4:
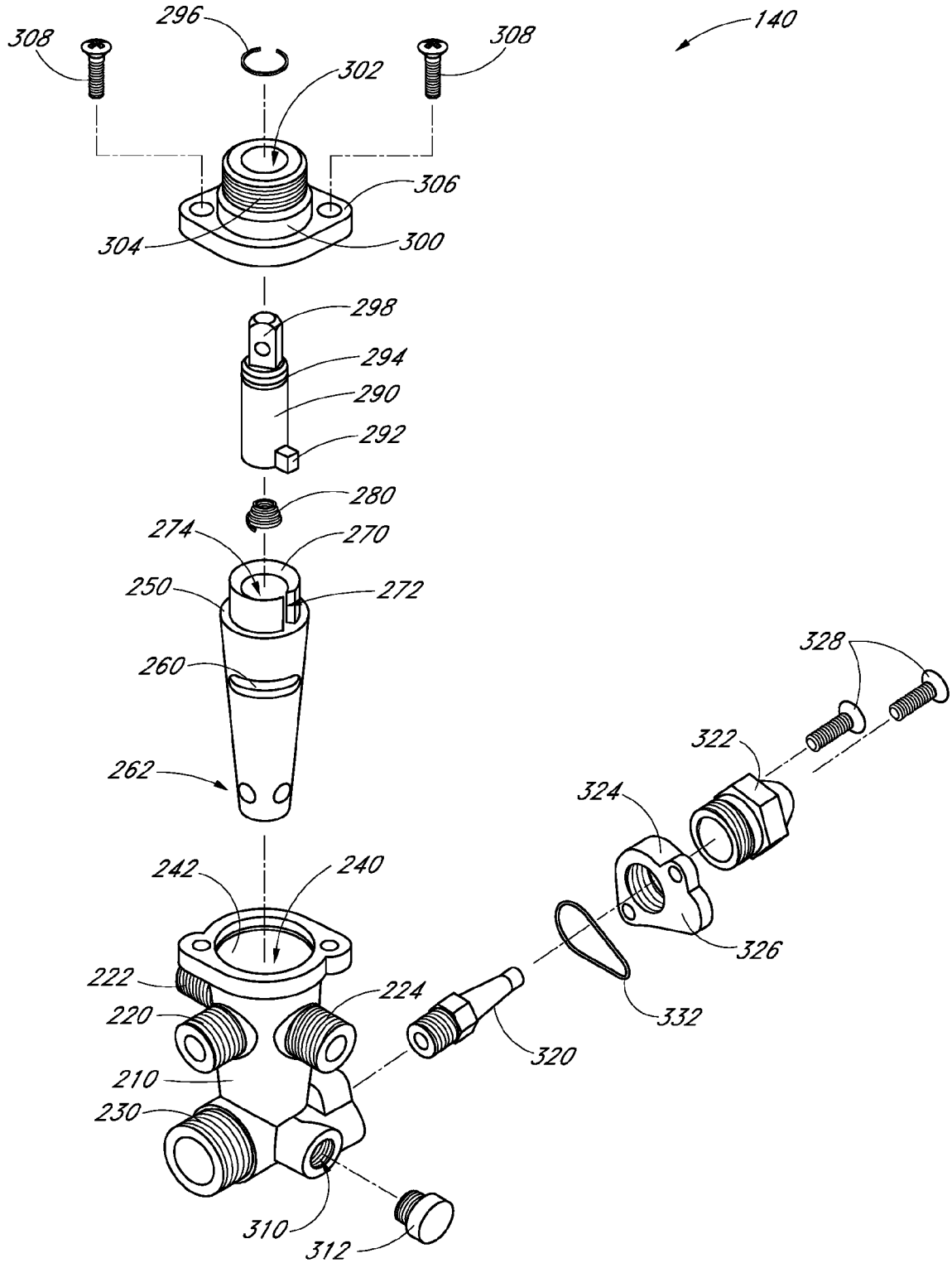
FIG. 4 is an exploded perspective view of the valve assembly of FIG. 3.

With reference to FIG. 4, in certain embodiments, the housing 210 defines a chamber 240. In some embodiments, each of the burner input 230, the pilot input 220, and the pilot outputs 222, 224 defines a passageway leading into the chamber 240 such that the chamber 240 can be in fluid communication with any of the inputs 220, 230 and outputs 222, 224. In some embodiments, the chamber 240 is defined by a substantially smooth inner sidewall 242 of the housing 210. The inner sidewall 242 can define any suitable shape, and in some embodiments, is rotationally symmetric. In various embodiments, the inner sidewall is substantially frustoconical or substantially cylindrical. The chamber 240 can thus be sized and shaped to receive a valve member, core, fluid flow controller, or valve body 250.

In some embodiments, the valve body 250 includes a lower portion 252 that defines an outer surface which is substantially complementary to the inner sidewall 242 of the housing 210. Accordingly, in some embodiments, the valve body 250 can form a substantially fluid-tight seal with the housing 210 when seated therein. In some embodiments, the valve body 250 is configured to rotate within the chamber 240. A suitable lubricant is preferably included between the valve body 250 and the inner sidewall 242 of the housing 210 in order to permit relatively smooth movement of the valve body 250 relative to the housing 210. The valve body 250 can define a channel 260 configured to direct fuel from the pilot input 220 to either the first or second pilot output 222, 224, and can include a series of apertures, openings, or ports 262 configured to direct fuel from the burner input 230 along either of two separate flow paths toward the burner delivery line 143, as further described below.

In some embodiments, the valve body 250 includes an upper portion 270, which can be substantially collar-shaped, and which can include a chamfered upper surface. In some embodiments, the upper portion 270 defines a longitudinal slot 272 and/or can define at least a portion of an upper cavity 274.

In some embodiments, a biasing member 280 is configured to be received by the upper cavity 274 defined by the valve body 250. The biasing member 280 can comprise, for example, a spring or any other suitable resilient element. In some embodiments, the biasing member 280 defines a substantially frustoconical shape and can be oriented such that a relatively larger base thereof is nearer the lower portion of the valve body 250 than is a smaller top thereof. References to spatial relationships, such as upper, lower, top, etc., are made herein merely for convenience in describing embodiments depicted in the figures, and should not be construed as limiting. For example, such references are not intended to denote a preferred gravitational orientation of the valve assembly 140.

Figure 5A:
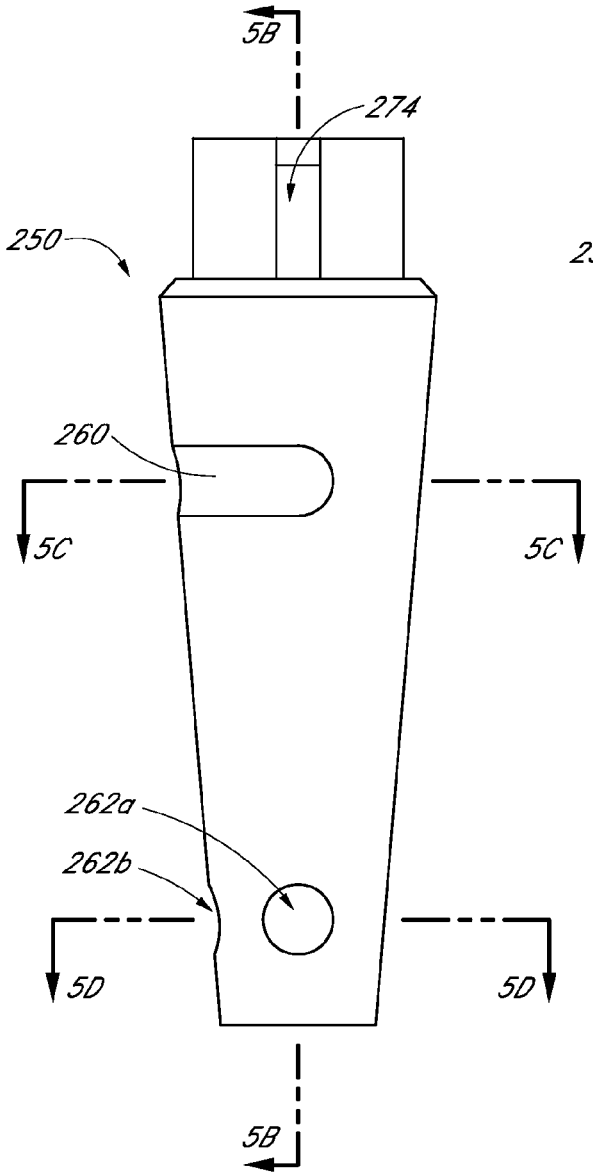
FIG. 5A is a front elevation view of an embodiment of a valve body compatible with the valve assembly of FIG. 3.
Figure 5B:
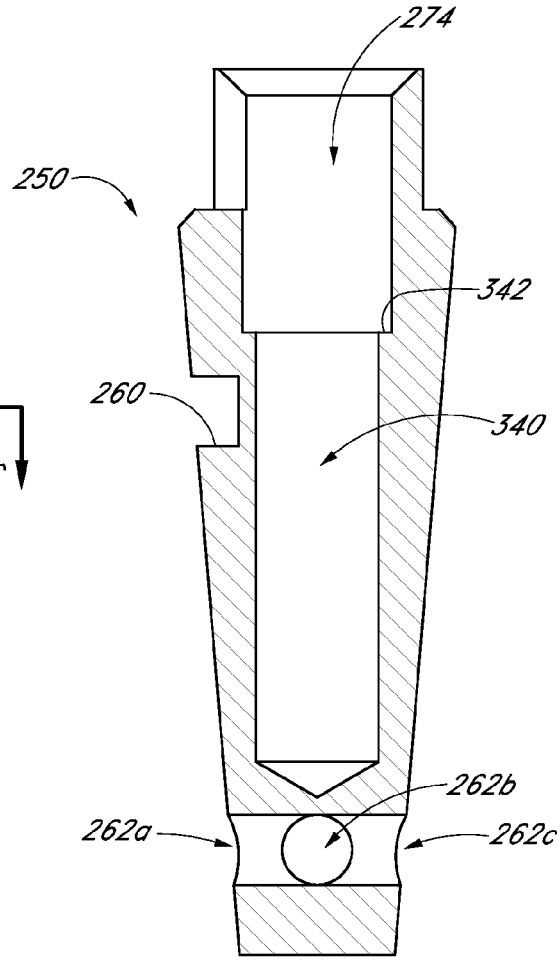
FIG. 5B is a cross-sectional view of the valve body of FIG. 5A taken along the view line 5B-5B.
Figure 5C:
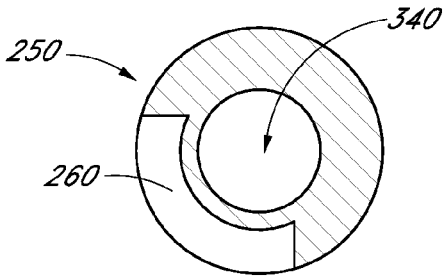
FIG. 5C is a cross-sectional view of the valve body of FIG. 5A taken along the view line 5C-5C.
Figure 5D:
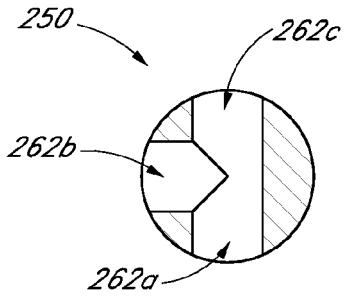
FIG. 5D is a cross-sectional view of the valve body of FIG. 5A taken along the view line 5D-5D.

In some embodiments, an actuator, rod, column, or shaft 290 is configured to be received by the upper cavity 274 defined by the valve body 250. In some embodiments, the biasing member 280 is retained between a ledge defined by the valve body 250 (shown in FIG. 5B) and the shaft 290, thus providing a bias that urges the shaft 290 upward, or away from the valve body 290, in the assembled valve assembly 140. In certain embodiments, the shaft 290 defines a protrusion 292 sized and shaped be received by the slot 272 defined by the valve body 250. In some embodiments, the protrusion 292 is sized to fit within the slot 272 with relatively little clearance or, in other embodiments, snugly, such that an amount of rotational movement by the protrusion 292 closely correlates with an amount of rotation of the valve body 250. In some embodiments, the protrusion 292 is substantially block-shaped, and projects at a substantially orthogonally with respect to a longitudinal length of a substantially columnar body of the shaft 290. In some embodiments, the protrusion 292 is capable of longitudinal movement within the slot 272, and can be capable of rotating the valve body 250 at any point within the range of longitudinal movement.

In some embodiments, the shaft 290 defines a channel 294 sized and shaped to receive a split washer 296. The shaft 290 can define an extension 298. In some embodiments, the extension 298 defines two substantially flat and substantially parallel sides configured to be engaged by a clamping device, such as a pair of pliers, such that the shaft 290 can be rotated. In other embodiments, the extension 298 is configured to couple with a knob or some other suitable grippable device, and in some embodiments, defines only one flat surface. Other configurations of the shaft 290 are also possible.

In some embodiments, the shaft 290 extends through a cap 300 in the assembled valve assembly 140. The cap 300 can define an opening 302 sized and shaped to receive the shaft 290 and to permit rotational movement of the shaft 290 therein. In some embodiments, the split washer 296 prevents the shaft 290 from being forced downward and completely through the opening 302 in the assembled valve assembly 140.

The cap 300 can include a neck 304, which can be threaded to engage a collar or cover. In some embodiments, the cap 300 defines a flange 306 through which fasteners 308, such as, for example, screws, can be inserted to connect the cap 300 with the housing 210.

In some embodiments, the housing 210 defines an opening 310, which in some embodiments, results from the drilling or boring of a flow channel within the housing 210, as described below. In some embodiments, the opening 310 is sealed with a plug 312, which in some embodiments, includes a threaded portion configured to interface with an inner surface of the housing 210 that defines the flow channel. In some embodiments, glue, epoxy, or some other suitable bonding agent is included between the plug 312 and the housing 210 in order to ensure that a substantially fluid-tight seal is created.

In certain embodiments, the housing 210 is configured to be coupled with a nozzle element, fuel director, fuel dispenser, or first nozzle member 320, a second nozzle member 322, and/or a cover 324, as further described below. In some embodiments, the cover 324 defines a flange 326 through which fasteners 328, such as, for example, screws, can be inserted to connect the cover 324 with the housing 210. In further embodiments, a sealing member or gasket 332 is coupled with the housing 210 in order to create a substantially fluid-tight seal, as further described below.

With reference to FIGS. 5A-5D, in certain embodiments, the valve body 250 defines three burner ports 262*a, b, c* configured to permit the passage of fuel. In some embodiments, the ports 262*a, b, c* are formed by drilling or boring two flow channels into a solid portion of the valve body 250. In some embodiments, one of the flow channels extends from one side of the valve body 250 to an opposite side thereof, and the other flow channel extends from another side of the valve body 250 and intersects the first flow channel within the valve body 250. In some embodiments, the ports 262*a, b, c* are substantially coplanar, and in further embodiments, are coplanar along a plane that is substantially orthogonal to a longitudinal axis of the valve body 250.

In some embodiments, the valve body 250 is substantially hollow, and can define a lower cavity 340 which can reduce the material costs of producing the valve body 250. The lower cavity 340 can have a perimeter (e.g. circumference) smaller than a perimeter of the upper cavity 274. Accordingly, in some embodiments, the valve body 250 defines a ledge 342 against which the biasing member 280 can rest.

As described above, the valve body 250 can define a groove or a channel 260 configured to direct fuel flow. In some embodiments, the channel 260 is milled or otherwise machined into a side of the valve body 250. In some embodiments, a first end of the channel 260 is substantially aligned with the port 262*a* along a plane through a first longitudinal axis of the valve body 250, and a second end of the channel 260 is substantially aligned with the port 263*b* along a second plane through a longitudinal axis of the valve body 250. In some embodiments, the first plane and the second plane are substantially orthogonal to each other.

In other embodiments, the valve body 250 does not include a lower cavity 340 such that the valve body 250 is substantially solid. Ports similar to the ports 262*a, b, c* can thus be created in the valve body 250 in place of the channel 260. Other configurations of the valve body 250 are also possible.

Figure 6:
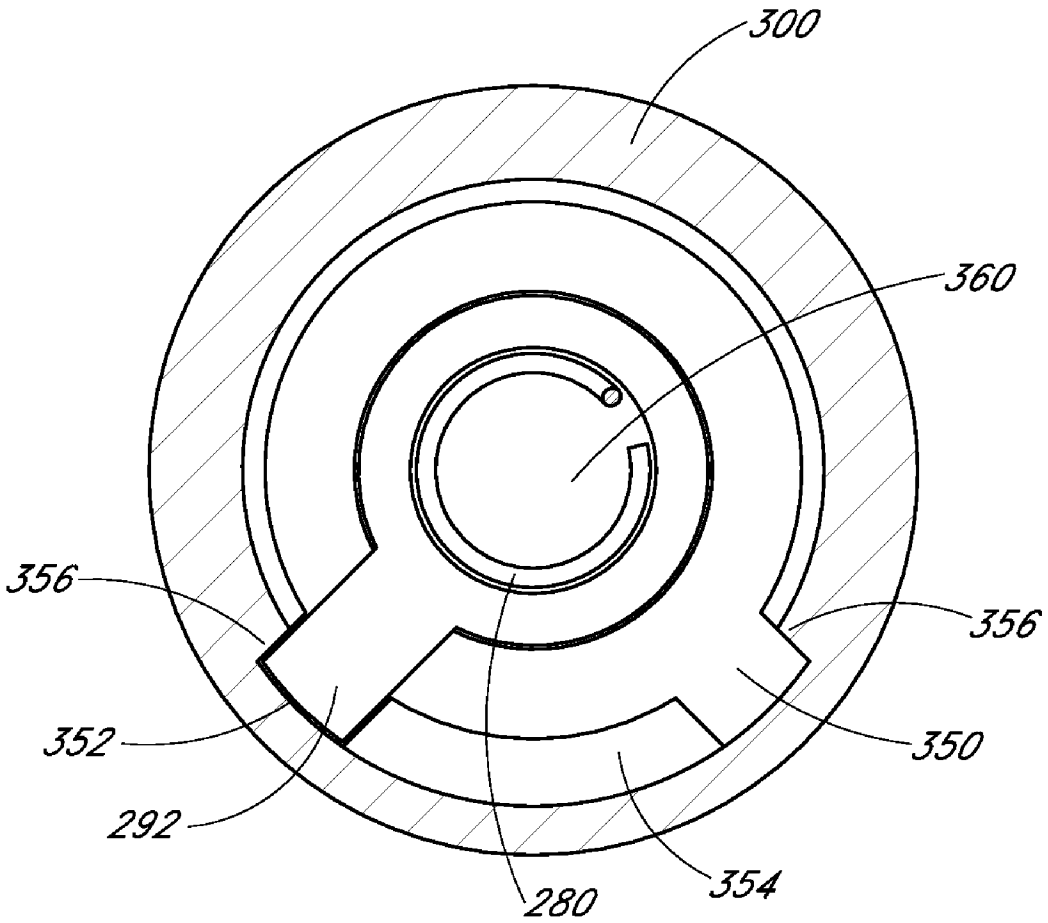
FIG. 6 is a cross-sectional view of the valve assembly of FIG. 3 taken along the view line 6-6.

With reference to FIG. 6, in certain embodiments, the cap 300 defines a channel, slot, or first depression 350 and a second depression 352. In some embodiments, the first and second depressions 350, 352 are sized and shaped to receive a portion of the protrusion 292 defined by the shaft 290. The first and second depressions 350, 352 can define an angle relative to a center of the cap 300. In preferred embodiments, the angle is about 90 degrees. Other angles are also possible, including, for example, between about 30 degrees and about 270 degrees, between about 45 and about 180 degrees, and between about 60 and about 120 degrees; no less than about 30 degrees, about 45 degrees, about 60 degrees, and about 90 degrees; and no greater than about 270 degrees, about 180 degrees, about 120 degrees, and about 90 degrees. The first and second depressions 350, 352 can be separated by a relatively short shelf or ledge 354. In some embodiments, the first and second depressions 350, 352 are also separated by a stop 356, which can be defined by an extension of the cap 300.

In some embodiments, the shaft 290 defines a receptacle 360 configured to receive a portion of the biasing member 280. In some embodiments, the receptacle 360 contacts the top end of the biasing member 280, and the biasing member 280 urges the shaft 290 upward toward the cap 300. Accordingly, in some embodiments, the protrusion 292 of the shaft 290 is naturally retained within one of the depressions 350, 352 by the bias provided by the biasing member 280, and the shaft 290 is displaced downward or depressed in order to rotate the shaft 290 such that the protrusion 292 moves to the other depression 350, 352. Movement past either of the depressions 350, 352 can be prevented by the stop 356. As noted above, in many embodiments, movement of the protrusion 292 can result in correlated movement of the valve body 250. Accordingly, rotation of the shaft 290 between the first and second depressions 350, 352 can rotate the valve body 250 between a first and a second operational state, as described further below.

Figure 7C:
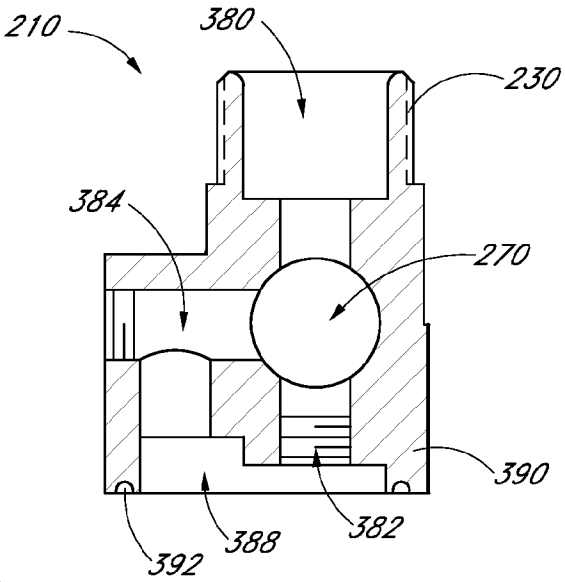
FIG. 7C is a cross-sectional view of the housing of FIG. 7A taken along the view line 7C-7C.
Figure 7B:
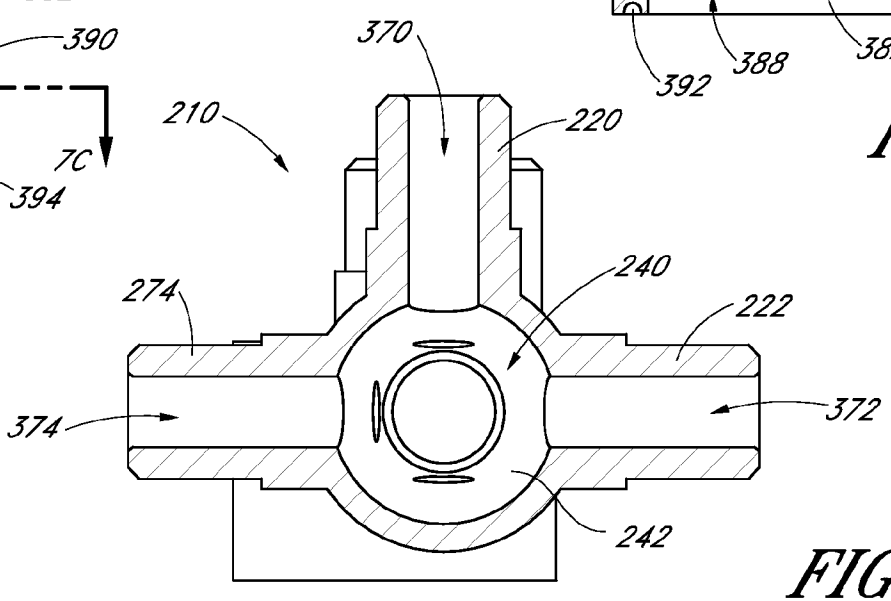
FIG. 7B is a cross-sectional view of the housing of FIG. 7A taken along the view line 7B-7B.
Figure 7A:
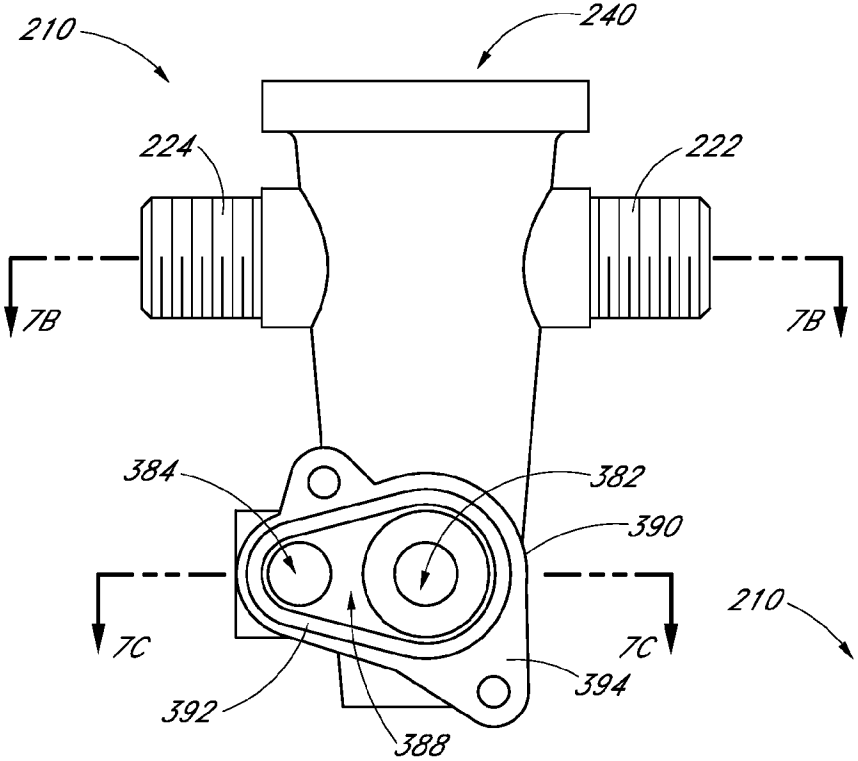
FIG. 7A is a front elevation view of an embodiment of a housing compatible with the valve assembly of FIG. 3.

FIGS. 7A-7C illustrate an embodiment of the housing 210. With reference to FIGS. 7A and 7B, in certain embodiments, the pilot input 220 defines at least a portion of a channel, conduit, passageway, or flow path 370 along which fuel can flow toward the chamber 240. The pilot output 222 can define at least a portion of a flow path 372, and the pilot output 224 can define at least a portion of a flow path 374, along which fuel can flow away from the chamber 240 and out of the housing 210. In some embodiments, the flow paths 372, 374 define longitudinal axes that are substantially collinear. In some embodiments, a longitudinal axis of the flow path 370 is substantially orthogonal to one or more of the flow paths 372, 374. Other arrangements are also possible.

With reference to FIGS. 7A and 7C, in some embodiments, the burner input 230 of the housing 210 defines at least a portion of a flow path 380 along which fuel can flow toward the chamber 240. The housing 210 can define a first egress flow path 382 along which fuel can flow away from the chamber 240 and out of the housing 240. In some embodiments, an inner surface of the portion of the housing 210 that defines the egress flow path 382 can be threaded or include any other suitable connection interface for coupling with the first nozzle member 320, as further described below. The housing 210 can define a second egress flow path 384 along which fuel can flow away from the chamber 240 and out of the housing 240. In certain embodiments, the housing 210 defines an indentation, cavity, or recess 388. In some embodiments, the recess 388 defines a portion of the second egress flow path 384.

In some embodiments, the recess 388 is defined by a projection 390 of the housing 210. The projection 390 can further define a channel 392 for receiving the gasket 332 to thereby form a substantially fluid-tight seal with the cover 324. In some embodiments, a face 394 of the projection 390 is substantially flat, and can be configured to abut the cover 324. The face 394 can define apertures through which fasteners can be advanced for coupling the cover 324 with the housing 210. In some embodiments, the face 394 defines a plane that is substantially parallel to a longitudinal axis defined by the inner sidewall 242 of the housing 210.

Figure 8:
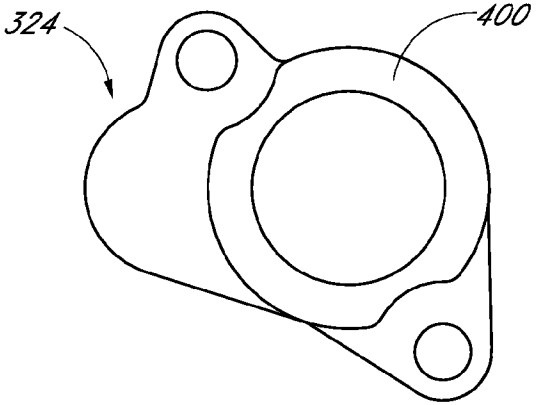
FIG. 8 is a top plan view of an embodiment of a cover compatible with the valve assembly of FIG. 3.

With reference to FIG. 8, in certain embodiments, the cover 324 is sized and shaped such that a periphery thereof substantially conforms to a periphery of the face 394 of the housing 210. Accordingly, an edge around the cover 324 and the face 394 can be substantially smooth when the cover 324 is coupled with the housing 210. In some embodiments, an underside of the cover 324 is substantially flat (see FIG. 4), and can thus be in relatively close proximity to the flat face 394 of the housing when coupled therewith. In some embodiments, the cover 324 defines a collar 400 configured to receive a portion of the second nozzle member 322. The collar 400 can include threading or any other suitable connection interface, which can be disposed along an interior surface thereof.

Figure 9:
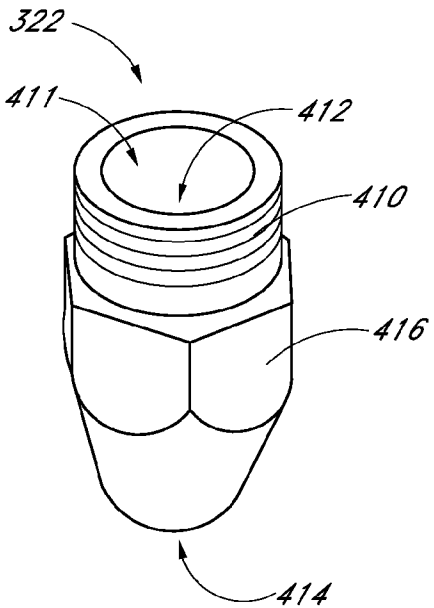
FIG. 9 is a perspective view of an embodiment of a nozzle member compatible with the valve assembly of FIG. 3.

With reference to FIG. 9, in certain embodiments, the second nozzle member 322 can include a rim 410 configured to couple with the collar 400 of the cover 324. In some embodiments, the rim 410 defines an inlet 411 of the second nozzle member 322 through which fuel can be accepted into the nozzle member 322. The rim 410 can comprise threading or any other suitable connection interface along an interior or exterior surface thereof. The rim 410 can define at least a portion of a cavity 412, which in some embodiments, is sufficiently large to receive at least a portion of the first nozzle member 320. In some embodiments, the cavity 412 extends through the full length of the second nozzle member 322, and can define an outlet 414 (see also FIG. 11A) at an end opposite the rim 410. In some embodiments, the second nozzle member 322 defines a tightening interface 416 configured to be engaged by a tightening device in order to securely couple the second nozzle member 322 with the cover 324.

Figure 10:
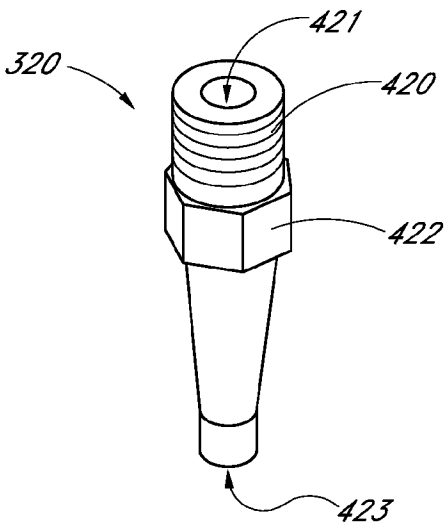
FIG. 10 is a perspective view of an embodiment of a nozzle member compatible with the valve assembly of FIG. 3.

With reference to FIG. 10, in certain embodiments, the first nozzle member 320 can comprise a distal portion 420, which can be configured to couple with the housing 210. The distal portion 420 can define an inlet 421 of the first nozzle member 320 configured to receive fuel into the first nozzle member 320. In some embodiments, an outer surface of the distal portion 420 is threaded, and is capable of engaging an inner surface of the housing 210 that at least partially defines the first egress flow path 382. The first nozzle member 320 can define a tightening interface 422 configured to be engaged by a tightening device in order to securely couple the first nozzle member 320 with the housing 210. The tightening interface 422 can comprise a substantially hexagonal flange, which can be engaged by a wrench or other suitable tightening device. In some embodiments, the first nozzle member 320 defines an outlet 423, which can be substantially opposite the distal portion 420.

Figure 11A:
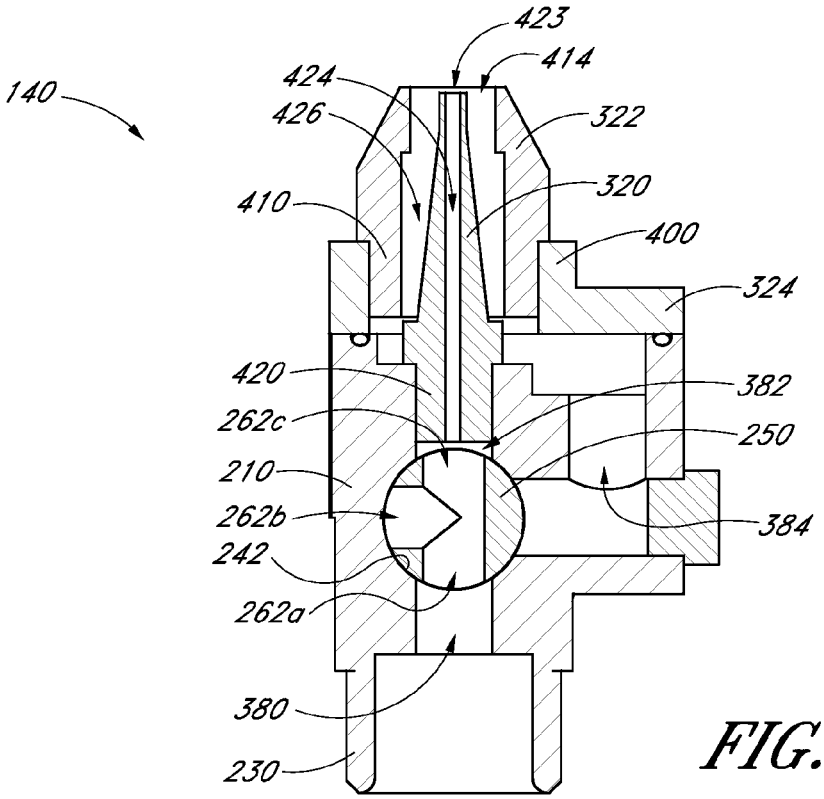
FIG. 11A is a cross-sectional view the valve assembly of FIG. 3 taken along the view line 11A-11A showing the valve assembly in a first operational configuration.

With reference to FIG. 11A, in certain embodiments, a substantial portion of the first nozzle member 320 is within the second nozzle member 322 in the assembled valve assembly 140. In some embodiments, the first nozzle member 320 and the second nozzle member 322 comprise a common longitudinal axis. In further embodiments, the longitudinal axis defined by the first and second nozzle members 320, 233 is substantially perpendicular to a longitudinal axis defined by the inner sidewall 242 of the housing 210. In some embodiments, one or more of the first and second nozzle members 320, 322 defines a longitudinal axis that is substantially perpendicular to an axis about which the valve body 250 is configured to rotate.

The outlet 423 of the first nozzle member 320 can extend beyond, be substantially flush with, or be interior to the outlet 414 of the second nozzle member 322. Accordingly, in some embodiments, the first nozzle member 320 is configured to direct fuel through the outlet 414 of the second nozzle member 320. Various embodiments of first and second nozzle members compatible with certain embodiments of the valve assembly 140 described herein are disclosed in U.S. patent application Ser. No. 11/443,446, titled NOZZLE, filed May 30, 2006; U.S. patent application Ser. No. 11/649,976, titled VALVE ASSEMBLIES FOR HEATING DEVICES, filed Jan. 5, 2007; and U.S. patent application Ser. No. 11/650,401, titled VALVE ASSEMBLIES FOR HEATING DEVICES, filed Jan. 5, 2007, the entire contents of each of which are hereby incorporated by reference herein and made a part of this specification.

In some embodiments, the distal portion 420 of the first nozzle member 320 is coupled with the housing 210 in substantially fluid-tight engagement. The first nozzle member 320 can thus define an inner flow channel 424 through which fuel can be directed and dispensed. In some embodiments, fuel is dispensed from the inner flow channel 424 via the outlet 423 at a first pressure.

In some embodiments, the rim 410 of the second nozzle member 322 is coupled with the collar 400 of the cover 324 in substantially fluid-tight engagement, and can provide an outer flow channel 426 through which fuel can be directed and dispensed. In some embodiments, at least a portion of an outer boundary of the outer flow channel 426 is defined by an inner surface of the second nozzle member 322, and at least a portion of an inner boundary of the outer flow channel 426 is defined by an outer surface of the first nozzle member 320. Thus, in some embodiments, at least a portion of the inner flow channel 424 is within the outer flow channel 426. In some embodiments, fuel is dispensed from the outer flow channel 426 via the outlet 414 at a second pressure. In some embodiments, the second pressure is less than the first pressure at which fuel is dispensed from the inner flow channel 424. In further embodiments, the inner flow 424 channel is configured to dispense liquid propane at the first pressure and the outer flow channel 426 is configured to dispense natural gas at a second pressure.

Other configurations of the nozzle members 320, 322 and/or the inner and outer flow channels 424, 426 are also possible. For example, in some embodiments the first nozzle member 320 is not located within the second nozzle member 322. The first and second nozzle members 320, 322 can be situated proximate or adjacent one another, can be oriented to dispense fuel in a substantially common direction, or can be oriented to dispense fuel in different directions, for example.

With continued reference to FIG. 11A, the illustrated embodiment of the valve assembly 140 is shown in a first operational configuration. In the first configuration, the valve body 250 is oriented in a first position such that the ports 262*a*, 262*c* provide fluid communication between the flow path 380 defined by the input 230 and the first egress flow path 382 defined by the housing 210. In some embodiments, the port 262*b* is directed toward the inner sidewall 242 of the housing 210, which can substantially prevent fluid flow out of the port 262*b*. Additionally, the valve body 250 can substantially block the second egress flow path 384, thereby substantially preventing fluid flow through the second egress flow path 384.

Accordingly, in certain embodiments, in the first operational configuration, the valve assembly 140 can accept fuel via the burner input 230, can direct the fuel along the flow path 380, through the valve body 250, through the first egress flow path 382 and through the inner flow channel 424, and can dispense the fuel at a proximal end of the inner flow channel 424 via the outlet 423.

Figure 11B:
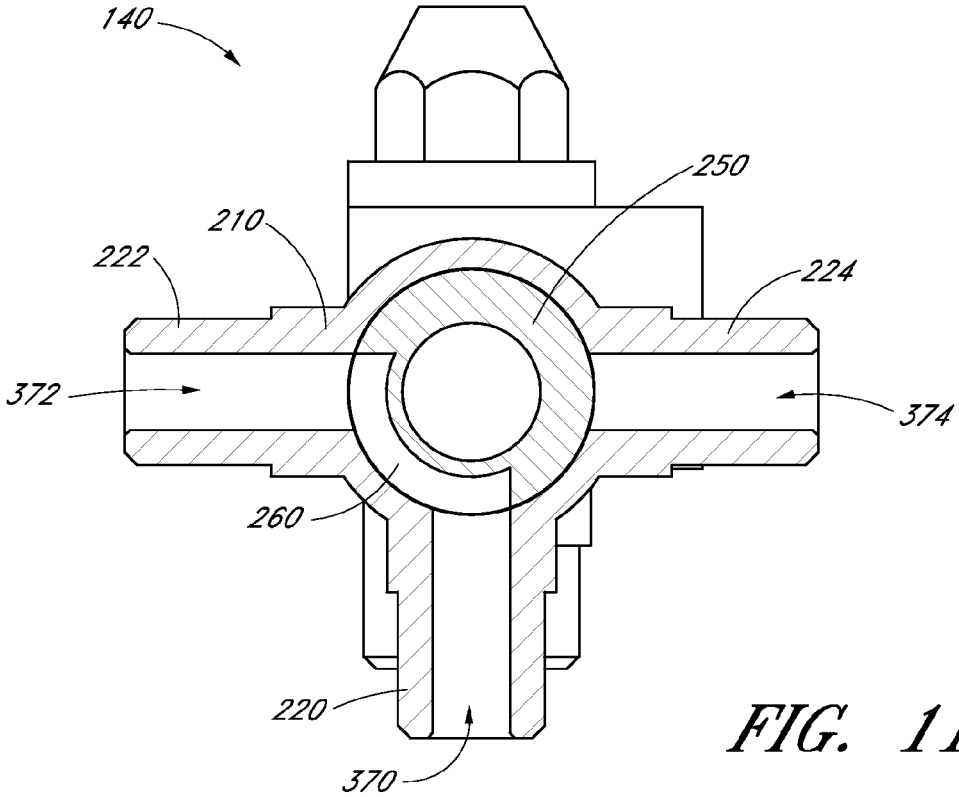
FIG. 11B is a cross-sectional view the valve assembly of FIG. 3 taken along the view line 11B-11B showing the valve assembly in the first operational configuration.

With reference to FIG. 11B, in certain embodiments, when the valve body 250 is oriented in the first position, the channel 260 can provide fluid communication between the flow path 370 and the flow path 372 defined by the housing 210. Accordingly, fuel entering the pilot input 220 can flow through the flow path 370, through the channel 260, through the flow path 372, and out of the first pilot output 222. In some embodiments, the valve body 250 can substantially block the flow path 374 such that fuel is substantially prevented from flowing through the second pilot output 224.

Figure 12A:
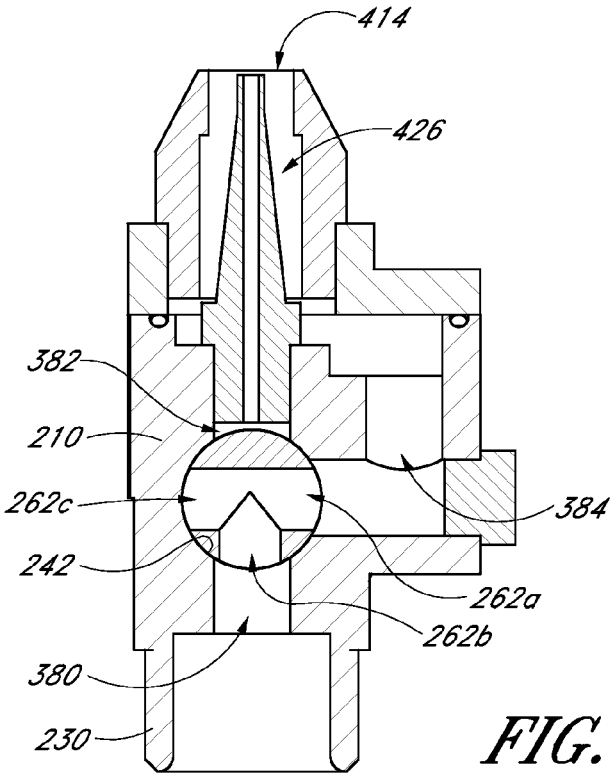
FIG. 12A is a cross-sectional view the valve assembly of FIG. 3 similar to the view depicted in FIG. 11A showing the valve assembly in a second operational configuration.

With reference to FIG. 12A, the illustrated embodiment of the valve assembly 140 is shown in a second operational configuration. In the second configuration, the valve body 250 is oriented in a second position such that the ports 262*a*, 262*b* provide fluid communication between the flow path 380 defined by the input 230 and the second egress flow path 384 defined by the housing 210. In some embodiments, the port 262*c* is directed toward the inner sidewall 242 of the housing 210, which can substantially prevent fluid flow out of the port 262*c*. Additionally, the valve body 250 can substantially block the first egress flow path 382, thereby substantially preventing fluid flow through the second egress flow path 382.

Accordingly, in certain embodiments, in the second operational configuration, the valve assembly 140 can accept fuel via the burner input 230, can direct the fuel along the flow path 380, through the valve body 250, through the second egress flow path 384 and through the outer flow channel 426, and can dispense the fuel at a proximal end of the outer flow channel 426 via the outlet 414.

Figure 12B:
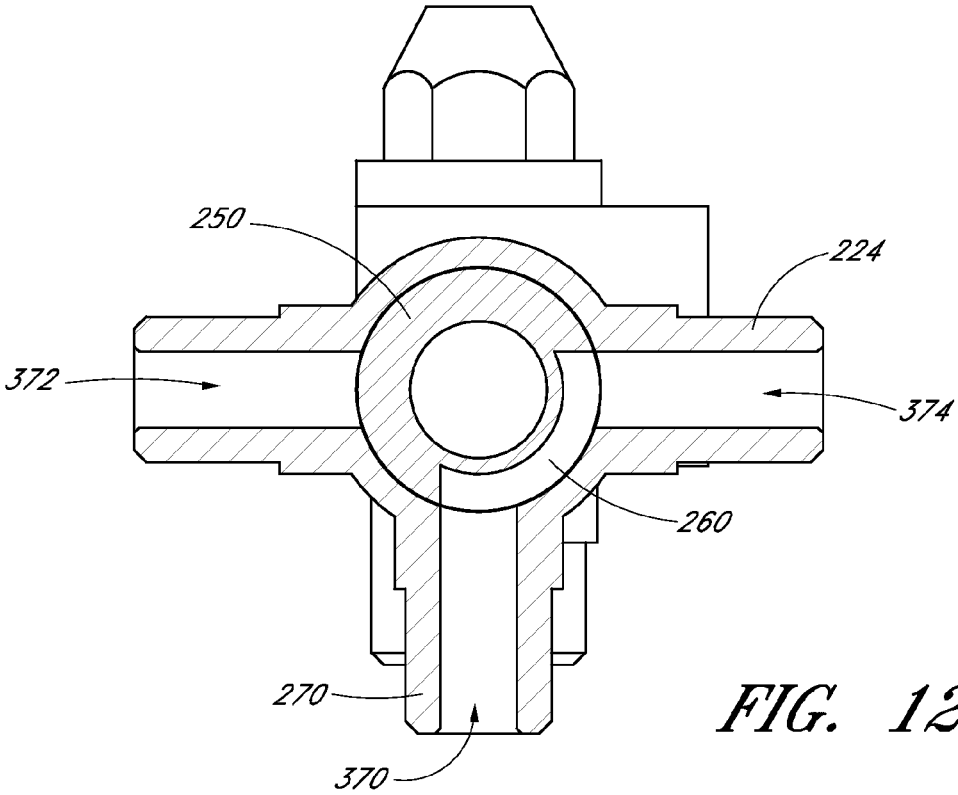
FIG. 12B is a cross-sectional view the valve assembly of FIG. 3 similar to the view depicted in FIG. 11B showing the valve assembly in the second operational configuration.

With reference to FIG. 12B, in certain embodiments, when the valve body 250 is oriented in the second position, the channel 260 can provide fluid communication between the flow path 370 and the flow path 374 defined by the housing 210. Accordingly, fuel entering the pilot input 220 can flow through the flow path 370, through the channel 260, through the flow path 374, and out of the second pilot output 224. In some embodiments, the valve body 250 can substantially block the flow path 372 such that fuel is substantially prevented from flowing through the second pilot output 224.

In certain embodiments, the valve assembly 140 is configured to accept and channel liquid propane when in the first operational configuration and to accept and channel natural gas when in the second operational configuration. In other embodiments, the valve assembly 140 is configured to channel one or more different fuels when in either the first or second operational configuration.

Figure 13B:
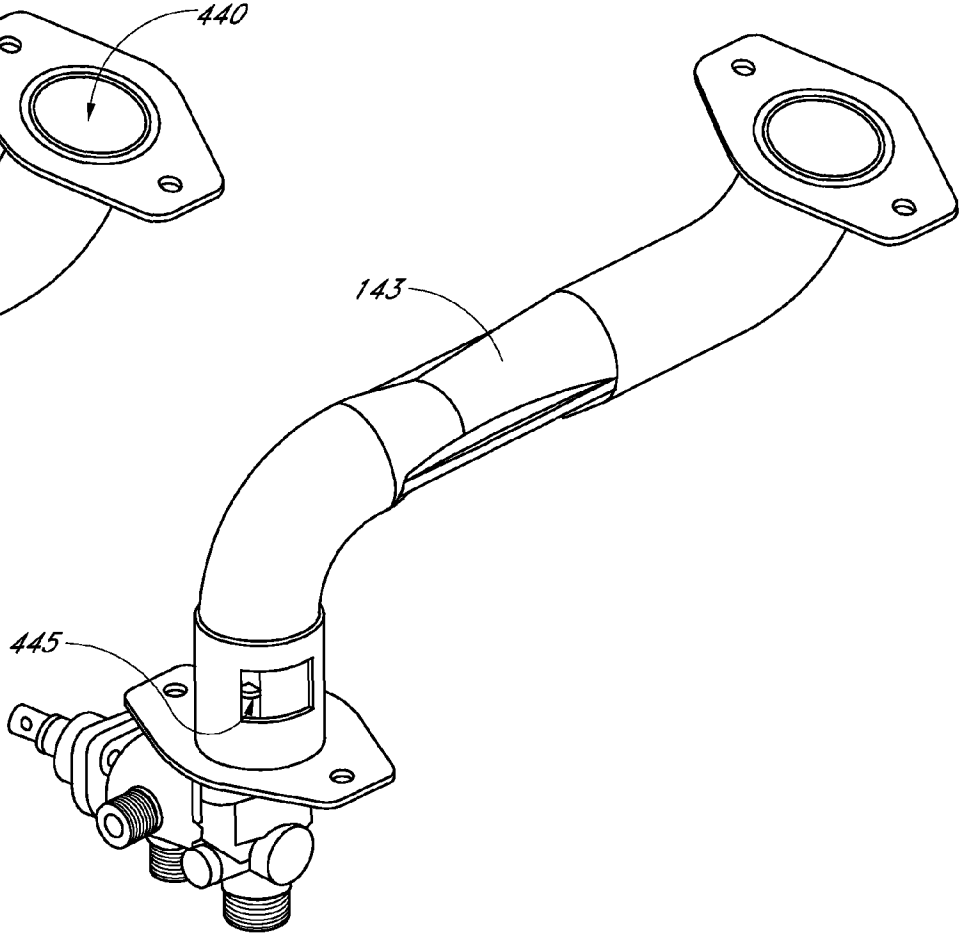
FIG. 13B is a perspective view of the valve assembly of FIG. 3 coupled with a fuel delivery line having a smaller air intake than that shown in FIG. 13A.
Figure 13A:
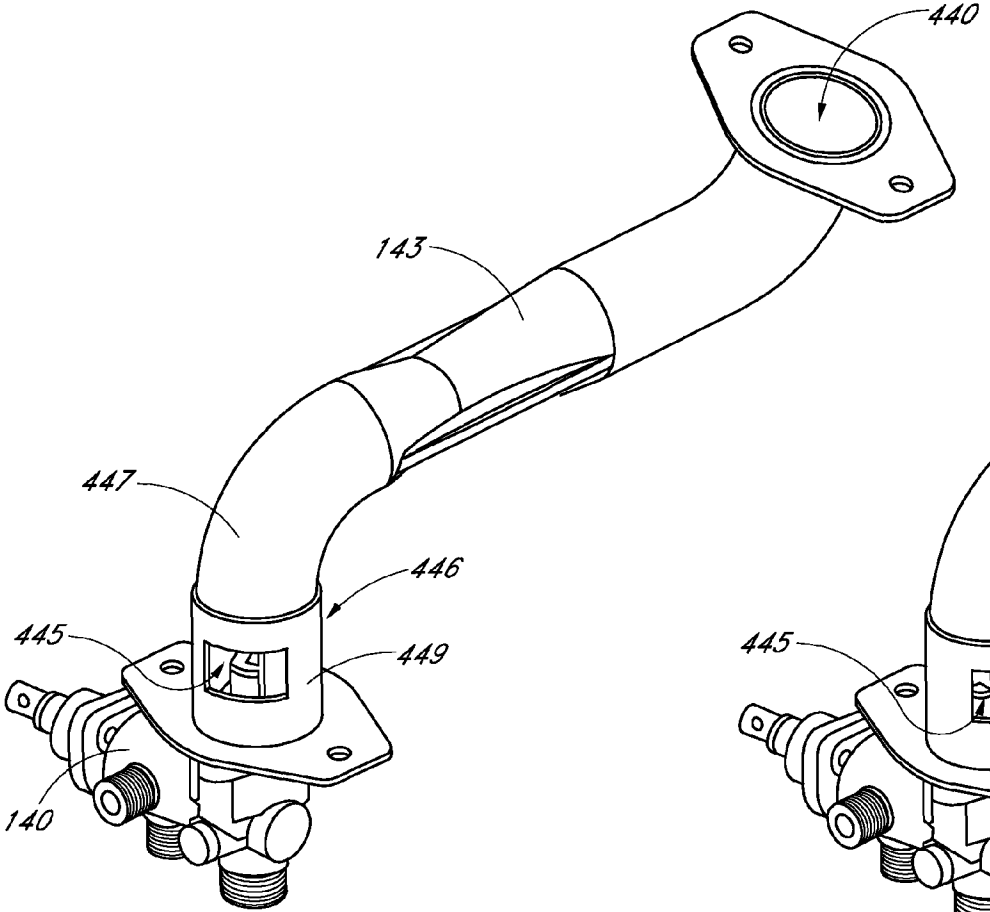
FIG. 13A is a perspective view of the valve assembly of FIG. 3 coupled with a fuel delivery line having an air intake.

With reference to FIG. 13A, in certain embodiments, the valve assembly 140 is positioned to be in fluid communication with the burner delivery line 143. The valve assembly 140 can be coupled with the burner delivery line 143 in any suitable manner and/or can be positioned in relatively fixed relation with respect to the burner delivery line 143. In some embodiments, the burner delivery line defines an opening (not shown) at a first end thereof through which one or more of the nozzle elements 320, 322 can extend. In other embodiments, the nozzle elements 320, 322 are not located within the burner delivery line 143 but are positioned to direct fuel into the burner delivery line 143. The burner delivery line 143 can define an opening 440 at a second end thereof through which fuel can flow to the burner 135.

In some embodiments, the burner delivery line 143 defines an air intake, aperture, opening, or window 445 through which air can flow to mix with fuel dispensed by the valve assembly 140. In some embodiments, the window 445 is adjustably sized. For example, in some embodiments, the burner delivery line 143 defines a mixing section, passageway, chamber, corridor, or compartment 446, which can include a primary conduit 447 and a sleeve 449. As used herein, the term "compartment" is a broad term used in its ordinary sense and can include, without limitation, structures that define a volume of space through which fluid can flow.

Each of the primary conduit 447 and the sleeve 449 can define an opening. In some embodiments, the openings can be relatively aligned with each other such that the window 445 is relatively large, and the sleeve 449 can be rotated such that less of the openings are aligned, thereby making the window 445 relatively smaller. In some embodiments, a wrench or other suitable device is used to adjust the size of the window 445. In other embodiments, the size of the window 445 can be adjusted by hand.

With continued reference to FIG. 13A, in some embodiments, the window 445 is relatively large, thus allowing a relatively large amount of air to be drawn into the burner delivery line 143 as fuel is dispensed from the valve assembly 140. In some embodiments, the valve assembly 140 is configured to operate in the first configuration such that fuel is dispensed via the outlet 423 defined by the first nozzle member 320 when the window 445 is relatively large.

With reference to FIG. 13B, in some embodiments, the window 445 is relatively small, thus allowing a relatively small amount of air to be drawn into the burner delivery line 143 as fuel is dispensed from the valve assembly 140. In some embodiments, the valve assembly 140 is configured to operate in the second configuration such that fuel is dispensed via the outlet 414 defined by the second nozzle member 322 when the window 445 is relatively small.

In certain embodiments, the valve assembly 140 and the window 445 are configured to create an air-fuel mixture that produces a substantially blue flame at the burner 135. In other embodiments, the air-fuel mixture produces a substantially yellow flame at the burner. In further embodiments one or more of the valve assembly 140 and the window 445 can be adjusted to alter the air-fuel mixture, and as a result, certain properties of the flame produced at the burner. Such properties can include, for example, the color, shape, height, and/or burn quality (e.g., number and/or type of by-products) of the flame.

Figure 14A:
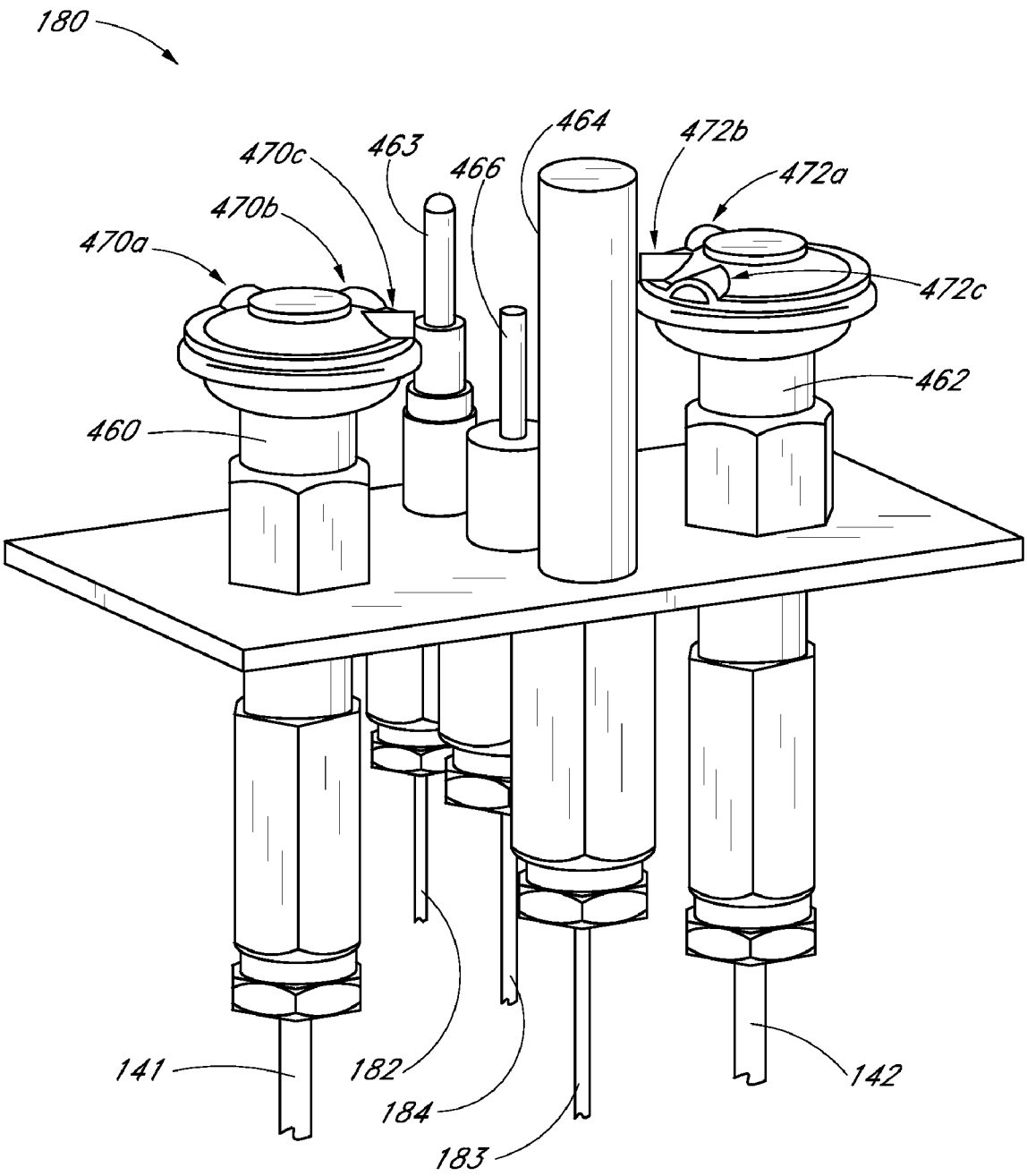
FIG. 14A is a perspective view of an embodiment of a pilot assembly compatible with the fuel delivery system of FIG. 2.

With reference to FIG. 14A, in certain embodiments, the pilot 180 includes nozzle body or first fuel dispenser 460 coupled with the first pilot delivery line 141 and a second fuel dispenser 462 coupled with the second pilot delivery line 142. The pilot 180 can include a thermocouple 463 coupled with the feedback line 182, a thermopile 464 coupled with the power line 183, and an electrode or igniter 466 coupled with the igniter line 184.

In some embodiments, the first dispenser 460 includes a plurality of first ports 470*a, b, c* and the second dispenser 462 includes a plurality of second ports 472*a, b, c*. In some embodiments, the ports 470*a*, 472*a* are directed toward the burner 135, the ports 470*b*, 472*b* are directed toward the thermocouple 463, and the ports 470*c*, 472*c* are directed toward the thermopile 464. Accordingly, in some embodiments, each of the first and second dispensers 460, 462 is configured to direct separate flames toward the burner 135, the thermocouple 463, and the thermopile 464.

The pilot assembly 180 can produce a first set of flames via the first ports 470*a, b, c* when in a first operational state and produces a second set of flames via the second ports 472*a, b, c* when in the second operational state. In some embodiments, the first and second sets of flames have substantially the same appearance such that a user of the heating device 10 would not perceive a significant difference in the flames. Certain of such embodiments can be desirable in applications for which the aesthetic qualities of a pilot flame are important, such as certain high-end heating devices (e.g., certain gas fireplaces).

Further, in some embodiments, the pilot assembly 180 is configured to operate as an oxygen depletion sensor, which can be desirable in certain vent-free applications. For example, in some embodiments, a flame produced via the port 470*b* or via the port 472*b* is stable when the oxygen level of an environment in which the heating device 10 is located is above a threshold amount. In such instances, heating the thermocouple 463 provides current to a solenoid within certain embodiments of the control valve 130, which can maintain a shutoff valve in an open configuration and thus permit delivery of fuel to the burner 135. When the oxygen level drops below the threshold amount (e.g., between about 18.0 percent and 18.5 percent, in some embodiments), the flame becomes unstable and/or lifts from the thermocouple 463, thus cooling the thermocouple 463 and causing the shutoff valve to close. Oxygen depletion sensors compatible with certain embodiments described herein are disclosed in U.S. patent application Ser. No. 11/443,492, titled OXYGEN DEPLETION SENSOR, filed May 30, 2006, the entire contents of which are hereby incorporated by reference herein and made a part of this specification.

Heating the thermopile 464 can provide electrical power to the control valve 130 and/or an electrical component coupled with the control valve 130, such as a thermostat. Accordingly, in some embodiments, the thermopile 464 can desirably permit operation of the heating device 10 without connection to external hardwiring.

Figure 14B:
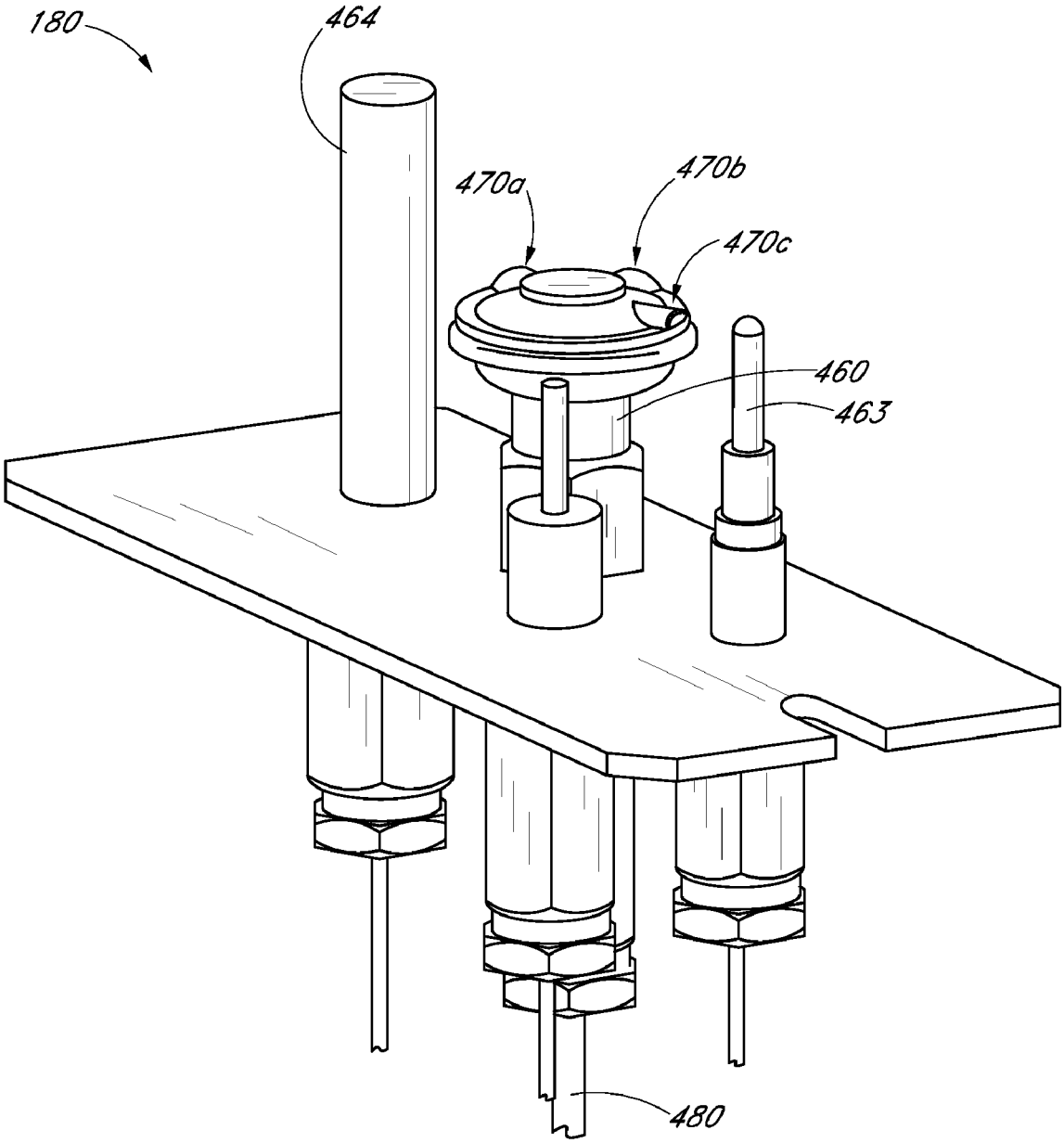
FIG. 14B is a perspective view of another embodiment of a pilot assembly compatible with the fuel delivery system of FIG. 2.

FIG. 14B illustrates another embodiment of the pilot 180. In certain embodiments, the pilot 180 includes only a single dispenser 460. In some embodiments, the port 470*a* is directed to the thermopile 464, the port 470*b* is directed to the burner 135, and the port 470*c* is directed to the thermocouple 463. Other configurations are also possible.

In certain embodiments, the single dispenser 460 is configured to operate with either a first fuel or a second fuel. For example, in some embodiments, the first and second pilot delivery lines 141, 142 (see FIG. 2) are coupled with a pilot input line 480 that delivers fuel to the dispenser 460. In some embodiments, a flame produced by the dispenser 460 when operating in one mode has a different appearance than it does when operating in another mode. For example, in some embodiments, the dispenser 460 produces a longer flame when it is fueled with natural gas than it does when fueled with propane.

Certain single-dispenser embodiments of the pilot assembly 180 desirably reduce the amount of material used to produce the assembly 180, and thus, can reduce production costs of heating devices 10. In certain embodiments, single-dispenser pilot assemblies 180 are advantageously used in applications for which the appearance of a flame produced by the pilot assembly 180 or the sensitivity the flame to environmental conditions is relatively unimportant, such as, for example, in certain economically priced vented fireplaces.

Figure 15:
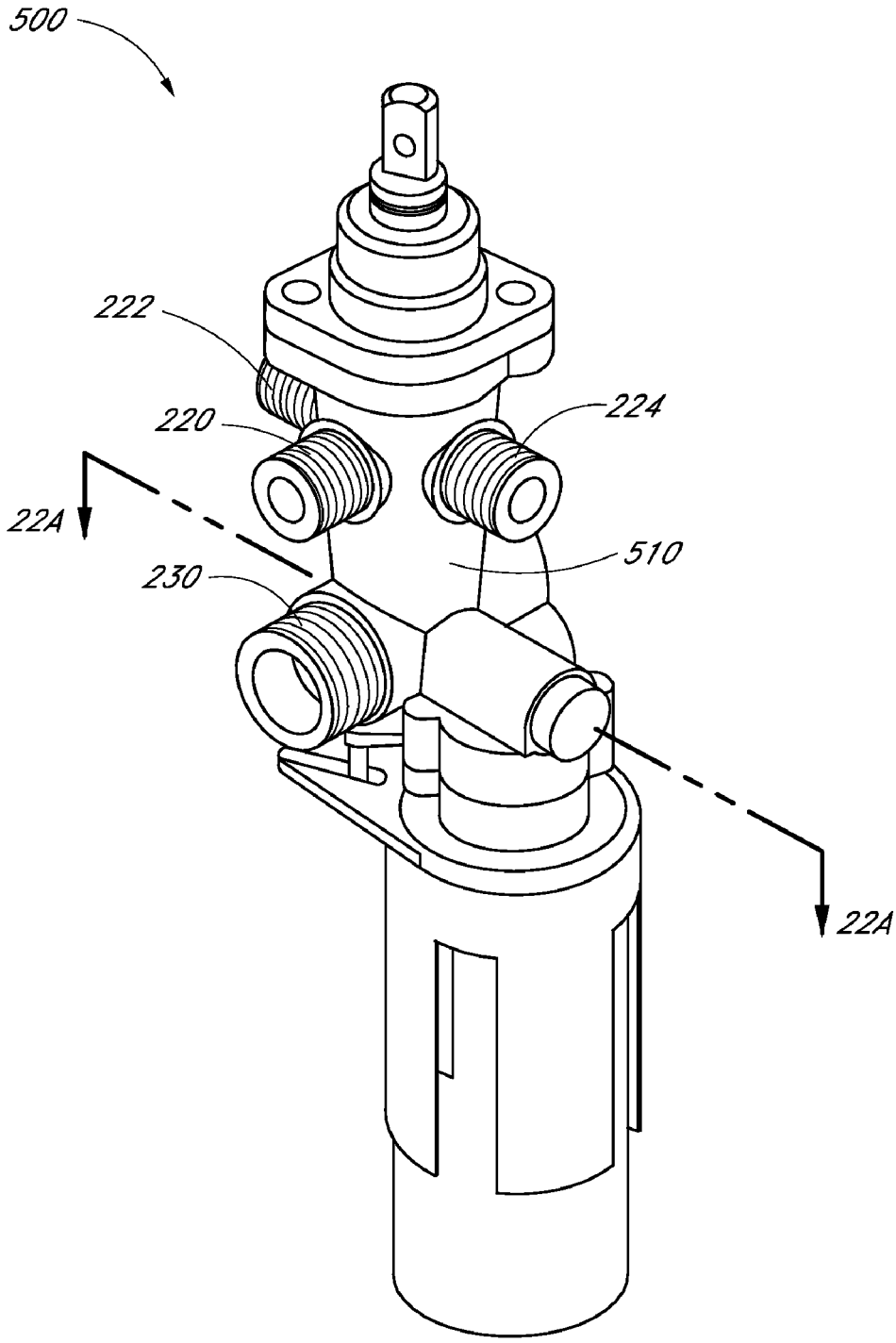
FIG. 15 is a perspective view of another embodiment of a valve assembly compatible with, for example, certain embodiments of the heater 10.

FIG. 15 illustrates an embodiment of a valve assembly 500, which can resemble the valve assembly 140 in many respects. Accordingly, like features are identified with like reference numerals. The valve assembly 500 can also include features different from those discussed with respect to the valve assembly 140, such as those described hereafter. In various embodiments, the valve assembly 500 is configured for use with the heating device 10, and can be configured for use with other suitable heating devices. In certain preferred embodiments, the valve assembly 500 is configured for use with gas log inserts, gas fireplaces, or other heating devices for which the color of the flame produced by the devices may desirably be a preferred color, such as, for example, yellow.

In certain embodiments, the valve assembly 500 includes a housing 510. The housing 510 can comprise a unitary piece of material, or can comprise multiple pieces joined in any suitable manner. In certain embodiments, the housing 510 defines an pilot input 220 configured to couple with the pilot transport line 138 and to receive fuel therefrom. The housing 510 can define a first pilot output 222 configured to couple with first pilot delivery line 141 and to deliver fuel thereto, and can define a second pilot output 224 configured to couple with the second pilot delivery line 142 and to deliver fuel thereto. In some embodiments, the housing 510 defines a burner input 230 configured to couple with the burner transport line 137 and to receive fuel therefrom.

Figure 16:
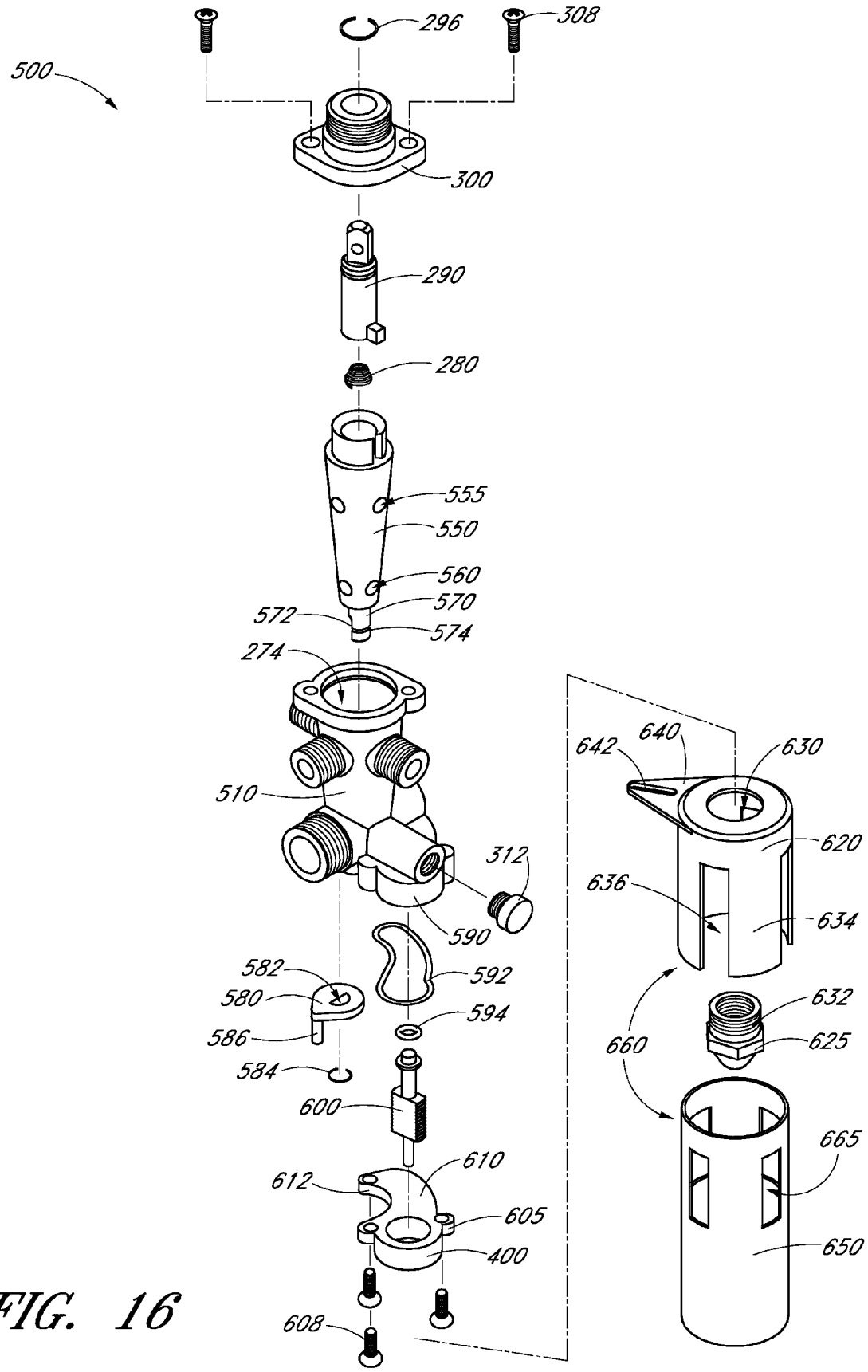
FIG. 16 is an exploded perspective view of the valve assembly of FIG. 15.
Figure 17A:
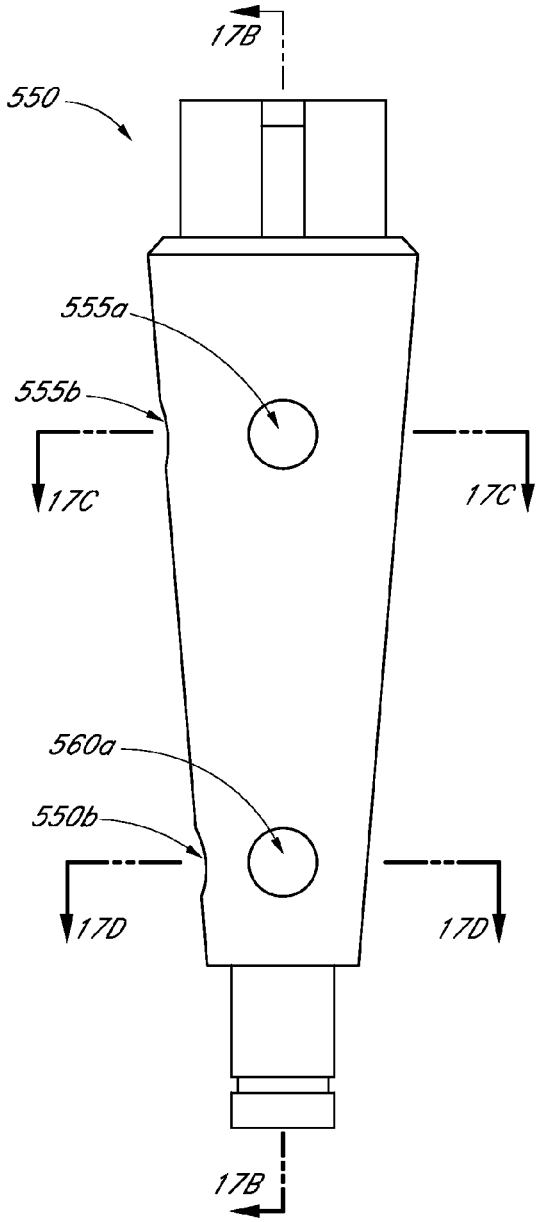
FIG. 17A is a front elevation view of an embodiment of a valve body compatible with the valve assembly of FIG. 15.
Figure 17B:
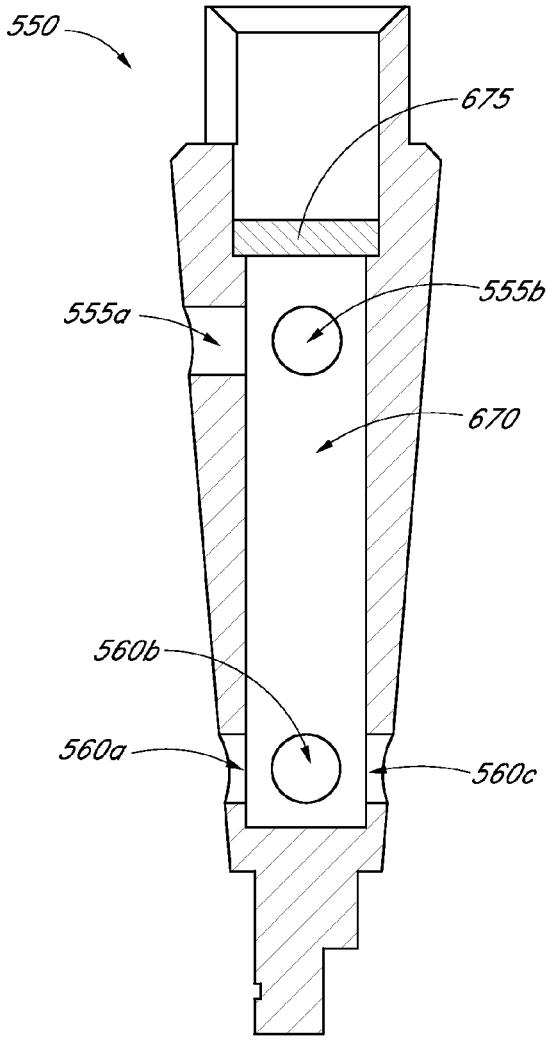
FIG. 17B is a cross-sectional view of the valve body of FIG. 17A taken along the view line 17B-17B.
Figure 17C:
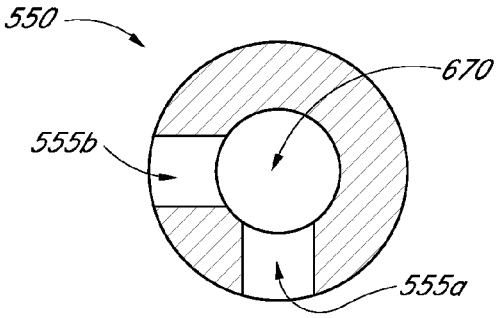
FIG. 17C is a cross-sectional view of the valve body of FIG. 17A taken along the view line 17C-17C.
Figure 17D:
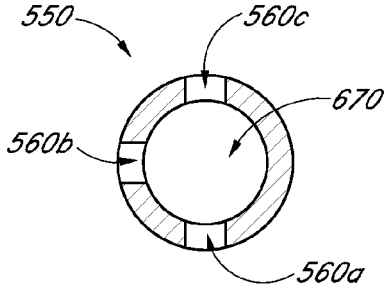
FIG. 17D is a cross-sectional view of the valve body of FIG. 17A taken along the view line 17D-17D.

With reference to FIG. 16, in certain embodiments, the housing 510 defines a cavity 240 configured to receive a valve body 550. The housing 510 and/or the valve body 550 can be coupled with a biasing member 280, a shaft 290, and a cap 300 via one or more fasteners 308 and a split washer 296, as described above. In some embodiments, the housing 510 is coupled with a plug 312.

The valve body 550 can resemble the valve body 250 in certain respects and/or can include different features. In some embodiments, the valve body 550 defines an upper set of apertures 555 and a lower set of apertures 560, which are described more fully below. In some embodiments, the valve body 550 defines a protrusion 570 that can extend from a lower end of the valve body 550. The protrusion 570 can define a substantially flat face 572 and a channel 574. In certain embodiments, the protrusion 570 extends through a lower end of the housing 510 in the assembled valve assembly 500.

In some embodiments, the valve assembly 500 includes a cam 580 configured to couple with the protrusion 570 of the valve body 550. The cam 580 can define an aperture 582 through which a portion of the protrusion 570 can extend. In some embodiments, the aperture 582 is sized such that the protrusion 570 fits snugly therein. In some embodiments, the aperture 582 is shaped substantially as a semicircle, and can comprise a flat face which, in further embodiments, extends through an axial or rotational center of the cam 580. The flat face of the aperture 582 can abut the flat face 572 of the protrusion 570, and can cause the cam 580 to rotate about the axial center when the valve body 550 is rotated within the housing 510. In certain embodiments, the cam 580 is retained on the protrusion 570 via a split washer 584. In some embodiments, a rod 586 extends from a lower surface of the cam 580. The rod 586 can be substantially cylindrical, thus comprising a substantially smooth and rotationally symmetric outer surface.

In some embodiments, the housing 510 defines a projection 590 at a lower end thereof. The projection 590 can be configured to couple with a gasket 592, an O-ring or sealing member 594, a first nozzle member 600 and a cover 605, as further described below. In some embodiments, the cover 605 is coupled with the projection 590 via fasteners 608.

As with the cover 324, the cover 605 can define a substantially flat surface 610 configured to abut a flat surface defined by the projection 590, and in some embodiments, the cover 605 defines a collar 400. The cover 605 can also define a rounded side surface 612. A radius of the side surface 612 can be slightly larger than the radius of a rounded portion of the cam 580, and can thus permit the rounded portion of the cam 580 to rotate proximate the cover 605 in the assembled valve assembly 500.

In certain embodiments, the cover 324 is configured to be coupled with a shroud, sleeve, occlusion member, or cover 620 and a second nozzle member 625. In some embodiments, the cover 620 is substantially cylindrical. An upper surface of the cover 620 can be substantially flat, and can define an opening 630. The opening 630 can be sized to receive a rim 632 of the second nozzle member 625. The opening 630 can be substantially circular, and can define a diameter slightly larger than an outer diameter of the rim 632 of the second nozzle member 625. Accordingly, in some embodiments, the cover 620 can rotate about the rim 632 of the second nozzle member 625 with relative ease in the assembled valve assembly 500.

The cover 620 can define one or more screens 634 separated by one or more gaps 636. In some embodiments, each screen 634 extends about a greater portion of a circumference of the cover 620 than does one or more neighboring gaps. In some embodiments, each screen 634 is substantially the same size and shape, and is spaced adjacent screens 634 by an equal amount. Other arrangements are also possible.

The cover 620 can define an extension 640 that projects from a top end of the cover 620. In some embodiments, the extension 640 is substantially coplanar with a top surface of the cover 620, and in other embodiments, a plane defined by the extension 640 is substantially parallel to the plane of the top surface. In some embodiments, the extension 640 defines a slot 642 configured to receive the rod 586 of the cam 580. As further discussed below, the cam 580 can cooperate with the extension 640 to rotate the cover 620 as the valve body 550 is rotated.

In some embodiments, the cover 620 is configured to receive a fuel directing member, tube, pipe, or conduit 650, which in some embodiments, comprises or is coupled with the burner delivery line 143. In other embodiments, the cover 620 is received within the conduit 650. In some embodiments, the cover 620 and conduit 650 cooperate to form a mixing section, passageway, chamber, corridor, or compartment 660. As further described below, the mixing compartment 660 can define one or more adjustably sized air intakes, channels, openings, apertures, or windows 665 through which air can flow to mix with fuel delivered to the conduit 650 via the valve assembly 500. For example, a flow area of the windows 665 can vary between a first operational configuration and a second operational configuration of the valve assembly 500.

With reference to FIGS. 17A-17D, in certain embodiments, the valve member 550 defines a series of upper apertures 555*a, b* and a series of lower apertures 560*a, b, c*. Each of the apertures 555*a, b* and 560*a, b, c* can be in fluid communication with a cavity 670 defined by the valve body 550. In some embodiments, the valve body 550 includes a cap 675 configured to seal the cavity 670. Accordingly, in some embodiments, fuel can enter the cavity 670 via one or more of the apertures 555*a, b* and 560*a, b, c*, can substantially fill the cavity 670, and can exit the cavity 670 via one or more of the apertures 555*a, b* and 560*a, b, c*, depending on the orientation of the valve body 550. In other configurations, a separator, such as a plate or an insert, is positioned between the upper and lower apertures 555*a, b*, 560*a, b, c*, substantially preventing fluid communication between the upper and lower apertures. Such configurations can be desirable for applications in which fuel entering the upper apertures 55*a, b* is preferably maintained separate from fuel entering the lower apertures 560*a,b,c*. Any suitable combination of the features of the valve member 250 and the valve member 550 is possible.

Figure 18:
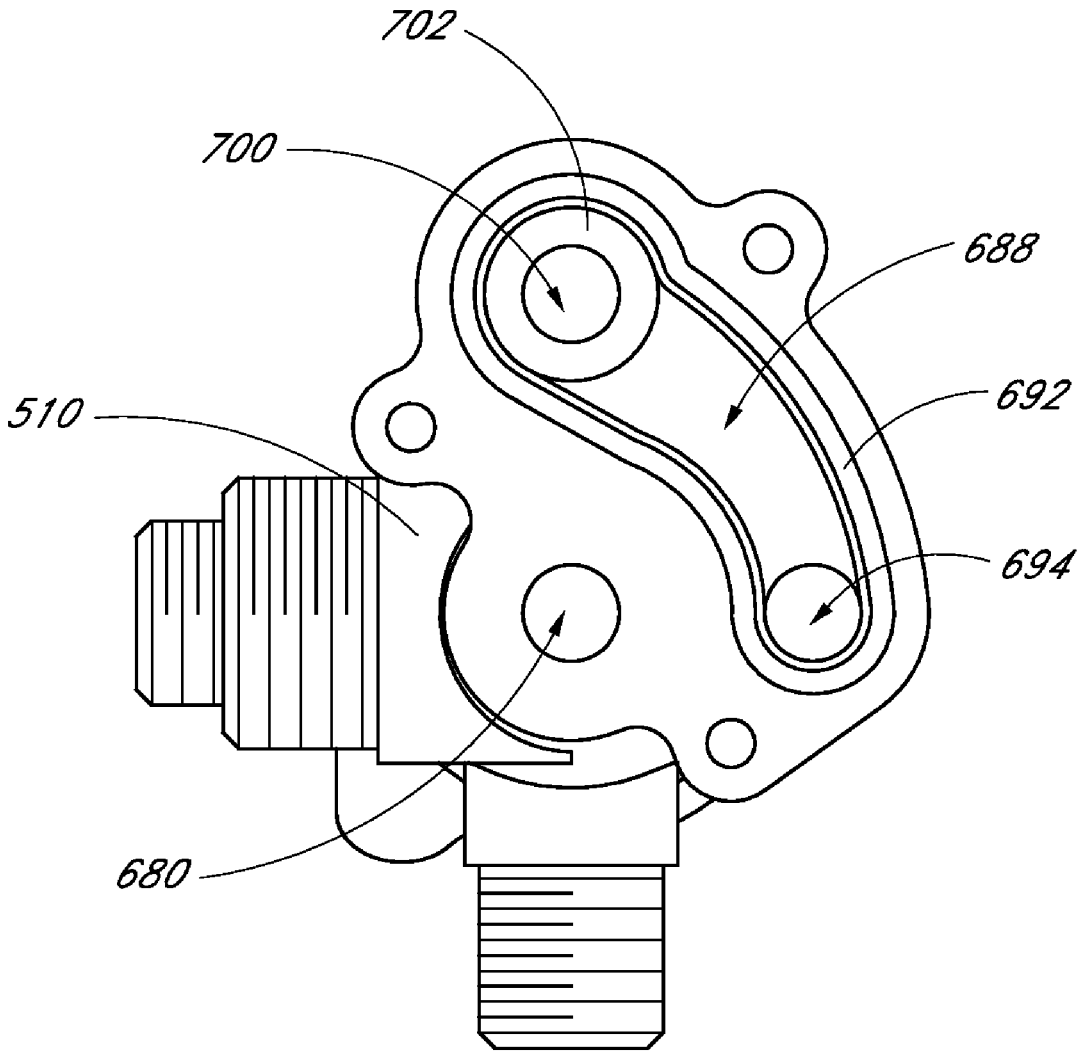
FIG. 18 is a bottom plan view of the valve assembly of FIG. 15.

With reference to FIG. 18, in certain embodiments, the housing 510 defines an opening 680 through which the protrusion 570 of the valve body 550 can extend. The housing can define a recess 688, such as the recess 388. The recess 688 can cooperate with the cover 605 to define a passage through which fuel can flow. In some embodiments, the housing 510 defines a channel 692, such as the channel 392, which can be configured to receive the gasket 592 in order to create a substantially fluid-tight seal between the housing 510 and the cover 605. In some embodiments, fuel can flow from a first egress aperture 694 defined by the housing 510 and into the passage defined by the recess 688 and the cover 605 when the valve assembly 500 is in a first operational configuration, as further described below.

In some embodiments, the housing 510 defines a second egress aperture 700. As further described below, in some embodiments, fuel can flow from the second egress aperture 700 into the first nozzle member 600 when the valve assembly 500 is in a second operational configuration. In some embodiments, the housing 510 defines a recess about the second egress aperture 700 which can be sized and shaped to receive the sealing member 594, and can be configured to form a substantially fluid-tight seal therewith.

Figure 19:
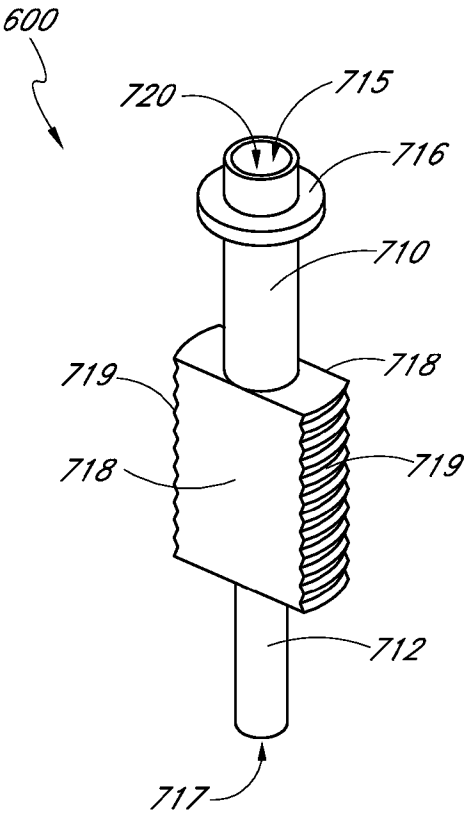
FIG. 19 is a perspective view of an embodiment of a nozzle member compatible with the valve assembly of FIG. 15.

With reference to FIG. 19, in certain embodiments, the first nozzle member 600 includes an upper stem 710, a lower stem 712, and a body 714. In some embodiments, the upper stem 710 is substantially cylindrical. The upper stem can define an input 715 configured to receive fuel into the first nozzle member 600, and can include shelf 716 configured to contact the sealing member 594 in the assembled valve assembly 500. The lower stem 712 can also be substantially cylindrical, and can define an outer diameter smaller than an outer diameter of the upper stem 710. The lower stem 712 can define an output 717 configured to dispense fuel. In some embodiments, an inner diameter defined by the lower stem 712 is smaller than an inner diameter defined by the upper stem 710.

In some embodiments, the body 714 includes two substantially flat faces 718, which can be oriented substantially parallel to each other. The faces 718 can extend outward from the upper and lower stems 710, 712, and can thus define wings. In some embodiments, the nozzle member 600 includes one or more connection interfaces 719 configured to engage the second nozzle member 600. In some embodiments, the connection interfaces 719 comprise curved, threaded surfaces that extend from one face 718 to another.

The first nozzle member 600 can define an inner flow path 720 that extends through the upper and lower stems 710, 712 and the body 714. In some embodiments, fuel can flow through the inner flow path 720 when the valve assembly 500 is in the second operational configuration.

Figure 20:
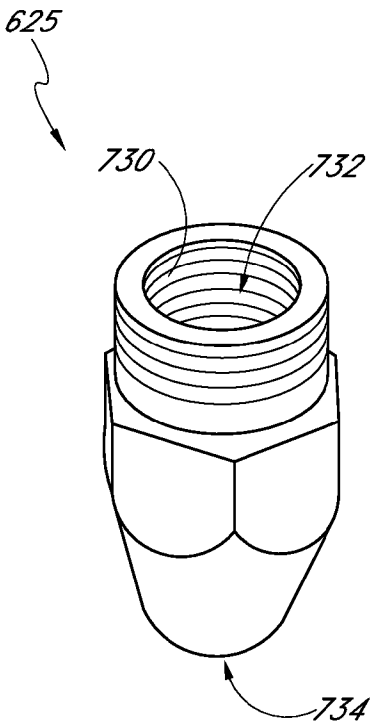
FIG. 20 is a perspective view of an embodiment of a nozzle member compatible with the valve assembly of FIG. 15.

With reference to FIG. 20, in certain embodiments, an inner surface 730 of the second nozzle member 625 is threaded or includes any other suitable connection interface for coupling with the connection interface or interfaces 719 of the first nozzle member 600. In some embodiments, the threading extends through a substantial portion of the nozzle member 625, and extends downward to an inwardly projecting ridge or shelf that can serve as a stop against which a lower edge of the body 714 of the first nozzle member 600 can abut. The second nozzle member 625 can define an input 732 configured to receive fuel, and an output 734 configured to dispense fuel.

Figure 21:
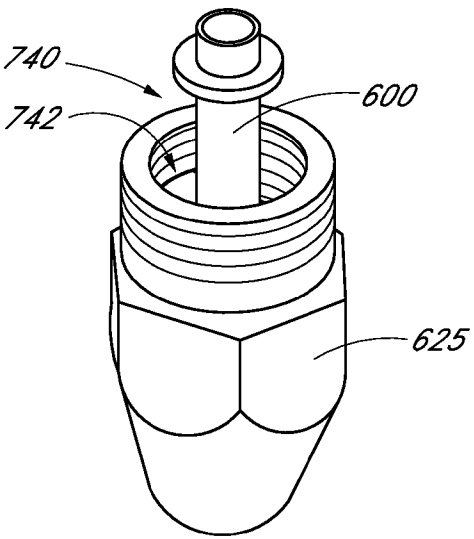
FIG. 21 is a perspective view of the nozzle members of FIGS. 19 and 20 in a coupled configuration.

With reference to FIG. 21, in certain embodiments, the first and second nozzle members 600, 625 define a gap 740 through which fuel can flow. In some embodiments, fuel can flow through the gap 740 and through an outer flow path 742, which can be defined by an outer surface of the first nozzle member 600 and an inner surface of the second nozzle member 625. In some embodiments, fuel flows through the gap 740 and the outer flow path 742 when the valve assembly 500 is in the first operational configuration.

Figure 22A:
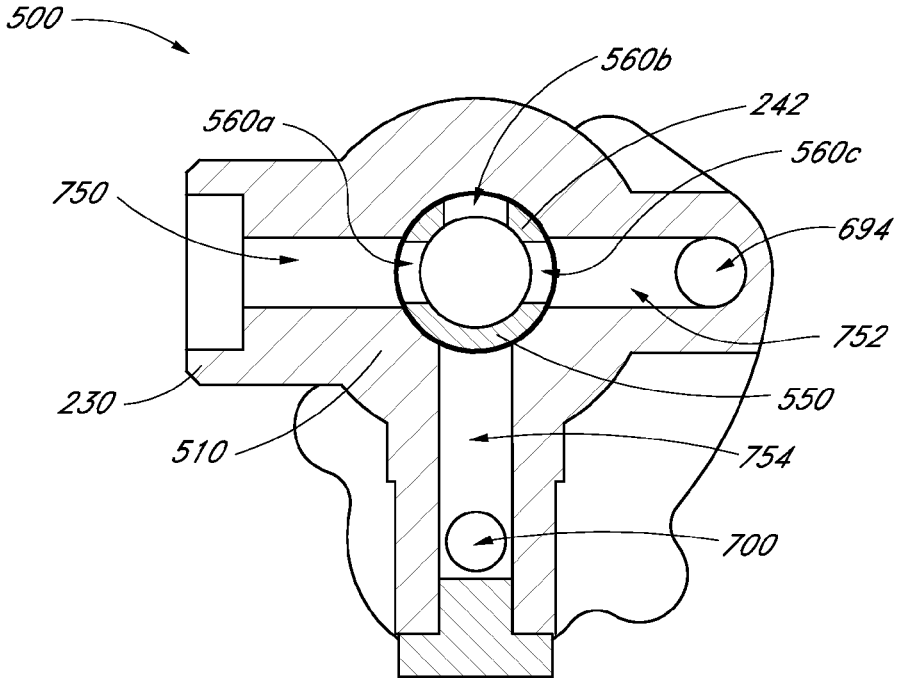
FIG. 22A is a cross-sectional view of the valve assembly of FIG. 15 taken along the view line 22A-22A showing the valve assembly in a first operational configuration.

FIG. 22A illustrates an embodiment of the valve assembly 500 comprising a housing 510 that defines an input flow path 750, a first egress flow path 752, and a second egress flow path 754. In the illustrated embodiment, the valve assembly is in the first operational configuration. In the first configuration, the valve body 550 is oriented in a first position such that the ports 560*a*, 560*c* provide fluid communication between the input flow path 750 and the first egress flow path 752. In some embodiments, the port 560*b* is directed toward the inner sidewall 242 of the housing 510, which can substantially prevent fluid flow out of the port 262*b*. Additionally, the valve body 550 can substantially block the second egress flow path 754, thereby substantially preventing fluid flow through the second egress flow path 754.

Accordingly, in certain embodiments, in the first operational configuration, the valve assembly 500 can accept fuel via the burner input 230, can direct the fuel along the input flow path 750, through the valve body 550, through the first egress flow path 752 and out the first egress aperture 694. As described above, fuel flowing through the first egress aperture 694 can progress through the passage defined by the recess 688 and the cover 605. The fuel can flow through the gap 740 and the outer flow path 742 defined by the first and second nozzle members 600, 625, and can be dispensed via the output 734 of the second nozzle member 625.

In certain embodiments, when the valve assembly 500 is in the first operational configuration, the valve body 550 is oriented such that the port 555*a* (see FIG. 17C) is in fluid communication with the pilot input 220 and the port 555*b* (see FIG. 17C) is in fluid communication with the first pilot output 222. The valve body 550 can thus function similarly to the valve body 250, and can direct fuel from the pilot input 220 to the first pilot output 222.

Figure 22B:
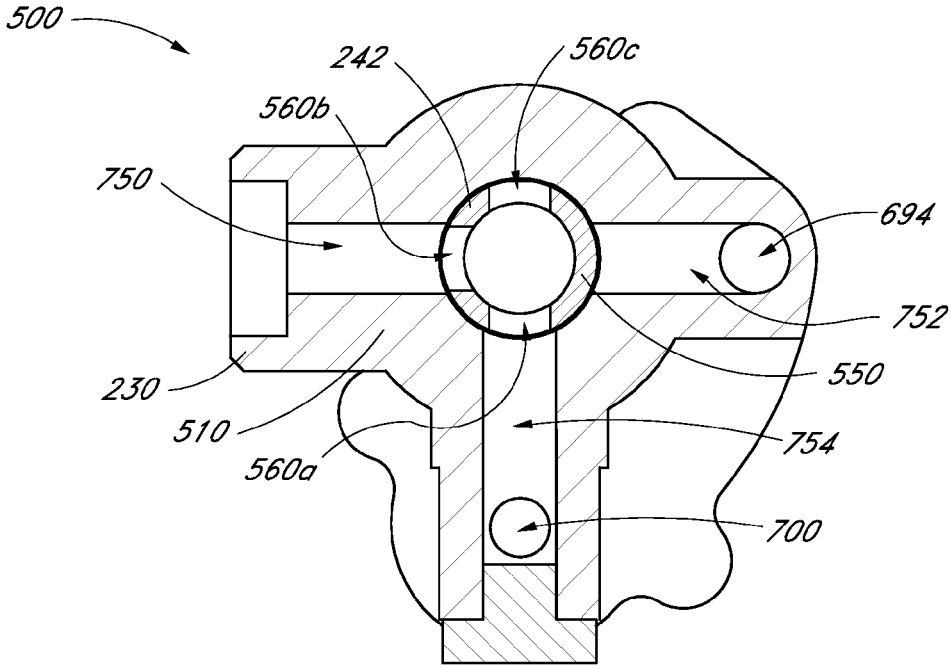
FIG. 22B is a cross-sectional view of the valve assembly of Figure similar to the view depicted in FIG. 22A showing the valve assembly in a second operational configuration.

FIG. 22B illustrates an embodiment of the valve assembly 500 in the second operational configuration. In the second configuration, the valve body 550 is oriented in a second position such that the ports 560*a*, 560*b* provide fluid communication between the input flow path 750 and the second egress flow path 754. In some embodiments, the port 560*c* is directed toward the inner sidewall 242 of the housing 510, which can substantially prevent fluid flow out of the port 560*c*. Additionally, the valve body 550 can substantially block the first egress flow path 752, thereby substantially preventing fluid flow through the first egress flow path 752.

Accordingly, in certain embodiments, in the second operational configuration, the valve assembly 500 can accept fuel via the burner input 230, can direct the fuel along the input flow path 750, through the valve body 550, through the second egress flow path 754 and out the second egress aperture 700. Fuel flowing through the second egress aperture 700 can progress through the first nozzle member 600 and can be dispensed by the output 717.

In certain embodiments, when the valve assembly 500 is in the second operational configuration, the valve body 550 is oriented such that the port 555*b* (see FIG. 17C) is in fluid communication with the pilot input 220 and the port 555*a* (see FIG. 17C) is in fluid communication with the second pilot output 224. The valve body 550 can thus function similarly to the valve body 250, and can direct fuel from the pilot input 220 to the second pilot output 224.

Figure 23A:
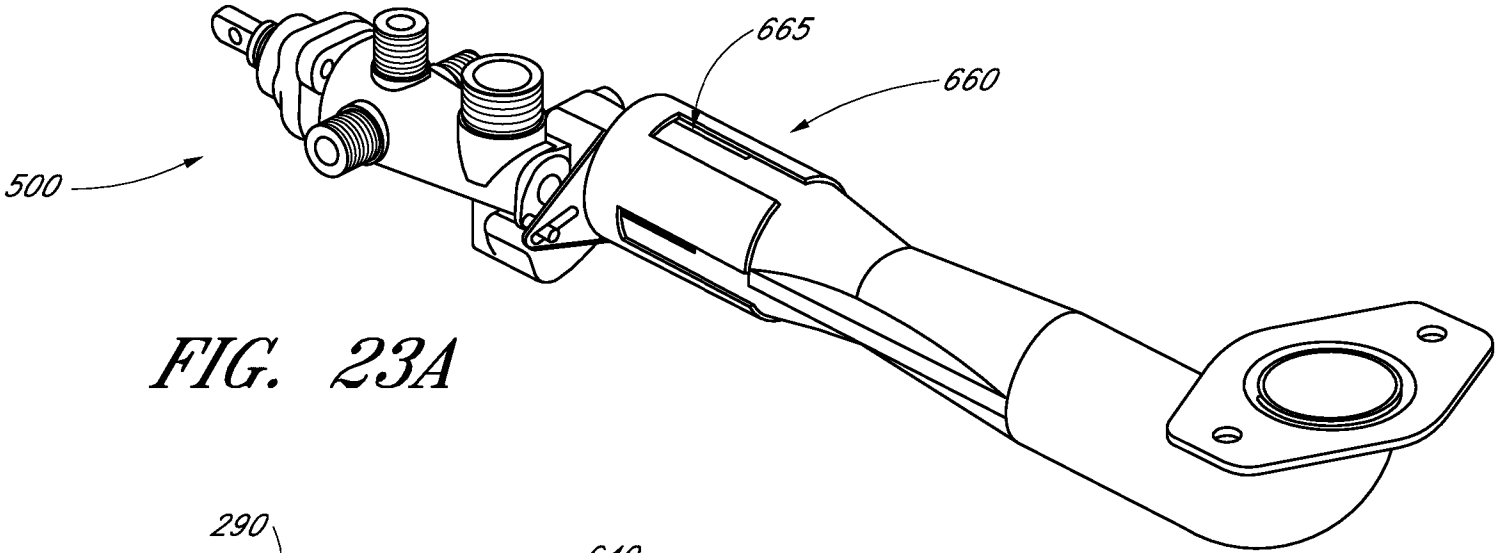
FIG. 23A is a perspective view of the valve assembly coupled with a fuel delivery line showing the valve assembly in the first operational configuration.

With reference to FIG. 23A, in certain embodiments, the first and second nozzle members are 600, 625 are positioned to deliver fuel to the mixing compartment 660. In the illustrated embodiment, the valve assembly 500 is in the first configuration such that fuel can be dispensed via the second nozzle member 625. The flow channels or windows 665 are relatively small and allow a relatively small amount and/or a relatively low flow rate of air therethrough. In some embodiments, as fuel is dispensed from the second nozzle member 625, air is drawn through the windows 665. In some embodiments, the size of the windows 665 is such that the amount of air drawn into the mixing compartment 660 is adequate to form an air-fuel mixture that combusts as a substantially yellow flame (e.g., a flame of which a substantial portion is yellow) at the burner 135. In some embodiments, the valve assembly 500 is configured to dispense natural gas at a first pressure so as to produce a substantially yellow flame at the burner 135.

Figure 23B:
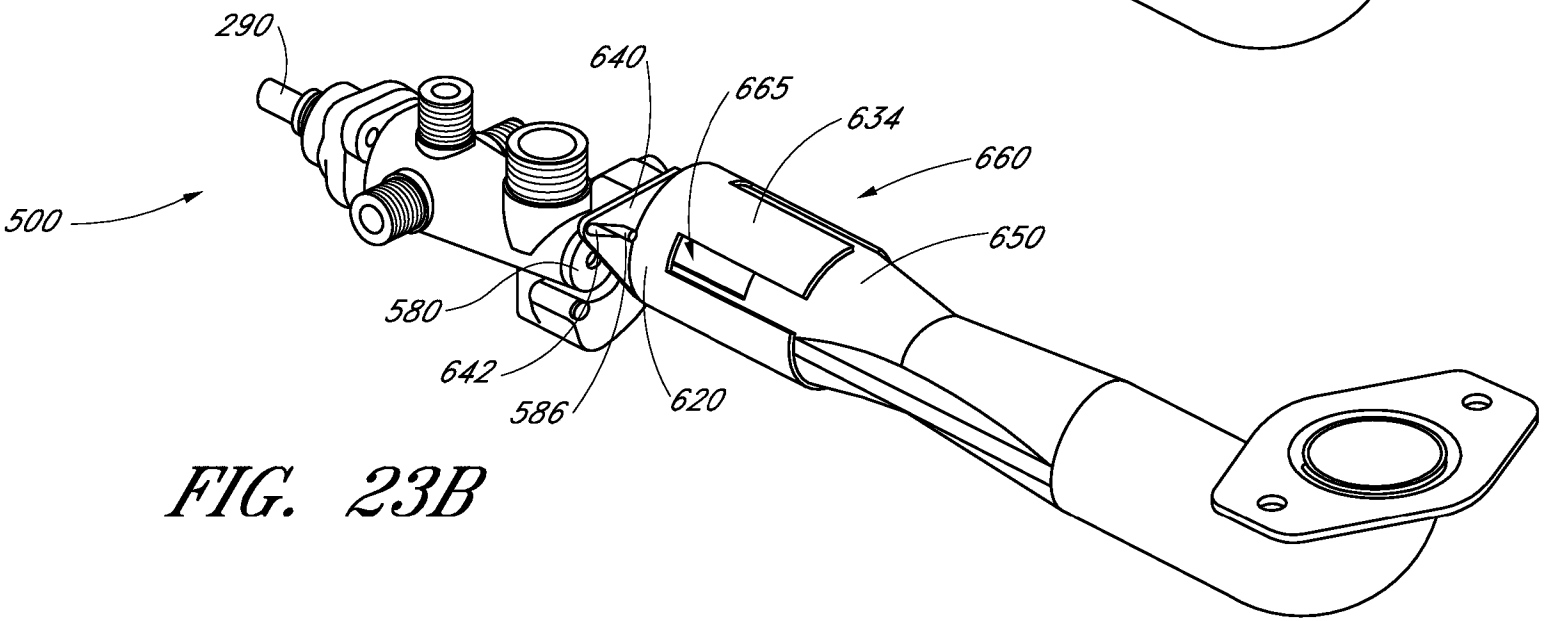
FIG. 23B is a perspective view of the valve assembly coupled with a fuel delivery line showing the valve assembly in the second operational configuration.

With reference to FIG. 23B, the valve assembly 500 can be configured to transition to the second operational configuration. In certain embodiments, the shaft 290 is rotated, thereby rotating the valve body 550, which rotates the cam 580. In some embodiments, rotation of the cam 580 translates the rod 586 within the slot 642 defined by the extension 640, thereby imparting rotational movement to the cover 620. Movement of the cover 620 can rotate the screens 634 relative to openings in the conduit 650, thereby adjusting the size of the windows 665. For example, prior to rotation of the screens 634, the windows 665 can define a first flow area, and subsequent to rotation of the screens 634, the windows 665 can define a second flow area which varies from the first flow area.

In some embodiments, when the valve assembly 500 is in the second operating configuration, the windows 665 are relatively larger than they are when the valve assembly 500 is in the first configuration. In some embodiments, the size of the windows 665 changes by a predetermined amount between the first and second configurations.

In some embodiments, the size of the windows 665 is such that, when the valve assembly 500 is in the second configuration, the amount of air drawn into the mixing compartment 660 is adequate to form an air-fuel mixture that combusts as a substantially yellow flame at the burner 135. In some embodiments, the valve assembly 500 is configured to dispense propane at a second pressure so as to produce a substantially yellow flame at the burner 135. In some embodiments, the second pressure at which propane is dispensed is larger than the first pressure at which natural gas is dispensed when the valve assembly is in the first configuration.

The valve assembly 500 can transition from the second operational configuration to the first operational configuration. In certain embodiments, the screens 634 occlude a larger portion of the openings defined by the conduit 650 when the valve assembly 500 transitions from the second operational configuration to the first operational configuration, thus reducing the size of the windows 665. Advantageously, the valve assembly 500 can transition between the first and second operating configurations as desired with relative ease. Accordingly, a user can select whichever configuration is appropriate for the fuel source with which the valve assembly 500, and more generally, the heater 10, is to be used.

Figure 24:
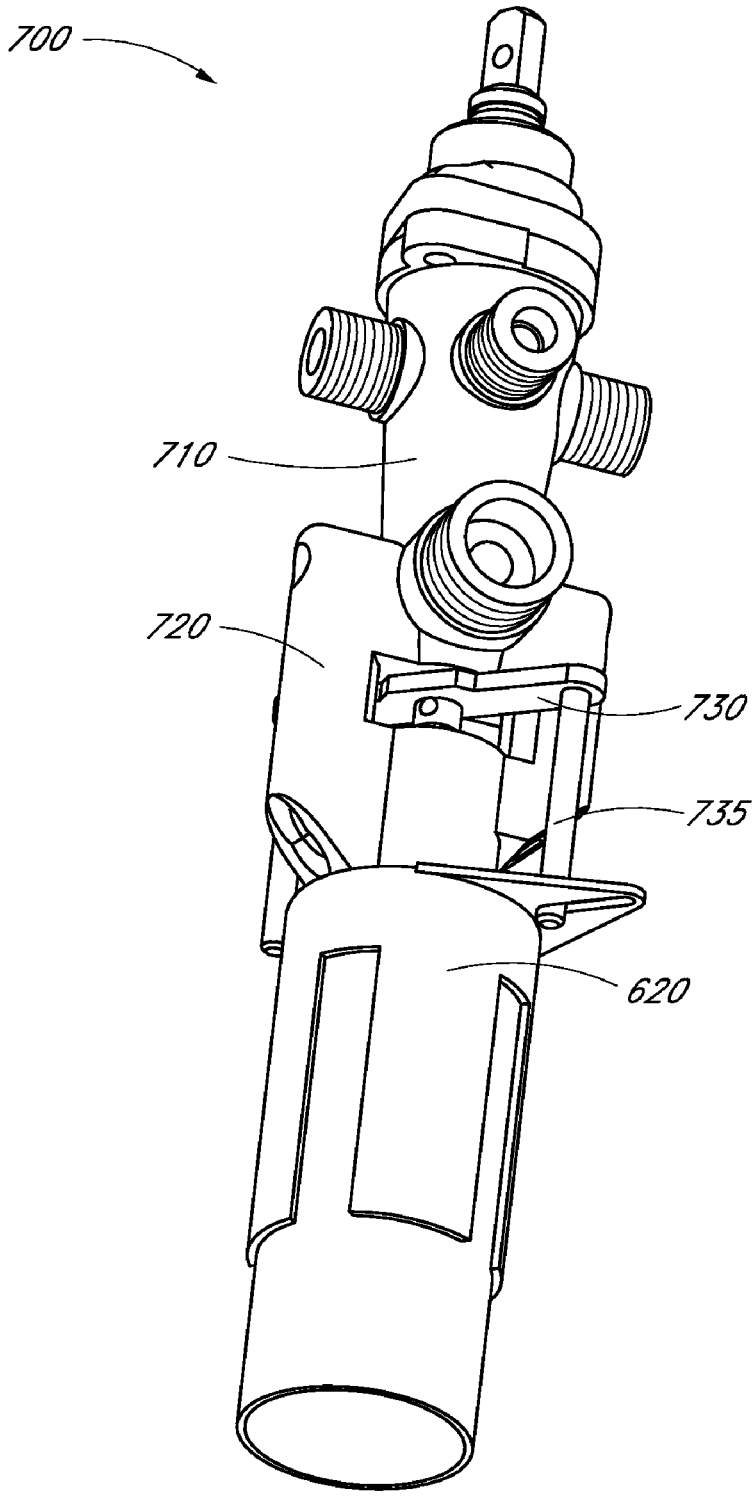
FIG. 24 is a perspective view of another embodiment of a valve assembly compatible with, for example, certain embodiments of the heater 10.

FIG. 24 illustrates another embodiment of a valve assembly 700 similar to the valve assembly 500. The valve assembly 700 can include a housing 710 that defines a channel housing 720. The valve assembly 700 can include a cam 730 from which a rod 735 extends to interact with the cover 620.

Figure 25:
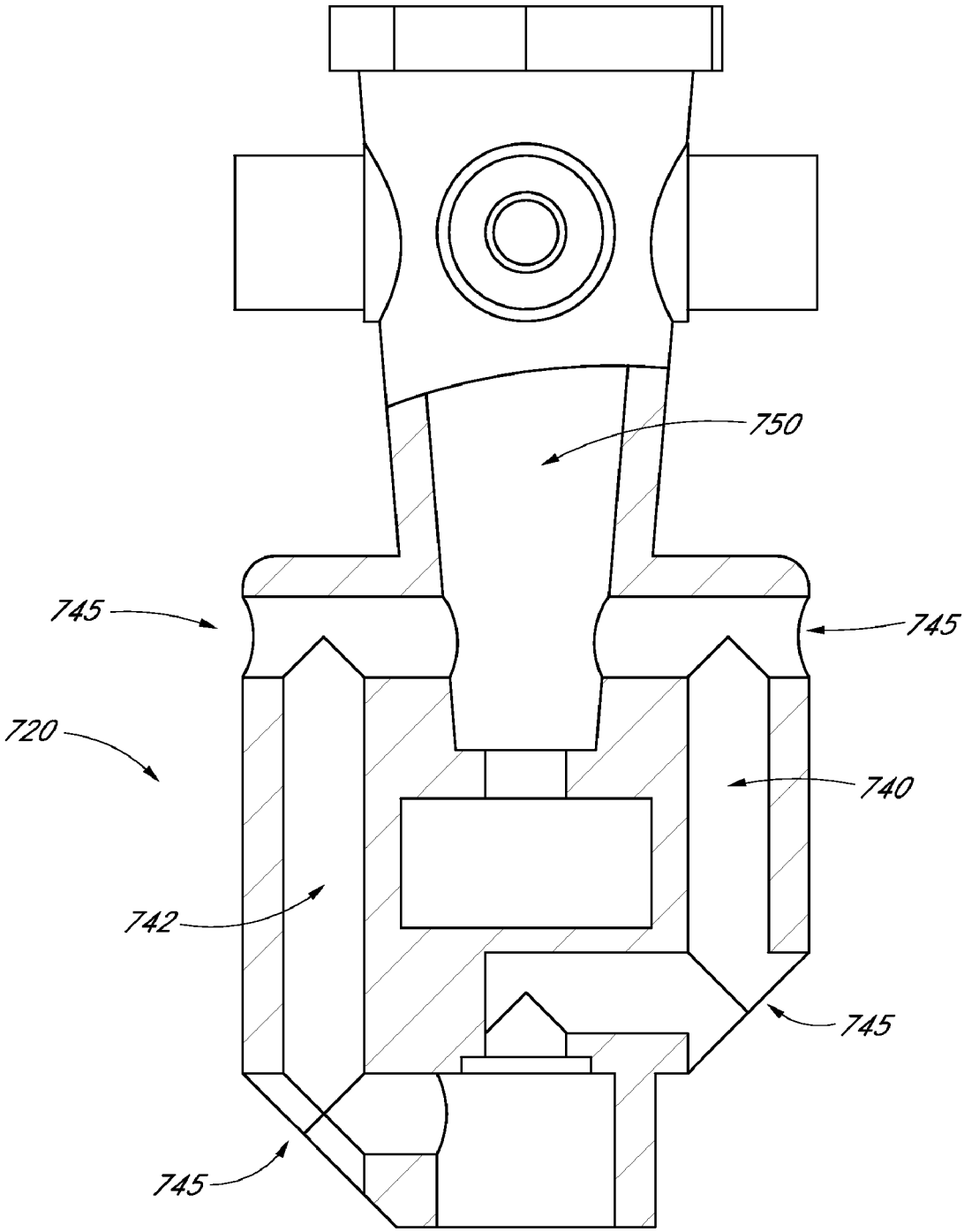
FIG. 25 is a partial cross-sectional view of a housing compatible with the valve assembly of FIG. 24.

With reference to FIG. 25, in certain embodiments, the channel housing 720, can define a first channel 740 configured to direct fuel to the first nozzle member 600, and can define a second channel 742 configured to direct fuel to the second nozzle member 625. In some embodiments, the first and second channels 740, 742 are formed via multiple drillings, and access holes 745 formed during the drillings are subsequently plugged. In some embodiments, the first and second channels 740, 742 extend from substantially opposite sides of a chamber 750.

With reference to FIG. 26, in some embodiments, a valve member or valve body 760 compatible with embodiments of the valve assembly 700 defines an upper flow channel 762 and a lower flow channel 764 that are similarly shaped, and can be formed by drilling into a body of the valve body 760. Each flow channel 762, 764 can redirect fluid flow at an angle of about 90 degrees. Other angles are possible. In some embodiments, respective ingress ports and egress ports of the flow channels 762, 764 are substantially coplanar along a plane running through a longitudinal axis of the valve body 760. The ingress and/or egress ports can also be offset from each other.

Figure 27A:
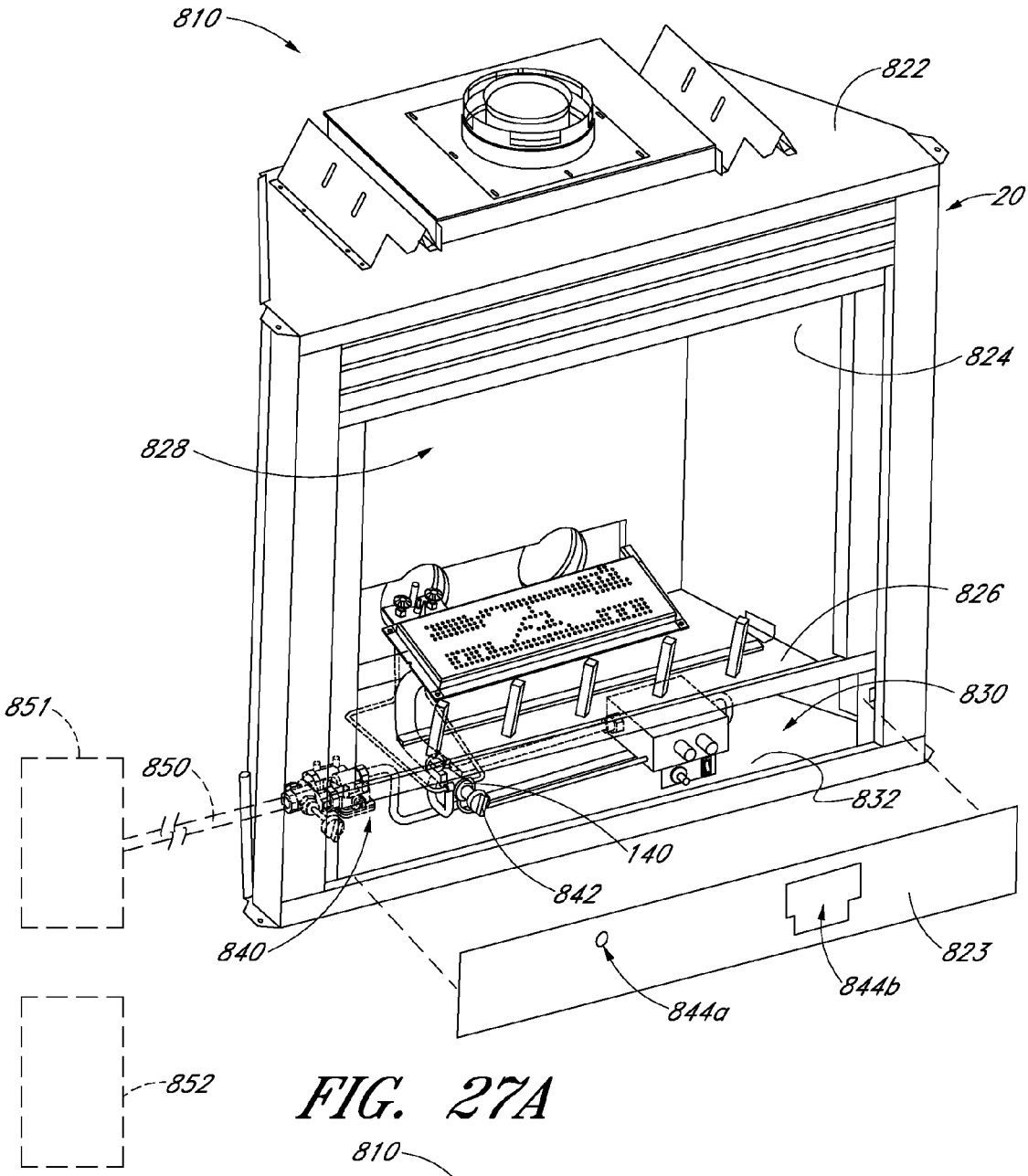
FIG. 27A is a perspective partially exploded view of another embodiment of a heating device.

FIG. 27A illustrates an embodiment of a heater, fireplace, or heating device 810. The heating device 810 can resemble the heating device 10 in many respects, thus like features are identified with like numerals. The heating device 810 can differ in other respects, such as those described hereafter.

In certain embodiments, the heating device 810 includes a housing 20. In some embodiments, the housing 20 includes an outer shell or casing 822, which can be configured to be mounted within a structure, such as a wall or fireplace. In some embodiments, the casing 822 includes a removable panel 823, as discussed further below. In some embodiments, the housing 20 includes a firebox or inner casing 824, which can include a partition or floor 826. In some embodiments, the inner casing 824 defines a cavity or combustion chamber 828. In some embodiments, the combustion chamber 828 is configured to sustain a controlled burn of gas fuel.

In some embodiments, the housing 20 defines an access port or opening 830. In certain embodiments, the opening 830 provides access to a volume of space located between a base 832, which in some embodiments is the base of the outer casing 822, and the floor 826 of the inner casing 824.

In certain embodiments, the heating device 810 includes a fuel delivery system 840. In some embodiments, the fuel delivery system 840 includes a valve assembly 140, which in some embodiments is coupled with an actuator, switch, or knob 842. In some advantageous embodiments, at least a portion of the fuel delivery system 840 is located in the space between the base 832 and the floor 826, and thus may be relatively cool with respect to the chamber 828 when the heating device 810 is in use. Accordingly, certain components of the fuel delivery system 840 can be shielded from an elevated temperature within the chamber 828.

In some embodiments, the panel 823 is configured to cover the access opening 830 and can desirably hide portions of the fuel delivery system 840 from view. In some embodiments, the panel 823 defines one or more apertures 844*a, b* through which one or more portions of the fuel delivery system 840 can extend.

Figure 27B:
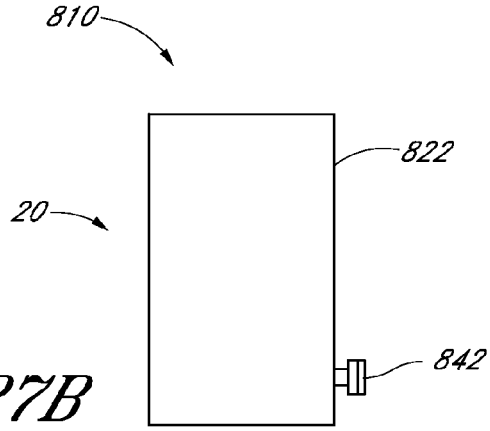
FIG. 27B is a schematic side plan view of the heating device shown in FIG. 27A.

As schematically illustrated in FIG. 27B, in certain embodiments, the knob 842 extends through the panel 823 the panel is coupled with the outer casing 822. In other embodiments, the knob 842 extends through some other portion of the housing 20. In still other embodiments, the knob 842 is completely within the housing 20. For example, in some embodiments, the knob 842 is within the chamber 828. In some desirable embodiments, the knob 842 is within the volume of space between the floor 826 and the base 832.

With reference again to FIG. 27A, in some embodiments, the heating device 810 is configured to be mounted within a cavity in relatively fixed or permanent manner. For example, in some embodiments, the heating device 810 can desirably be mounted in a wall of a building or other structure. In certain embodiments, the fuel delivery system 840 is coupled with tubing or piping 850 of the structure in which the heating device 810 is mounted. For example, in some embodiments, the heating device 810 is coupled with a gas line of the structure.

The piping 850 can be configured to convey fuel from a first fuel source 851 or a second fuel source 852. In some embodiments, the first fuel source 851 delivers a first fuel at a first pressure to the fuel delivery system 840. In some embodiments, the second fuel source 852 delivers a second fuel at a second pressure to the fuel delivery system 840. Advantageously, the first fuel source 851 and the second fuel source 852 can be interchanged to supply either of the first fuel or the second fuel to the fuel delivery system 840. For example, in certain embodiments, the first fuel source comprises a liquid propane tank and the second fuel source comprises a natural gas main. Accordingly, in certain instances, a household or other structure serviced by liquid propane could switch to natural gas without changing the piping 850.

In some embodiments, a conduit, tube, or pipe of the piping 850 is coupled with an input of the fuel delivery system 840. In some embodiments, the piping 850 and the fuel delivery system 840 are coupled at a point exterior to the outer housing 822. In other embodiments, the piping 850 and the fuel delivery system 840 are coupled at a point interior to the housing 822.

Figure 28:
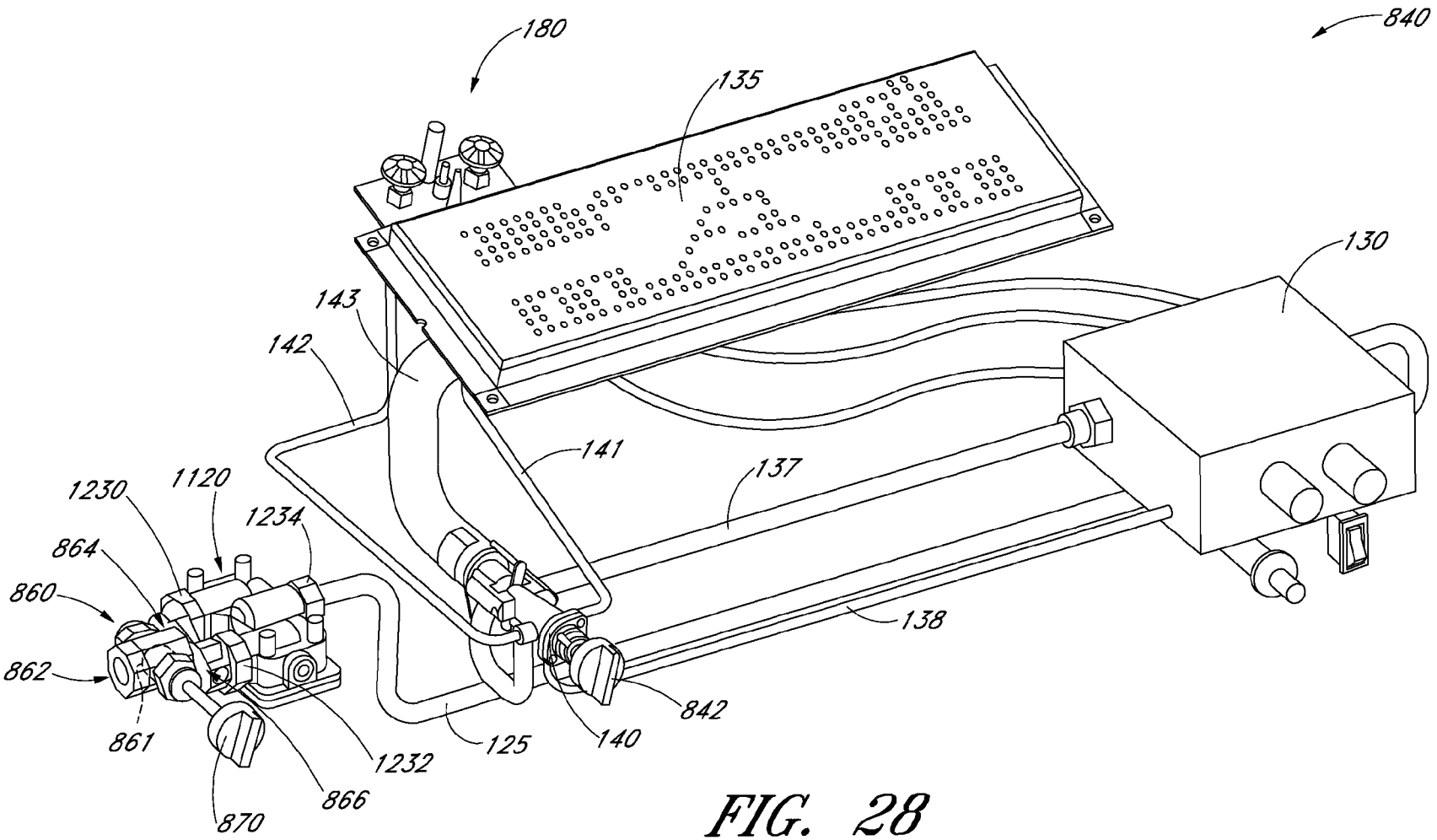
FIG. 28 is a perspective view of an embodiment of a fuel delivery system compatible with the heating device of FIG. 27A.
Figure 29:
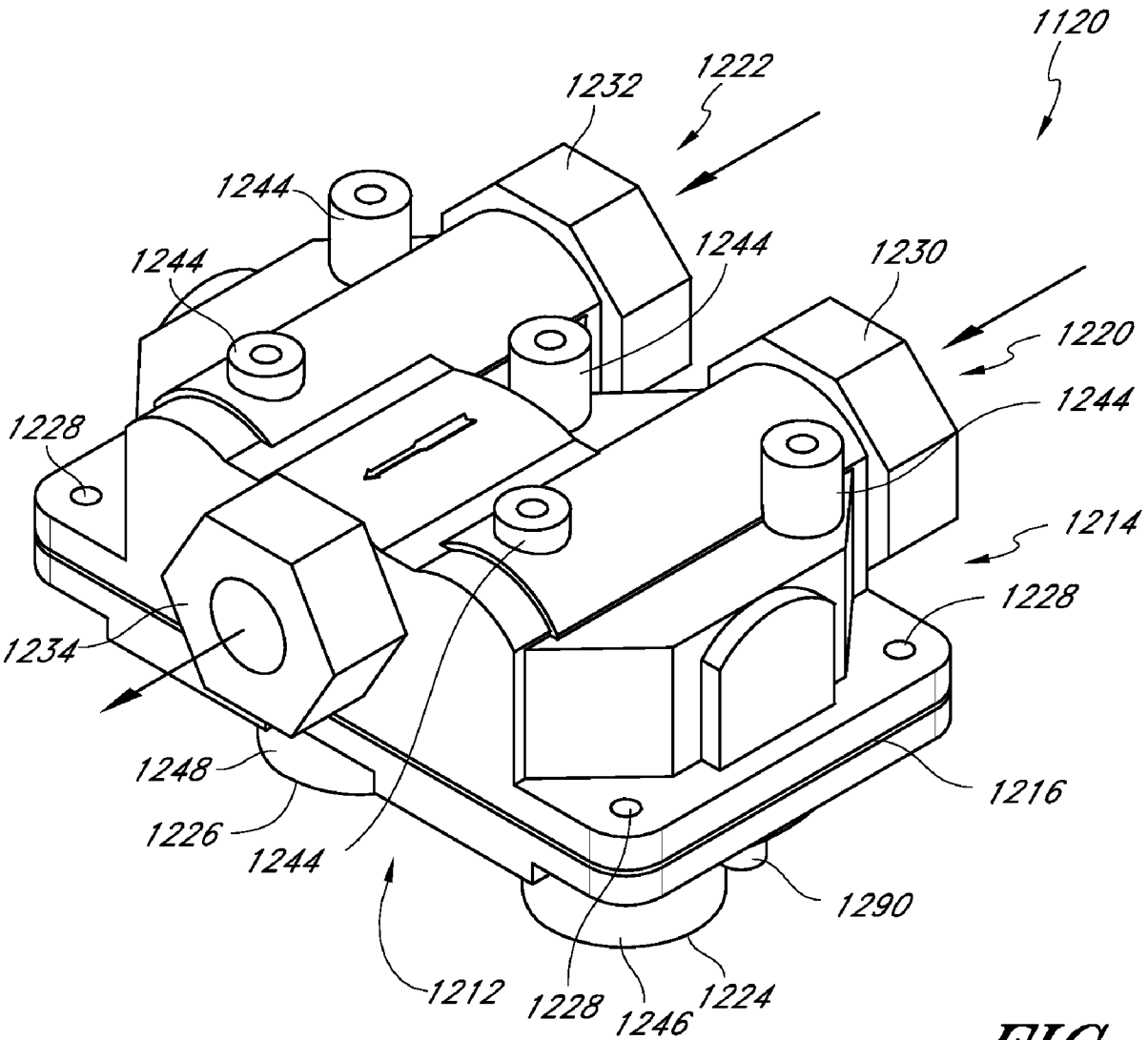
FIG. 29 is a bottom perspective view of an embodiment of a pressure regulator configured to couple with either the first fuel source or the second fuel source.
Figure 30:
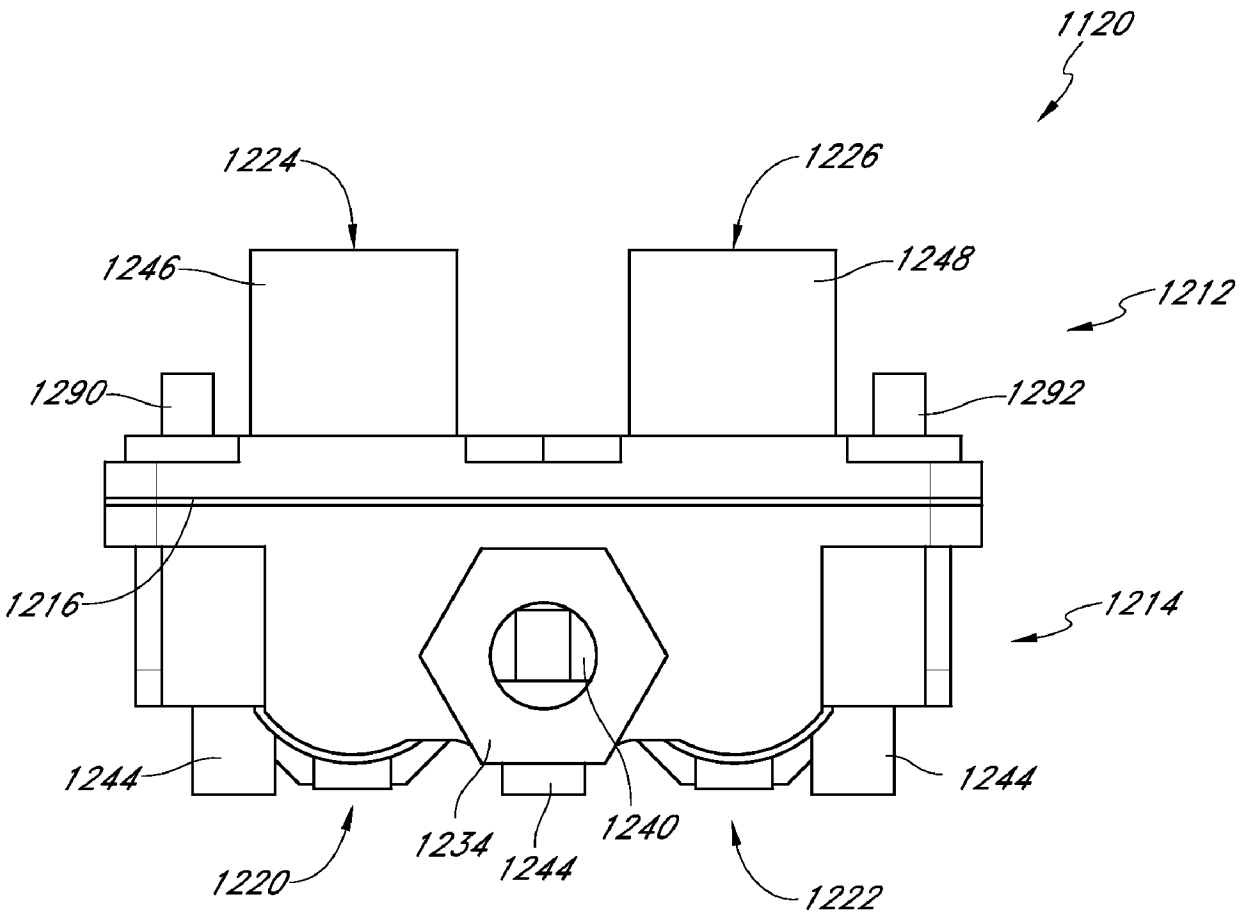
FIG. 30 is a back elevation view of the pressure regulator of FIG. 29.
Figure 31:
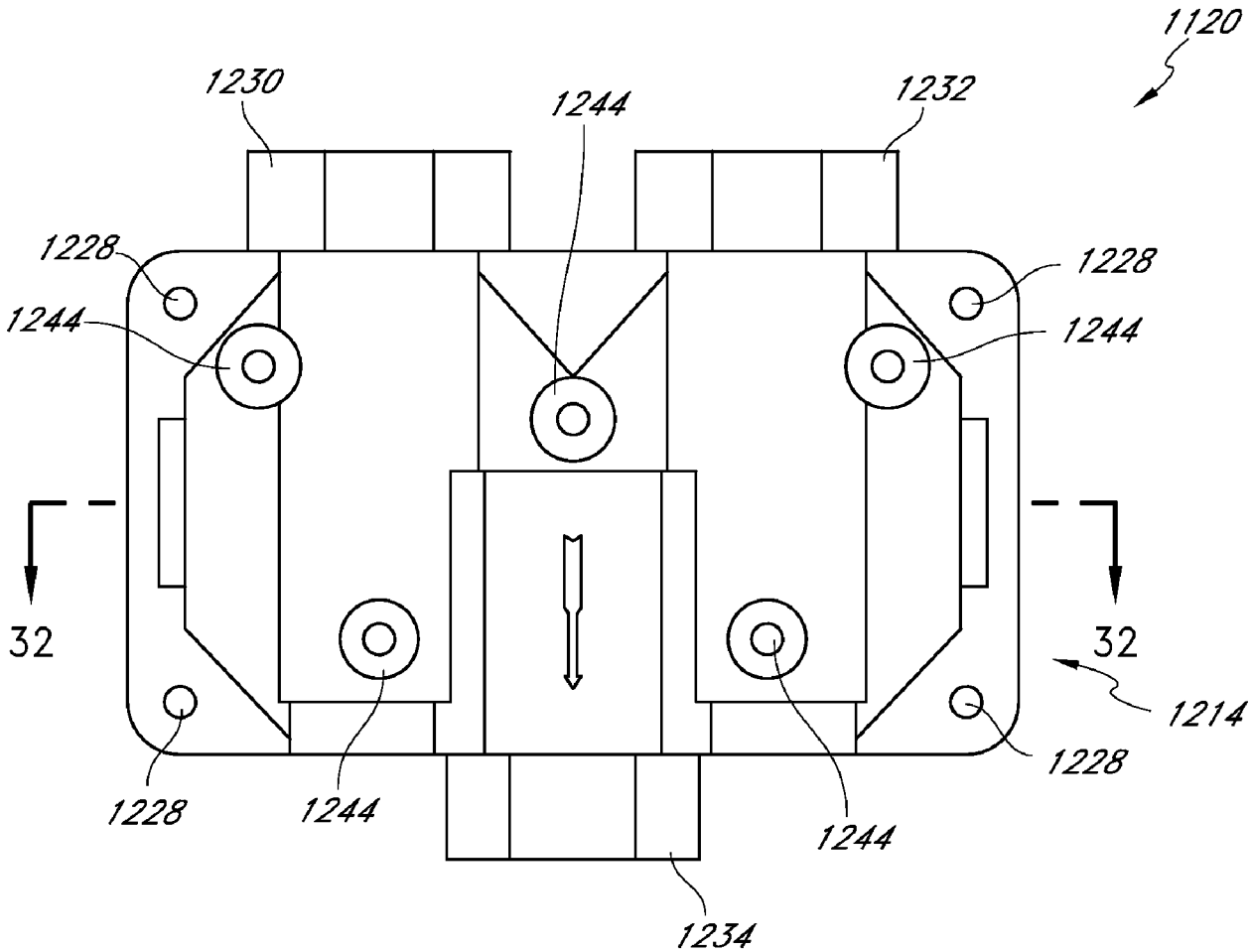
FIG. 31 is a bottom plan view of the pressure regulator of FIG. 29.
Figure 32:
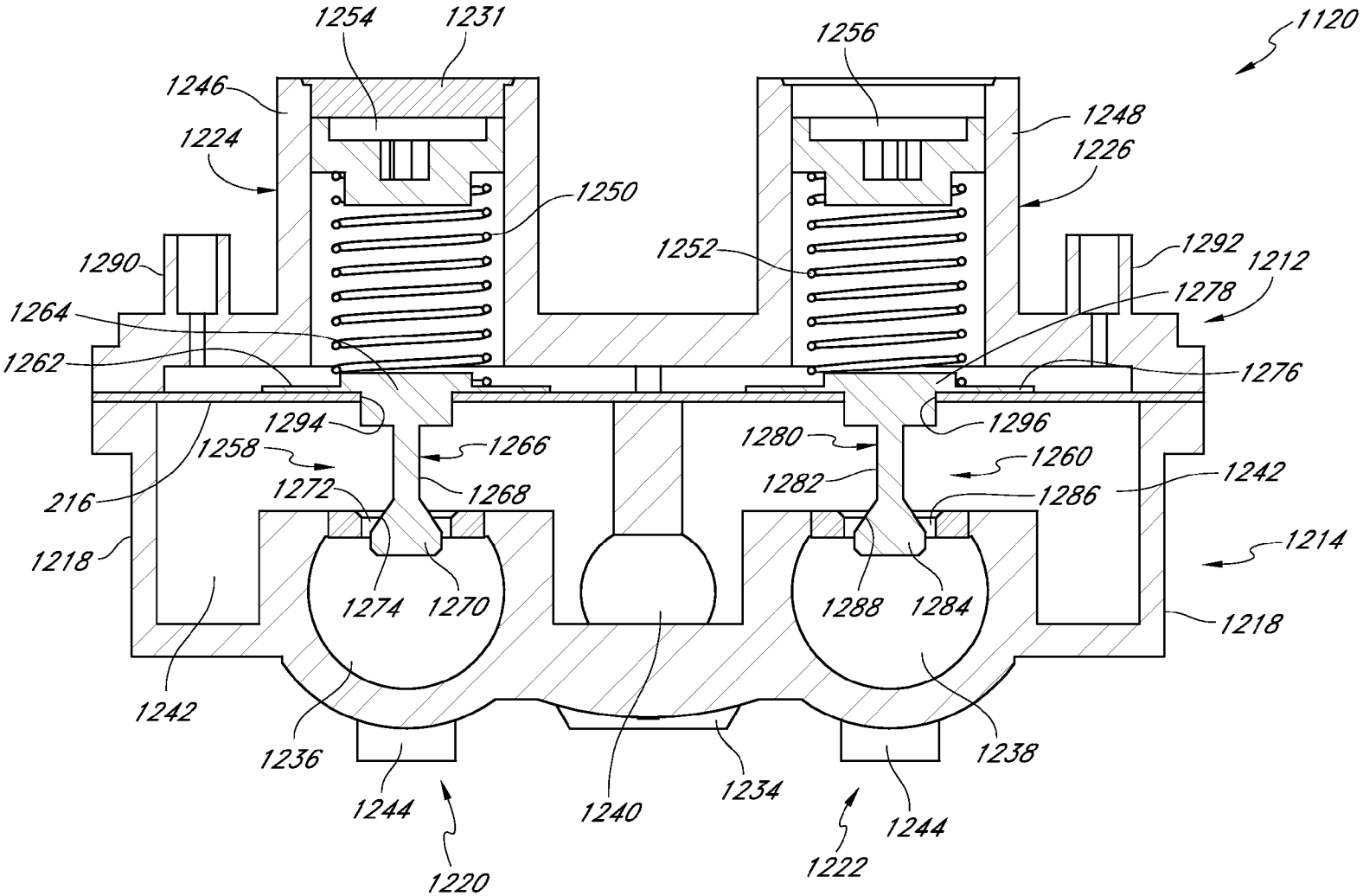
FIG. 32 is a cross-sectional view of the pressure regulator of FIG. 29 taken along the line 32-32 in FIG. 31.
Figure 33:
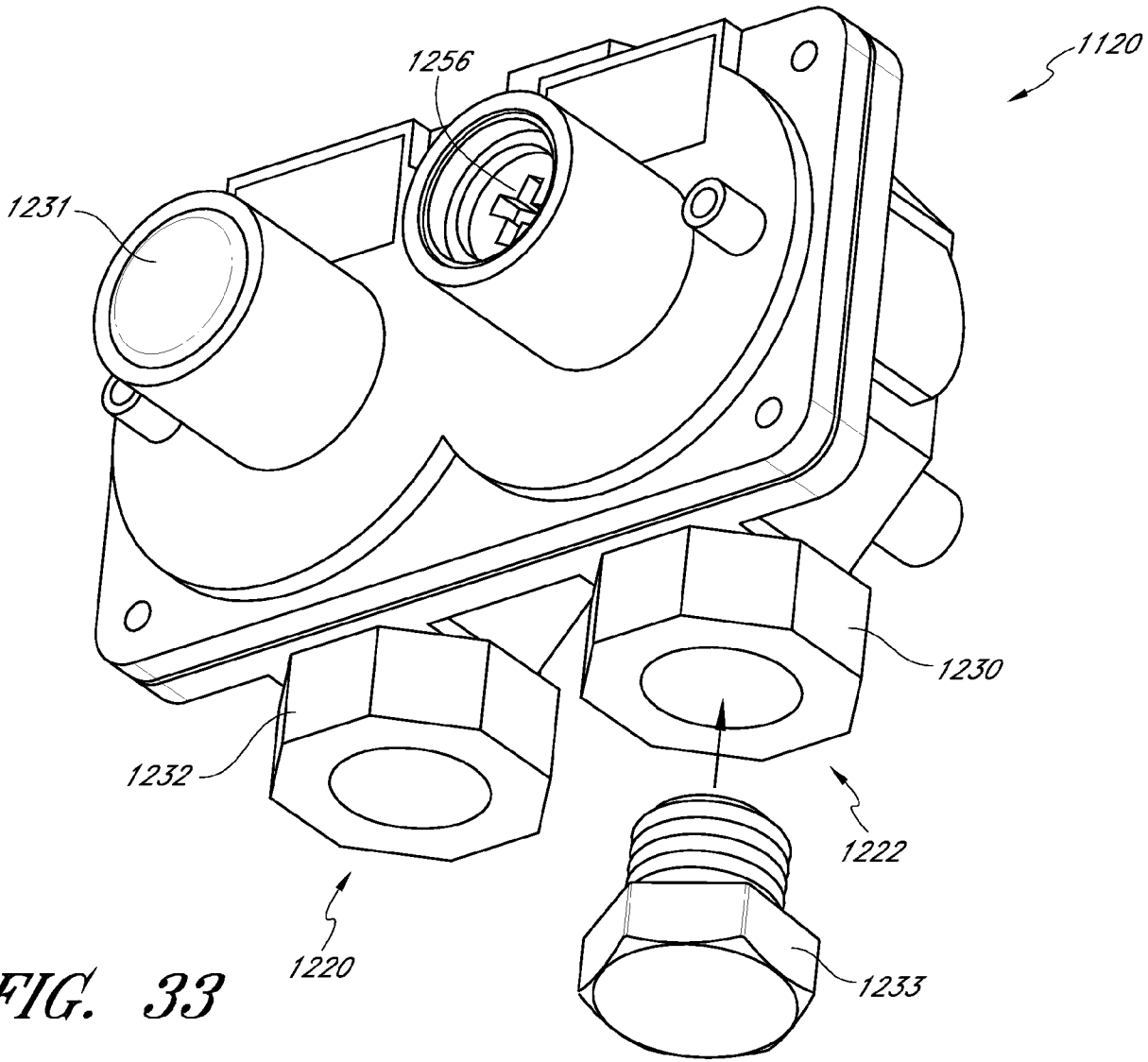
FIG. 33 is a top perspective view of the pressure regulator of FIG. 29.

With reference to FIG. 28, in certain embodiments, the fuel delivery system 840 includes the valve assembly 140, a control valve 130, a burner 135, and/or a pilot assembly 180. In certain embodiments, the valve assembly 140 includes a source line 125, a burner transport line 137, a pilot transport line 138, a first pilot delivery line 141, a second pilot deliver line 142, and/or burner delivery line 143, which can interconnect various components of the valve assembly 140 in a manner such as described above with respect to the fuel delivery system 40.

In certain embodiments, the fuel delivery system 840 includes a pressure regulator 1120, which is described in detail below. In some embodiments, the regulator 1120 includes a first input port 1230, a second input port 1232, and an output port 1234. In some embodiments, the output port 1234 is connected with the source line 125.

In some embodiments, the fuel delivery system 840 includes an intake valve 860, which can include an input 862, a first output 864, and a second output 866. In some embodiments, the input 862 is coupled with the piping 850, the first output 864 is coupled with the first input port 1230 of the pressure regulator, and the second output 866 is coupled with the second input port 1232 of the pressure regulator.

In some embodiments, the intake valve 860 further includes a valve body 861 directly or indirectly connected to an actuator, selector, or knob 870. In some embodiments, the knob 870 is configured to transition the intake valve 860 between a first state in which fuel received via the input 862 is channeled or directed to the first output 864 and a second state in which fuel received via the input 862 is channeled or directed to the second output 866. As with the knob 842, in various embodiments, the knob 870 can be inside or at least partially outside of the chamber 828. Similarly, the knob 842 can be inside or at least partially outside of the casing 822.

With reference to FIGS. 29-33, certain embodiments of the pressure regulator 1120 will now be described. FIGS. 29-33 depict different views of one embodiment of the pressure regulator 1120. The regulator 1120 desirably provides an adaptable and versatile system and mechanism which allows at least two fuel sources to be selectively and independently utilized with the heater 810. In some embodiments, the fuel sources comprise natural gas and propane, which in some instances can be provided by a utility company or distributed in portable tanks or vessels.

In certain embodiments, the heater 810 and/or the regulator 1120 are preset at the manufacturing site, factory, or retailer to operate with selected fuel sources. As discussed below, in many embodiments, the regulator 1120 includes one or more caps 1231 to prevent consumers from altering the pressure settings selected by the manufacturer. Optionally, the heater 810 and/or the regulator 1120 can be configured to allow an installation technician and/or user or customer to adjust the heater 810 and/or the regulator 1120 to selectively regulate the heater unit for a particular fuel source.

In many embodiments, the regulator 1120 comprises a first, upper, or top portion or section 1212 sealingly engaged with a second, lower, or bottom portion or section 1214. In some embodiments, a flexible diaphragm 1216 or the like is positioned generally between the two portions 1212 and 1214 to provide a substantially airtight engagement and generally define a housing or body portion 1218 of the second portion 1212 with the housing 1218 also being sealed from the first portion 1212. In some embodiments, the regulator 1120 comprises more than one diaphragm 1216 for the same purpose.

In certain embodiments, the first and second portions 1212 and 1214 and diaphragm 1216 comprise a plurality of holes or passages 1228. In some embodiments, a number of the passages 1228 are aligned to receive a pin, bolt, screw, or other fastener to securely and sealingly fasten together the first and second portions 1212 and 1214. Other fasteners such as, but not limited to, clamps, locks, rivet assemblies, or adhesives may be efficaciously used.

In some embodiments, the regulator 1120 comprises two selectively and independently operable pressure regulators or actuators 1220 and 1222 which are independently operated depending on the fuel source, such as, but not limited to, natural gas and propane. In some embodiments, the first pressure regulator 1220 comprises a first spring-loaded valve or valve assembly 1224 and the second pressure regulator 1222 comprises a second spring-loaded valve or valve assembly 1226.

In certain embodiments, the second portion 1214 comprises a first fluid opening, connector, coupler, port, or inlet 1230 configured to be coupled to a first fuel source (e.g., via the first output 864 of the intake valve 860). In further embodiments, the second portion 1214 comprises a second fluid opening, connector, coupler, port, or inlet 1232 configured to be coupled to a second fuel source (e.g., via the second output 866 of the intake valve 860). In some embodiments, the second connector 1232 is threaded. In some embodiments, the first connector 1230 and/or the first fuel source comprises liquid propane and the second fuel source comprises natural gas, or vice versa. The fuel sources can efficaciously comprise a gas, a liquid, or a combination thereof.

In certain embodiments, the second portion 1214 further comprises a third fluid opening, connector, port, or outlet 1234 configured to be coupled with the source line 125 of the heater 810, as described above. In some embodiments, the connector 1234 comprises threads for engaging the source line 125. Other connection interfaces may also be used.

In some embodiments, the housing 1218 of the second portion 1214 defines at least a portion of a first input channel or passage 1236, a second input channel or passage 1238, and an output channel or passage 1240. In many embodiments, the first input channel 1236 is in fluid communication with the first connector 1230, the second input channel 1238 is in fluid communication with the second connector 1232, and the output channel 1240 is in fluid communication with the third connector 1234.

In certain embodiments, the output channel 1240 is in fluid communication with a chamber 1242 of the housing 1218 and the source line 125 of the heater 810. In some embodiments, the input channels 1236, and 1238 are selectively and independently in fluid communication with the chamber 1242 and a fuel source depending on the particular fuel being utilized for heating.

In one embodiment, when the fuel comprises natural gas, the second input connector 1232 is sealingly plugged by a plug or cap 1233 (see FIG. 33) while the first input connector 1230 is connected to and in fluid communication with a fuel source that provides natural gas for combustion and heating. In certain embodiments, the cap 1233 comprises threads or some other suitable fastening interface for engaging the connector 1232. The natural gas flows in through the first input channel 1236 into the chamber 1242 and out of the chamber 1242 through the output channel 1240 and into the source line 125 of the heater 810.

In another embodiment, when the fuel comprises propane, the first input connector 1230 is sealingly plugged by a the plug or cap 1233 while the second input connector 1232 is connected to and in fluid communication with a fuel source that provides propane for combustion and heating. The propane flows in through the second input channel 1238 into the chamber 1242 and out of the chamber 1242 through the output channel 1240 and into the source line 125 of the heater 810. As one having skill in the art would appreciate, when the cap 1233 is coupled with either the first input connector 1230 or the second input connector 1232 prior to packaging or shipment of the heater 810, it can have the added advantage of helping consumers distinguish the first input connector 1230 from the second input connector 1232.

As is evident from at least the description of the intake valve 860 above, in other embodiments, when the fuel comprises natural gas, the second input connector 1232 receives substantially no fuel from the intake valve 860, while the first input connector 1230 is in fluid communication with a fuel source that provides natural gas for combustion and heating. The natural gas flows in through the first input channel 1236 into the chamber 1242 and out of the chamber 1242 through the output channel 1240 and into the source line 125 of the heater 810. When the fuel comprises propane, the first input connector 1230 receives substantially no fuel from the intake valve 860, while the second input connector 1232 is in fluid communication with a fuel source that provides propane for combustion and heating. The propane flows in through the second input channel 1238 into the chamber 1242 and out of the chamber 1242 through the output channel 1240 and into the source line 125 of the heater 810.

Accordingly, in some embodiments, the regulator 1120 comprises a single input connector (e.g., the intake valve 860) that leads to the first input channel 1236 and the second input channel 1238. In certain of such embodiments, either a first pressurized source of liquid or gas or a second pressurized source of liquid or gas can be coupled with the intake valve 860, as described above. In some embodiments, a valve or other device is employed to seal or substantially seal one of the first input channel 1236 or the second input channel 1238 while leaving the remaining desired input channel 1236, 1238 open for fluid flow.

In certain embodiments, the second portion 1214 comprises a plurality of connection or mounting members or elements 1244 that can facilitate mounting of the regulator 1120 to a suitable surface of the heater 810. The connection members 1244 can comprise threads or other suitable interfaces for engaging pins, bolts, screws, or other fasteners to securely mount the regulator 1120. Other connectors or connecting devices such as, but not limited to, clamps, locks, rivet assemblies, and adhesives may be efficaciously used, as needed or desired.

In certain embodiments, the first portion 1212 comprises a first bonnet 1246, a second bonnet 1248, a first spring or resilient biasing member 1250 positioned in the bonnet 1246, a second spring or resilient biasing member 1252 positioned in the bonnet 1248, a first pressure adjusting or tensioning screw 1254 for tensioning the spring 1250, a second pressure adjusting or tensioning screw 1256 for tensioning the spring 1252 and first and second plunger assemblies 1258 and 1260 which extend into the housing 1218 of the second portion 1214. In some embodiments, the springs 1250, 1252 comprise steel wire. In some embodiments, at least one of the pressure adjusting or tensioning screws 1254, 1256 may be tensioned to regulate the pressure of the incoming fuel depending on whether the first or second fuel source is utilized. In some embodiments, the appropriate pressure adjusting or tensioning screws 1254, 1256 are desirably tensioned by a predetermined amount at the factory or manufacturing facility to provide a preset pressure or pressure range. In other embodiments, this may be accomplished by a technician who installs the heater 810. In many embodiments, caps 1231 are placed over the screws 1254, 1256 to prevent consumers from altering the preset pressure settings.

In certain embodiments, the first plunger assembly 1258 generally comprises a first diaphragm plate or seat 1262 which seats the first spring 1250, a first washer 1264 and a movable first plunger or valve stem 1266 that extends into the housing 1218 of the second portion 1214. The first plunger assembly 1258 is configured to substantially sealingly engage the diaphragm 1216 and extend through a first orifice 1294 of the diaphragm 1216.

In some embodiments, the first plunger 1266 comprises a first shank 1268 which terminates at a distal end as a first seat 1270. The seat 1270 is generally tapered or conical in shape and selectively engages a first O-ring or seal ring 1272 to selectively substantially seal or allow the first fuel to flow through a first orifice 1274 of the chamber 1242 and/or the first input channel 1236.

In certain embodiments, the tensioning of the first screw 1254 allows for flow control of the first fuel at a predetermined first pressure or pressure range and selectively maintains the orifice 1274 open so that the first fuel can flow into the chamber 1242, into the output channel 1240 and out of the outlet 1234 and into the source line 125 of the heater 810 for downstream combustion. If the first pressure exceeds a first threshold pressure, the first plunger seat 1270 is pushed towards the first seal ring 1272 and seals off the orifice 1274, thereby terminating fluid communication between the first input channel 1236 (and the first fuel source) and the chamber 1242 of the housing 1218.

In some embodiments, the first pressure or pressure range and the first threshold pressure are adjustable by the tensioning of the first screw 1254. In certain embodiments, the pressure selected depends at least in part on the particular fuel used, and may desirably provide for safe and efficient fuel combustion and reduce, mitigate, or minimize undesirable emissions and pollution. In some embodiments, the first screw 1254 may be tensioned to provide a first pressure in the range from about 3 inches of water column to about 6 inches of water column, including all values and sub-ranges therebetween. In some embodiments, the first threshold or flow-terminating pressure is about 3 inches of water column, about 4 inches of water column, about 5 inches of water column, or about 6 inches of water column. In certain embodiments, when the first inlet 1230 and the first input channel 1236 are being utilized to provide a given fuel, the second inlet 1232 is plugged or substantially sealed.

In certain embodiments, the first pressure regulator 1220 (and/or the first valve assembly 1224) comprises a vent 1290 or the like at the first portion 1212. The vent can be substantially sealed, capped, or covered by a dustproof cap or cover, often for purposes of shipping. The cover is often removed prior to use of the regulator 1120. In many embodiments, the vent 1290 is in fluid communication with the bonnet 1246 housing the spring 1250 and may be used to vent undesirable pressure build-up and/or for cleaning or maintenance purposes.

In certain embodiments, the second plunger assembly 1260 generally comprises a second diaphragm plate or seat 1276 which seats the second spring 1252, a second washer 1278 and a movable second plunger or valve stem 1280 that extends into the housing 1218 of the second portion 1214. The second plunger assembly 1260 substantially sealingly engages the diaphragm 1216 and extends through a second orifice 1296 of the diaphragm 1216.

In certain embodiments, the second plunger 1280 comprises a second shank 1282 which terminates at a distal end as a second seat 1284. The seat 1284 is generally tapered or conical in shape and selectively engages a second O-ring or seal ring 1286 to selectively substantially seal or allow the second fuel to flow through a second orifice 1288 of the chamber 1242 and/or the second input channel 1238.

In certain embodiments, the tensioning of the second screw 1256 allows for flow control of the second fuel at a predetermined second pressure or pressure range and selectively maintains the orifice 1288 open so that the second fuel can flow into the chamber 1242, into the output channel 1240 and out of the outlet 1234 and into the source line 125 of the heater 810 for downstream combustion. If the second pressure exceeds a second threshold pressure, the second plunger seat 1284 is pushed towards the second seal ring 1286 and seals off the orifice 1288, thereby terminating fluid communication between the second input channel 1238 (and the second fuel source) and the chamber 1242 of the housing 1218.

In certain embodiments, the second pressure or pressure range and the second threshold pressure are adjustable by the tensioning of the second screw 1256. In some embodiments, the second screw 1256 may be tensioned to provide a second pressure in the range from about 8 inches of water column to about 12 inches of water column, including all values and sub-ranges therebetween. In some embodiments, the second threshold or flow-terminating pressure is about equal to 8 inches of water column, about 9 inches of water column, about 10 inches of water column, about 11 inches of water column, or about 12 inches of water column. In certain embodiments, when the second inlet 1232 and the second input channel 1238 are being utilized to provide a given fuel, the first inlet 1230 is plugged or substantially sealed.

In certain embodiments, the second pressure regulator 1222 (and/or the second valve assembly 1226) comprises a vent 1292 or the like at the first portion 1212. The vent can be substantially sealed, capped or covered by a dustproof cap or cover. The vent 1292 is in fluid communication with the bonnet 1248 housing the spring 1252 and may be used to vent undesirable pressure build-up and/or for cleaning or maintenance purposes and the like.

In some embodiments, when natural gas is the first fuel and propane is the second fuel, the first pressure, pressure range and threshold pressure are less than the second pressure, pressure range and threshold pressure. Stated differently, in some embodiments, when natural gas is the first fuel and propane is the second fuel, the second pressure, pressure range and threshold pressure are greater than the first pressure, pressure range and threshold pressure.

Advantageously, the dual regulator 1120, by comprising first and second pressure regulators 1220, 1222 and corresponding first and second valves or valve assemblies 1224, 1226, which are selectively and independently operable facilitates a single heater unit being efficaciously used with different fuel sources. This desirably saves on inventory costs, offers a retailer or store to stock and provide a single unit that is usable with more than one fuel source, and permits customers the convenience of readily obtaining a unit which operates with the fuel source of their choice. The particular fuel pressure operating range is desirably factory-preset to provide an adaptable and versatile heater.

The pressure regulating device 1120 can comprise a wide variety of suitably durable materials. These include, but are not limited to, metals, alloys, ceramics, plastics, among others. In one embodiment, the pressure regulating device 1120 comprises a metal or alloy such as aluminum or stainless steel. The diaphragm 1216 can comprise a suitable durable flexible material, such as, but not limited to, various rubbers, including synthetic rubbers. Various suitable surface treatments and finishes may be applied with efficacy, as needed or desired.

In certain embodiments, the pressure regulating device 1120 can be fabricated or created using a wide variety of manufacturing methods, techniques and procedures. These include, but are not limited to, casting, molding, machining, laser processing, milling, stamping, laminating, bonding, welding, and adhesively fixing, among others.

Although the regulator 1120 has been described as being integrated in the heater 810, the regulator 1120 is not limited to use with heating devices, and can benefit various other applications. Additionally, pressure ranges and/or fuel-types that are disclosed with respect to one portion of the regulator 1120 can also apply to another portion of the regulator 1120. For example, tensioning of either the first screw 1254 or the second screw 1256 can result in pressure ranges between about 3 inches of water column and about 6 inches of water column or between about 8 inches of water column and about 12 inches of water column, in some embodiments.

Although various embodiments described herein are discussed in the context of two fuel systems, it is appreciated that various features described can be adapted to operate with more than two fuels. Accordingly, certain embodiments that have two operational configurations can be adapted for additional operational configurations. For example, certain embodiments may have at least two operational states (e.g., a first operational state, a second operational state, and a third operational state). Therefore, use herein of such terms as "either," "both," or the like should not be construed as limiting, unless otherwise indicated.

Although the inventions have been disclosed in the context of certain preferred embodiments and examples, it will be understood by those skilled in the art that the inventions extend beyond the specifically disclosed embodiments to other alternative embodiments and/or uses and obvious modifications and equivalents thereof. The skilled artisan will appreciate, in view of the present disclosure, that certain advantages, features and aspects of certain features disclosed herein may be realized in a variety of other applications, many of which have been noted above. Additionally, it is contemplated that various aspects and features of the inventions described can be practiced separately, combined together, or substituted for one another, and that a variety of combinations and sub-combinations of the features and aspects can be made and still fall within the scope of the inventions. Thus, it is intended that the scope of the inventions herein disclosed should not be limited by the particular embodiments described above.

In the foregoing description of embodiments, various features of the inventions are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

What is claimed is:

1. A heater apparatus comprising:

a burner;

an intake valve comprising:

a valve housing comprising:

a single input for receiving fuel from either a first fuel source at a first pressure or a second fuel source having a type of fuel different from the first fuel source at a second pressure different from the first pressure;

a first output for directing fuel received from said first fuel source;

a second output for directing fuel received from said second fuel source; and a valve body positioned within the valve housing and configured to permit fluid communication between the input and the first output or between the input and the second output; and a dual fuel pressure regulator comprising:

a first regulator having a first pressure range configured to regulate pressure of the fuel from the first fuel source within a first pressure range;

a second regulator having a second pressure range different from the first pressure range configured to regulate pressure of the fuel from the second fuel source within a second pressure range different from the first pressure range; and a pressure regulator casing that houses the first and second regulators, the pressure regulator casing comprising:

a first inlet in direct fluid communication with the first output of the intake valve, for receiving fuel from the first output of the intake valve and for directing fuel from the first output to the first regulator;

a second inlet in direct fluid communication with the second output of the intake valve for receiving fuel from the second output of the intake valve and for directing fuel from the second output to the second regulator; and a single outlet for directing fuel from the dual fuel pressure regulator toward the burner, the single outlet in fluid communication with both the first regulator and the second regulator;

wherein the dual fuel pressure regulator has a single flow path between the first inlet and the outlet being through the first regulator, and a single flow path between the second inlet and the outlet being through the second regulator;

wherein the intake valve is connected to the dual fuel pressure regulator such that there is a single fuel entry point, being the single inlet of the intake valve, and a single fuel exit point being the single outlet of the dual fuel pressure regulator.

2. The apparatus of claim 1, further comprising a pilot assembly.

3. The apparatus of claim 2, wherein the pilot assembly includes:

a thermocouple;

a first fuel dispenser positioned to direct a flame to the thermocouple; and a second fuel dispenser positioned to direct a flame to the thermocouple.

4. The apparatus of claim 1, further comprising a valve assembly in fluid communication with the burner and single outlet of the dual fuel pressure regulator, the valve assembly configured to direct fuel received from the output of the pressure regulator along either a first flow path or a second flow path to the burner.

5. The apparatus of claim 4, further comprising a pilot assembly having a first fuel dispenser and a second fuel dispenser, wherein the valve assembly is configured to direct fuel received from the output of the pressure regulator to either the first fuel dispenser or the second fuel dispenser.

6. The apparatus of claim 1, further comprising a housing defining a combustion chamber and an actuator coupled to the valve body, wherein at least a portion of the actuator is outside the combustion chamber.

7. The apparatus of claim 1, further comprising a housing defining a combustion chamber and an actuator coupled to the valve body, wherein the actuator is located within the combustion chamber.

8. The apparatus of claim 1, further comprising an outer casing and an actuator coupled to the valve body, wherein at least a portion of the actuator is outside the outer casing.

9. The apparatus of claim 1, further comprising an outer casing and an actuator coupled to the valve body, wherein the actuator is within the outer casing.

10. A heater apparatus comprising:

a burner;

a pilot assembly;

an intake valve comprising:

an input for receiving fuel from either a first fuel source or a second fuel source;

a first output for directing fuel received from said first fuel source;

a second output for directing fuel received from said second fuel source; and a first valve body configured to permit fluid communication between the input and the first output or between the input and the second output;

a dual fuel pressure regulator comprising:

a first regulator configured to regulate fluid pressure of a flow of fuel from the first fuel source within a first pressure range;

a second regulator configured to regulate fluid pressure of a flow of fuel from the second fuel source within a second pressure range different from the first pressure range; and a pressure regulator housing, the first and second regulators positioned within the pressure regulator housing, the pressure regulator housing comprising:

a first inlet for receiving fuel from the first output of the intake valve and for directing fuel from the first output to the first regulator;

a second inlet for receiving fuel from the second output of the intake valve and for directing fuel from the second output to the second regulator; and an outlet in fluid communication with both the first regulator and the second regulator;

wherein the intake valve is connected to the dual fuel pressure regulator such that there is a single fuel entry point, being the inlet of the intake valve, and a single fuel exit point being the outlet of the dual fuel pressure regulator; and a valve assembly comprising:

a housing defining an inlet, the dual fuel pressure regulator configured to direct fuel received from either the first output or the second output of the intake valve to the inlet of the valve assembly, the housing further defining a first egress flow path and a second egress flow path; and a second valve body configured to direct fuel along the first egress flow path toward the burner and to direct fuel along the second egress flow path toward the pilot assembly.

11. The apparatus of claim 10, further comprising a first nozzle member configured to receive fuel from the first fuel source and a second nozzle member configured to receive fuel from the second fuel source.

12. The apparatus of claim 10, further comprising an actuator configured to permit fluid communication between the input and the first output or between the input and the second output.

13. The apparatus of claim 10, further comprising a housing defining a combustion chamber, wherein at least a portion of a first actuator is outside the combustion chamber.

14. The apparatus of claim 10, further comprising a housing defining a combustion chamber, wherein a first actuator is located within the combustion chamber.

15. The apparatus of claim 10, further comprising an outer casing, wherein at least a portion of a first actuator is outside the outer casing.

16. The apparatus of claim 10, further comprising an outer casing, wherein the first valve body is within the outer casing.

17. A heating apparatus comprising:

an intake valve comprising:

a valve housing comprising:

an input port configured for connecting to either a first fuel source having a first fuel or a second fuel source having a second fuel of a different type than the first fuel and receiving a flow of fuel therefrom;

a first output; and a second output, the valve housing configured to direct the flow of fuel through the intake valve by permitting fluid communication between the input port and the first output or between the input and the second output; and a dual fuel pressure regulator comprising:

a first regulator having a first pressure range configured to regulate fluid pressure of the flow of fuel from the first fuel source within a first pressure range;

a second regulator having a second pressure range different from the first pressure range configured to regulate fluid pressure of the flow of fuel from the second fuel source within a second pressure range different from the first pressure range; and a pressure regulator housing, the first and second regulators positioned within the pressure regulator housing, the pressure regulator housing comprising:

a first inlet for receiving fuel from the first output of the intake valve and for directing fuel from the first output to the first regulator;

a second inlet for receiving fuel from the second output of the intake valve and for directing fuel from the second output to the second regulator; and an outlet in fluid communication with both the first regulator and the second regulator;

wherein the dual fuel pressure regulator has a single flow path between the first inlet and the outlet being through the first regulator, and a single flow path between the second inlet and the outlet being through the second regulator;

wherein the intake valve is connected to the dual fuel pressure regulator such that there is a single fuel entry point, being the inlet of the intake valve, and a single fuel exit point being the outlet of the dual fuel pressure regulator.

18. The heating apparatus of claim 17, further comprising a burner, a pilot assembly, and a valve assembly configured to receive the flow of fuel from the outlet of the dual fuel pressure regulator and direct the flow of fuel to the burner and to separately direct the flow of fuel to the pilot assembly.

19. The apparatus of claim 17, further comprising an actuator configured to permit fluid communication between the input and the first output or between the input and the second output.

* * * * *